US008152273B2

(12) United States Patent
Osumi et al.

(10) Patent No.: US 8,152,273 B2
(45) Date of Patent: Apr. 10, 2012

(54) WASTE INK ABSORBENT MEMBER, AND WASTE INK CONTAINER AND INK JET RECORDING APPARATUS EQUIPPED WITH WASTE INK ABSORBENT MEMBER

(75) Inventors: Koichi Osumi, Tokyo (JP); Sadayuki Sugama, Tsukuba (JP); Shinichi Hakamada, Kawasaki (JP); Junichi Sakai, Machida (JP); Yasuhiro Nito, Yokohama (JP); Katsuhiko Suzuki, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 1131 days.

(21) Appl. No.: 11/916,567

(22) PCT Filed: Jun. 29, 2006

(86) PCT No.: PCT/JP2006/313439

§ 371 (c)(1),
(2), (4) Date: Dec. 5, 2007

(87) PCT Pub. No.: WO2007/004686

PCT Pub. Date: Jan. 11, 2007

(65) Prior Publication Data

US 2009/0231388 A1 Sep. 17, 2009

(30) Foreign Application Priority Data

Jun. 30, 2005 (JP) ..... 2005-192086
Jun. 30, 2005 (JP) ..... 2005-192608
Jun. 30, 2005 (JP) ..... 2005-192609
Jul. 8, 2005 (JP) ..... 2005-200533

(51) Int. Cl.
*B41J 2/165* (2006.01)

(52) U.S. Cl. ..... 347/36

(58) Field of Classification Search ..... 347/36
See application file for complete search history.

(56) References Cited

U.S. PATENT DOCUMENTS 6,252,615 B1 6/2001 Yoshino
6,280,513 B1 8/2001 Osumi et al.
6,375,305 B2 4/2002 Sugimoto et al.
6,425,662 B1 7/2002 Teraoka et al.
6,623,099 B2 * 9/2003 Matsumura ..... 347/35
6,722,755 B2 4/2004 Shigeno (Continued)

FOREIGN PATENT DOCUMENTS

EP 1 577 353 A1 9/2005

(Continued)

OTHER PUBLICATIONS

International Preliminary Report on Patentability in PCT Application No. PCT/JP2006/313439, dated Jan. 17, 2008.

(Continued)

*Primary Examiner* — Jerry Rahll
(74) *Attorney, Agent, or Firm* — Fitzpatrick, Cella, Harper & Scinto

(57) ABSTRACT

To provide a waste ink absorbing tank, capable, even in the case of utilizing an ink of a high coagulating property, of causing a waste ink absorbent member to efficiently absorb such ink. A waste ink absorbent member has a hole portion corresponding to an introducing position of the waste ink, and the hole portion is opened on a lateral face of the absorbent member. The waste ink, introduced into the hole portion moves in one direction toward the waste ink absorbent member and absorbed therein.

11 Claims, 28 Drawing Sheets

U.S. PATENT DOCUMENTS

| | | | | |
|---|---|---|---|---|
| 6,786,567 | B1 | 9/2004 | Yoshino | |
| 6,890,057 | B2 | 5/2005 | Gotoh et al. | |
| 7,371,274 | B2 | 5/2008 | Sanada et al. | 106/31.27 |
| 2005/0024458 | A1 | 2/2005 | Sanada et al. | 347/100 |
| 2008/0106581 | A1 | 5/2008 | Sanada et al. | 347/86 |

FOREIGN PATENT DOCUMENTS

| | | |
|---|---|---|
| JP | 6-226995 | 8/1994 |
| JP | 8-118678 | 5/1996 |
| JP | 10-278303 | 10/1998 |
| JP | 2000-063719 | 2/2000 |
| JP | 2000-127439 | 5/2000 |
| JP | 2000-198955 | 7/2000 |
| JP | 2000-198956 | 7/2000 |
| JP | 2001-105626 | 4/2001 |
| JP | 2002-225313 | 8/2002 |
| JP | 2003-266741 | 9/2003 |
| JP | 2004-034412 | 2/2004 |
| JP | 2005-119210 | 5/2005 |
| WO | WO 01/60622 A1 | 8/2001 |
| WO | 2004-061023 A1 | 7/2004 |

OTHER PUBLICATIONS

Search Report in European Patent Office Application No. 06780815.4-2304/1899166 PCT/JP2006313439, dated Dec. 18, 2009.

Notification of First Office Action (PCT application Entering the Chinese National Phase) in PCT Application No. PCT/JP2006/800238028, dated May 22, 2009.

* cited by examiner

WASTE INK ABSORBENT MEMBER, AND WASTE INK CONTAINER AND INK JET RECORDING APPARATUS EQUIPPED WITH WASTE INK ABSORBENT MEMBER

TECHNICAL FIELD

The present invention relates to a waste ink absorbent member capable of efficiently absorbing and holding a waste liquid, generated in an ink jet recording apparatus and not contributing to a recording, a waste ink container provided with such waste ink absorbent member and an ink jet recording apparatus provided with such waste ink container.

BACKGROUND ART

In relation to a recording of an ink jet method, it is already disclosed, for attaining a higher quality in a recorded image (such as an improvement in a character quality and an improvement in a bleeding resistance, to use an ink or an ink set, employing a pigment as a colorant and not employing a reactive liquid (Japanese Patent Application Laid-open No. 2000-198956). There is also proposed an ink which utilizes an ink composition employing a pigment as a colorant and a reaction liquid that renders the colorant in the ink composition unstable, wherein a reaction of two liquids is utilized to coagulate the colorant, thereby suppressing a blotting or a color mixing (bleeding) of the ink on a plain paper (Japanese Patent Application Laid-open No. 2000-63719).

There is also known an ink jet recording apparatus equipped, for maintaining a proper discharge operation from a recording head, with a suction recovery mechanism for forcedly sucking the ink from a discharge port. In such ink jet recording apparatus, a waste ink is absorbed and held in a waste ink absorbent member.

On the other hand, in order to meet requirements for a higher image quality and a higher fastness of recording on a plain paper, inks utilizing a water-insoluble pigment as a colorant are also being developed. Such inks include, for example, a two-liquid ink set utilizing an ink containing a colorant and a second ink that reacts with such ink thereby accelerating a coagulation, and a one-liquid ink showing a high coagulating property immediately after the deposition on a recording medium and not relying on a reactive ink. An ink showing a high coagulating property of the colorant on a paper is preferable for attaining a high quality recording on a plain paper, but such ink will also show a high coagulating property in the waste ink, and it becomes important to efficiently absorb the waste ink, showing such high coagulating property, in an absorbent member.

Technologies relating to the waste ink recovery include a waste ink absorbent member having a hole portion (Japanese Patent Application Laid-open No. 2004-34412), and a structure so constructed that a pigment-based ink and a dye-based ink are dropped in mutually close regions in a waste ink absorbent member to mix both inks, thereby suppressing generation of a coagulated substance of the waste ink (Japanese Patent Application Laid-open No. 2002-225313). It is also proposed, in order to facilitate replacement of a waste ink absorbent member, to provide a part of the waste ink absorbent member with a hole portion (Japanese Patent Application Laid-open No. H6-226995).

As a prior structure for storing the waste liquid, a waste ink tank, having a recess extending in a position including an entrance of the waste liquid, is proposed (Japanese Patent Application Laid-open No. 2000-127493). Also proposed is a waste ink tank, having a penetrating hole in which the waste ink is to be dropped and notched grooves formed radially from the penetrating hole (Japanese Patent Application Laid-open No. 2001-105626).

In the field of the ink jet recording apparatus, there is already known, in order to improve a water resistance and an image quality of an obtained record, a technology of depositing a liquid that reacts with an ink to insolubilize the ink or to generate an agglomeration therein (hereinafter such liquid being called a reaction liquid), onto a recording medium prior to the ink deposition. The reaction liquid is also discharged, as in the case of ink, from a discharge port and generates a waste liquid in order to maintain a proper discharge state, so that, in a system utilizing such reaction liquid, the forcedly discharged reaction liquid is also absorbed and stored, like the ink, in a waste ink absorbent member. In such system, in case the ink and the reaction liquid are mutually contacted on or in the ink absorbent member, a coagulated substance will be formed and the waste reaction liquid or the waste ink may overflow from the ink absorbent member, before it can sufficiently exhibits its absorbing property. Therefore, Japanese Patent Application Laid-open Nos. H8-118678 and H10-278303 disclose technologies of absorbing the waste reaction liquid and the waste ink from positions, as mutually separate as possible, of the waste ink absorbent member.

DISCLOSURE OF THE INVENTION

The absorption of the waste ink, generated at an image formation by an ink jet recording apparatus, into the waste ink absorbent member may be achieved in various structures, for example a structure in which an entire entrance for the waste ink is in direct contact with a waste ink absorbent member, a structure in which a part of the waste ink entrance is in contact with the waste ink absorbent member, and a structure in which the waste ink entrance is not in contact at all with the waste ink absorbent member, and still other structures are also conceivable.

The present inventors have undertaken an investigation on the shape of the waste ink absorbent member, in order to improve the absorbing ability thereof. As a result, there is found a new problem that, depending on the ink characteristics, the absorbing ability of the waste ink absorbent member is lost before the waste ink spreads over the entire waste ink absorbent member, whereby the waste ink leaks from the waste ink absorbent member. In order to clarify the cause of such phenomenon, the present inventors have investigated a relationship between the ink characteristics and the absorbing ability of the waste ink absorbent member. As a result, it is found that such phenomenon becomes more conspicuous in an ink showing a better bleeding resistance in the image formed on the recording medium. In particular, a pigment-based ink utilizing a pigment as the colorant and a solvent which is a poor solvent for the pigment is capable of significantly improving the bleeding resistance in comparison with the prior pigment-based inks to become not de-dissolvable, but such ink tends to extremely deteriorate the waste ink absorbing ability of the waste ink absorbent member, as the pigment loses dispersion stability on or in the waste ink absorbent member, because of a lower water evaporation rate in comparison with the prior pigment-based inks.

Therefore, the present inventors have further made an investigation on a waste ink absorbent member to be used for an ink, which is improved in the bleeding resistance in comparison with the prior inks, and have found that the prior technologies have involved following drawbacks for the waste liquid absorption.

In Japanese Patent Application Laid-open No. 2004-34412, as shown in FIGS. 1A and 1B, a waste ink absorbent member 102 in a tank main body 111 is provided with a hole portion 106, with a projection 113 on a bottom thereof. The waste ink is dropped onto the projection 113 as shown in FIG. 1B. The dropped waste ink is thereafter scattered as indicated by arrows in FIG. 1A and is absorbed by the waste ink absorbent member 102. However, according to the investigation undertaken by the present inventors, it is found, in the course of scattering of the dropped waste ink, that an ink with a high coagulating property remains on the projection 113. Such remaining waste ink dries to form a coagulate, which becomes a nucleus for a growth of the coagulate, whereby an overflow of the waste ink is induced.

Also Japanese Patent Application Laid-open No. 2002-225313 proposes to suppress formation of a coagulate by mixing an ink of a high coagulating property and a water-soluble ink such as a dye-based ink, but such method may not provide a sufficient effect in an ink improved in the coagulating property as investigated by the present inventors, and may rather stimulate the formation of the coagulate in certain inks.

Also Japanese Patent Application Laid-open No. H6-226995 intends an improvement of detach-attaching operation of the waste ink absorbent member in a housing, but does not consider an improvement in the absorption efficiency. Stated differently, it does not consider at all the relationship between the diffusion of the waste ink and the waste ink absorbent member, as contemplated by the present inventors.

Therefore, the present inventors have undertaken investigations with a target of maintaining the absorbing ability in a waste ink absorbent member as employed in the prior technologies, even in combination with an ink showing an excellent bleeding resistance on the recording medium, and the present invention has been made in consideration of such target.

Also as a result of investigations undertaken by the present inventors on an improvement of the ink for a further improvement in the imaging characteristics such as an image density and a bleeding suppressing ability, it is found that higher imaging characteristics can be attained in an ink that shows a decrease in the dispersion stability or a viscosity increase more instantly for example by a water evaporation. It is also found out that such ink, showing an instant decrease in the dispersion stability by a water evaporation, shows a lower absorption into the waste ink absorbent member in comparison with the prior inks, and that the waste ink absorbent member, as disclosed in the prior technologies, may not provide a sufficient absorbing ability.

Japanese Patent Application Laid-open Nos. 2000-127439 and 2001-105626 disclose that a recess or a notched groove extending from a position, including an introducing position for the waste liquid, allows to prevent a phenomenon that the waste liquid evaporates in the vicinity of the introducing position thereby losing the fluidity. However, an ink showing an instant decrease in the dispersion stability by a water evaporation, as investigated by the present inventors, causes a pigment solidification in a dropping position of the waste ink liquid, more specifically when the waste liquid contacts the waste ink absorbent member before it loses the fluidity. As a result, the waste liquid thereafter dropping in the same position is deposited on the solidified substance as a nucleus, thereby eventually blocking the ink flow into the recess or the notched groove. Therefore, the waste liquid may overflow from the vicinity of the introducing portion for the waste liquid, before the recess or the notched groove can be fully utilized, whereby the entire waste ink absorbent member cannot be effectively utilized.

Japanese Patent Application Laid-open No. 2001-105626 further discloses a structure of overlaying, in the vertical direction, plural waste ink absorbent members with notched grooves thereof in a mutually displaced relationship. As a result of investigation undertaken by the present inventors, such structure is found to involve following problems. When the waste liquid deposited in the notched groove of a lower waste ink absorbent member reaches a certain amount, the waste liquid starts to contact an upper waste ink absorbent member, which thus also starts to absorb the waste liquid. In such process, a solid-liquid separation proceeds between a liquid component such as water or a solvent in the waste liquid and a solid component such as a colorant. It is confirmed that, as the liquid component has a higher permeability, the upper waste ink absorbent member absorbs a waste liquid portion relatively richer in the liquid component. On the other hand, a waste liquid portion relatively richer in the solid component remains in the notched groove of the lower absorbent member. As a result, the notched groove of the lower absorbent member stimulates a viscosity increase of the waste liquid and a coagulate formation, whereby the waste liquid is blocked in the notched groove or at the introducing part for the waste liquid and the entire waste ink absorbent member cannot be utilized effectively (first target).

Therefore, a first target is, in the case of utilizing an ink showing an excellent bleeding resistance on a recording medium, to efficiently absorb and hold the waste liquid, even in case of an ink in which a colorant becomes rapidly unstable for example by a water evaporation to hinder a displacement or a diffusion of the ink into the waste ink absorbent member thereby reducing the absorbing ability thereof.

Also in order to improve the bleeding suppressing ability, a black ink or a color ink is generally so made as to coagulate easily. Therefore, because of the current requirement for a further improvement in the bleeding suppressing ability for the ink and the ink set, the ink itself tends to easily solidify, and a phenomenon, that the waste liquid solidifies in a path for guiding the waste liquid into the waste ink absorbent member thereby deteriorating the reliability of the system, is becoming noticeable and thus constitutes a new target. Besides, the present inventors find that such ink, deteriorating the absorbing ability of the waste ink absorbent member by an evaporation of the ink, leads to an ink overflow before the waste ink absorbent member can fully exhibit its waste ink absorbing ability, thus constituting a new problem.

In order to prevent an overflow of the waste ink, it is conceivable to increase a volume of the waste ink absorbent member. However, as a compactness and a design property are recently becoming more and more important in the ink jet recording apparatuses, the waste ink absorbent member is often restricted in its volume and area of installation.

Also the ink jet recording apparatus is used by replacing an ink tank or an ink cartridge for both the black ink and the color ink by a number of times, and, in such mode of use, a necessary waste ink absorbing capacity varies depending on whether the user principally uses the black ink or the color inks. Therefore, there is desired a configuration capable of fully exploiting the waste ink absorbing ability of the waste ink absorbent member in any mode of use.

Also recently, as an ink set satisfactory in a color developing property and a bleeding suppressing ability, there is often employed an ink set, constituted of a black ink utilizing a pigment as the colorant and color inks utilizing dyes as the colorant. In such ink set, the waste inks of the black ink and the color ink are introduced into the waste ink absorbent member, more effectively at a same position or at mutually adjacent positions, rather than at mutually separate positions. This is because the absorbing ability of the waste ink absorbent member can be fully exploited by re-dissolving (re-dispersing), by the color ink, a solidified substance generated from the black ink in or on the waste ink absorbent member. It is however found, in a recent ink set in which the colorant, the solvent and the additives in the ink are so designed as to facilitate formation of a coagulated substance on the paper thereby improving the image property such as the bleeding suppressing ability and the like, that the introduction of the waste inks in a same position or in adjacent positions does not achieve a re-dissolving (re-dispersion) but rather results in a new phenomenon of accelerating a loss in the dispersion stability of the colorant. Therefore the present inventors confirms a target of fully exploiting the absorbing ability of the waste ink absorbent member, even for an ink set with improved color developing property and bleeding suppressing ability, in the same manner as in the prior ink set.

In the case of introducing the waste inks in a same position or in adjacent positions, a diffusion rate of a mixture of the black ink and the color inks into the waste ink absorbent member is found to be extremely lower in a recent ink set, which promotes coagulation of the colorant, in comparison with the prior ink set in which the generated solidified substance can be re-dispersed. This is presumably because a mixed liquid of the black ink and the color inks of the recent ink set has characteristics that are quite different from those of a mixture of the black ink and the color inks of the prior ink set, so that the generated solid substances also show a difference in a re-dissolving property.

In the ink jet recording apparatuses, a compactness and a design property are recently becoming more and more important, so that the internal mechanisms are faced with larger restrictions. Therefore the waste ink absorbent member may be restricted in its volume, and an area and a position of installation thereof. Thus, in a case of utilizing an ink set with a satisfactory bleeding suppressing ability and introducing the waste inks in a same position or in adjacent positions whereby the colorant coagulation is promoted, the waste ink absorbent member cannot be utilized efficiently but may become unable to absorb the waste inks while the absorbing ability thereof still remains. When the waste ink absorbent member becomes unable to absorb the waste inks, such waste inks may overflow from the waste ink absorbent member thereby deteriorating the reliability of the system.

Therefore, a second object to be attained by the present invention is to avoid, even in an ink set with a bleeding suppressing ability that is improved over the prior technologies, an overflow of the waste inks from the waste ink absorbent member, leading to a deteriorated reliability (second target).

The aforementioned first target is accomplished, according to the present invention, by a waste ink absorbent member, adapted for use in an ink jet recording apparatus for forming an image with a liquid containing a solvent and a colorant, in which the solvent includes a poor solvent for the colorant, and adapted for absorbing a waste liquid derived from the above-mentioned liquid, wherein the waste liquid is in contact, in at least a part thereof, with the waste ink absorbent member and an absorbing ability of the waste ink absorbent member for the waste liquid is variable depending on a contact area between the waste liquid and the waste ink absorbent member.

The aforementioned first target is also accomplished by a waste ink absorbent member, adapted for use in an ink jet recording apparatus for forming an image with an ink, and adapted for absorbing and holding a waste liquid which does not contribute to the image formation, wherein the waste ink absorbent member includes a hole portion including a position where the waste liquid is introduced and a slit extending from the hole portion, in which a connecting part between the hole portion and the slit has a width smaller than a shortest dimension in the hole portion, passing through a center of the introducing position of the waste liquid.

The aforementioned second target is accomplished by a waste ink absorbent member, adapted for use in an ink jet recording apparatus executing an image formation with a first liquid containing a solvent and a colorant, in which the solvent includes a poor solvent for the colorant, and a second liquid containing a solvent constituting a poor solvent for the colorant of the first liquid and having a property of forming a barrier upon contacting the first liquid on a surface of the waste ink absorbent member, and adapted for absorbing a waste liquid derived from the first liquid and a waste liquid derived from the second liquid, wherein an introducing position of the waste liquid derived from the first liquid and an introducing position of the waste liquid derived from the second liquid, with respect to the waste ink absorbent member, are mutually separated by such a distance that, when the waste liquids are introduced into the waste ink absorbent member, the solvent contained in the waste liquid derived from the first liquid can singly diffuse or displace in the waste ink absorbent member and that thus displaced waste liquid and the waste liquid derived from the second liquid can mutually contact.

The aforementioned second target is also accomplished by an ink jet recording apparatus in which, at least a waste liquid derived from a first liquid and having a relatively smaller diffusion rate into a waste ink absorbent member and a waste liquid derived from a second liquid and having a relatively larger diffusion rate into the waste ink absorbent member are introduced from respectively different introducing positions into the waste ink absorbent member, wherein the introducing position for the waste liquid derived from the first liquid is positioned higher than the introducing position for the waste liquid derived from the second liquid.

The waste ink absorbent member of the present invention allows, even in case of utilizing an ink, having a high bleeding preventing effect and a high coagulating property, to efficiently absorb a waste liquid of such ink.

Also even in the case of an ink set with a further improved bleeding suppressing ability, the waste ink absorbent member can efficiently absorb a waste ink derived from such ink set, without causing an overflow of the waste ink from the waste ink absorbent member, thereby avoiding deterioration of the reliability.

BEST MODE FOR CARRYING OUT THE INVENTION

First Embodiment for Accomplishing the First Target

In the following, a first embodiment for accomplishing the first target will be explained with reference to the accompanying drawings.

At first, a phenomenon that "a waste ink absorbent member has different absorbing properties on the waste liquid" will be explained in detail.

Figure 1A:
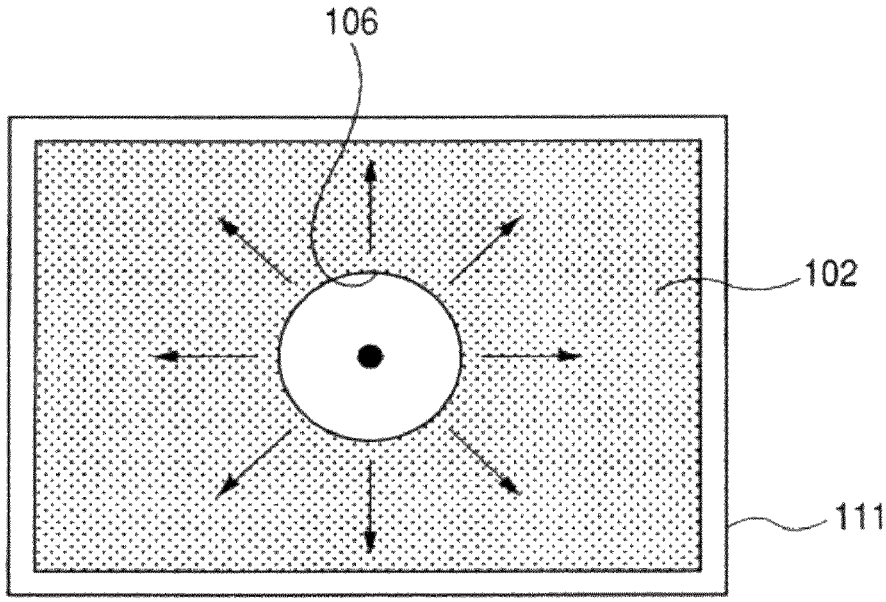
PRIOR ART FIG. 1A
FIGS. 1A and 1B are respectively a plan view and a lateral cross-sectional view showing a structure of a prior waste ink tank.
Figure 1B:
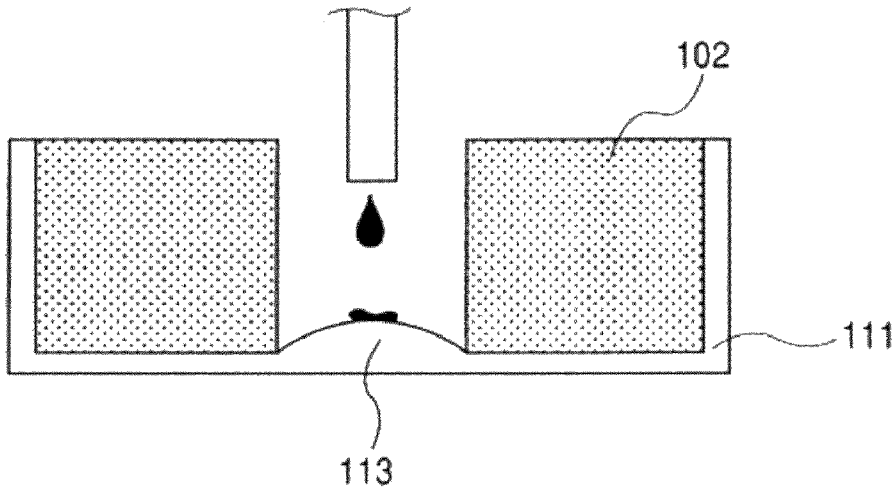
PRIOR ART FIG. 1B
Figure 2A:
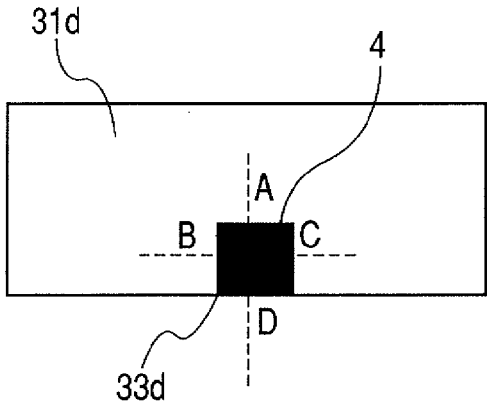
FIGS. 2A and 2B are plan views showing absorption states of waste ink in a hole portion formed in a waste ink absorbent member and having an open part, respectively showing a state in which the waste ink is dropped and a state in which the waste ink is absorbed in the absorbent member.
Figure 2B:
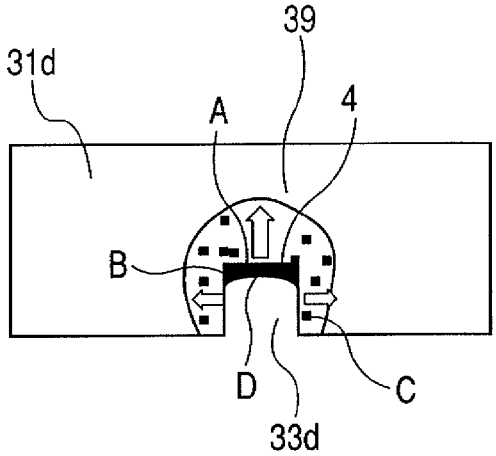

FIGS. 2A and 2B respectively show a state in which the waste ink is introduced into a hole portion and a state in which the waste ink is being absorbed in the absorbent member. In such structure, an amount of the waste liquid, absorbed from an internal surface A of the hole portion, is larger than that absorbed from an internal surface B or C. Such phenomenon can be explained by a surface energy of the waste liquid, at an external periphery thereof. In the drawings, 39 indicates an absorption area of the waste liquid.

Figure 3A:
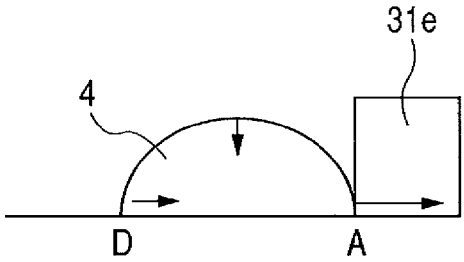
FIGS. 3A and 3B are lateral cross-sectional views, respectively along a line A-D and a line B-C in FIGS. 2A and 2B, showing an absorption state of the waste ink in the hole portion of the waste ink absorbent member shown in FIGS. 2A and 2B.

Now, a surface energy of the waste liquid at an external periphery will be explained. FIG. 3A is a cross-sectional view along a line connecting faces A-D shown in FIG. 2A. In FIG. 3A, the waste liquid has different surface energies in a portion A in contact with the waste ink absorbent member and in a portion D not in contact with the waste ink absorbent member. As a result, the waste liquid moves in a direction toward a portion in contact with the waste ink absorbent member.

Figure 3B:
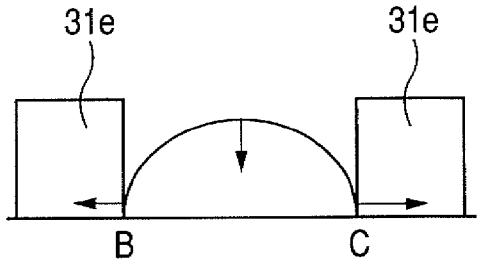

On the other hand, FIG. 3B is a cross-sectional view along a line connecting faces B-C shown in FIG. 2A. In FIG. 3A, as the portions B and C are both in contact with the waste ink absorbent member, the surface energy of the waste liquid becomes equilibrated between B and C. As a result, faces B and C try to absorb the waste liquid with a same force into the waste ink absorbent member.

As a result, the waste liquid introduced into the hole portion shown in FIG. 2A is subjected to different absorbing abilities depending on the direction, and, as a result, a waste ink absorption state in the waste ink absorbent member as shown in FIG. 2B is realized.

In the present specification, such phenomenon, showing different absorbing abilities among the portions in contact with the waste ink absorbent member, will be called a phenomenon of different absorbing abilities.

In a waste ink absorbent member, so constructed as to show a different absorbing ability in a specified direction, causes the waste ink, dropped into the hole portion formed in the waste ink absorbent member, to move in the specified direction. For example, the waste ink facing D in FIG. 2A, moves by being pulled toward the internal face A as shown in FIG. 3A and does not remain in the hole portion.

Figure 4:
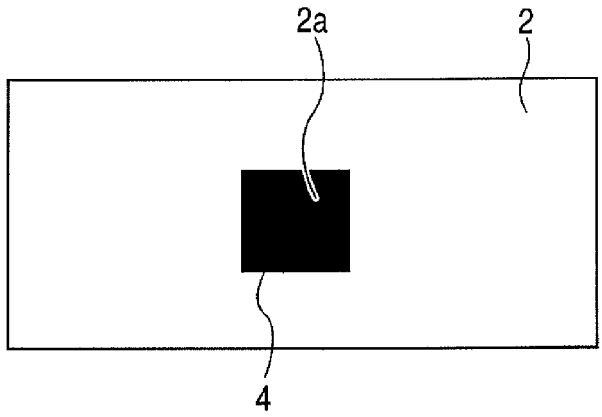
FIG. 4 is a plan view showing another example of the hole portion provided in the waste ink absorbent member.
Figure 5A:
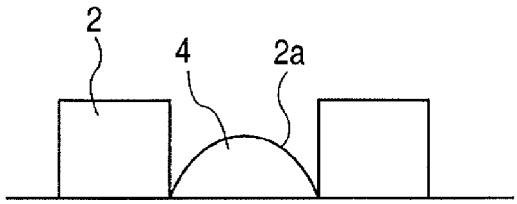
FIGS. 5A and 5B are lateral cross-sectional views, showing absorption of the waste ink in the structure shown in FIG. 4, respectively showing a state in which the waste ink is dropped and a state in which the waste ink is absorbed in the absorbent member and remains partially.
Figure 5B:
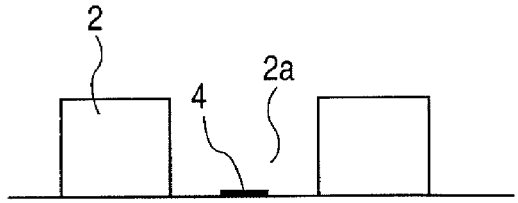

On the other hand, FIGS. 4 and 5A show a state, in a waste ink absorbent member 2 having a hole portion 2*a* without an open part, immediately after the waste ink 4 is introduced into the hole portion 2*a*. The internal periphery of the hole portion 2*a* is not subjected to a hydrophilic treatment nor a water-repellent treatment. In the illustrated state, the waste liquid 4 is in contact, over the entire periphery thereof, with the waste ink absorbent member 2. Therefore the waste liquid 4, having a same contacting material over the entire periphery, shows a same surface energy over the entire periphery. Therefore, the surface energy of the waste ink 4 is estimated to be in an equilibrated state in the approximate center of the waste liquid 4, and, as the waste ink 4 is absorbed from the entire external periphery thereof, the waste liquid 4 remains, as shown in FIG. 5B, in a central portion thereof where the surface energy is in an equilibrated state. Thereafter, the remaining waste ink 4 coagulates to form a nucleus of a coagulate growth which may hinder absorption and diffusion of the waste ink 4 into the waste ink absorbent member 2. Therefore, such hole portion 2*a* is not preferable.

The aforementioned state that "waste ink absorbent member has different absorbing properties on the waste liquid" may be realized, for example, by forming a hole portion corresponding to an introducing position of the waste liquid, and by causing an internal surface area of the hole portion, contacted by the waste liquid, not to generate an equilibrated state in the surface energy of the waste liquid.

However, such structure is merely an example, and any other structure, that realizes different absorbing abilities of the waste ink absorbent member for the waste liquid, may also be utilized.

Figure 6A:
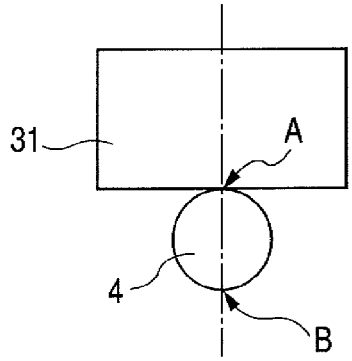
FIGS. 6A and 6B are respectively a plan view and a cross-sectional view, showing a structure of a hole portion providing an uneven interfacial energy in an area contacted by a drop of the waste ink.
Figure 6B:
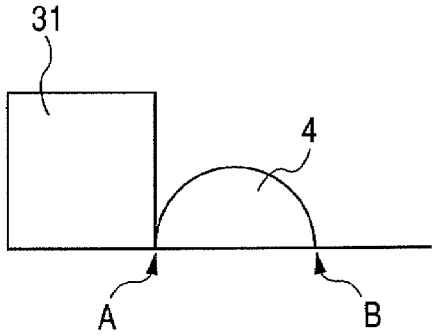

"Areas contacted by the waste ink" above means, as indicated by areas A and B in FIGS. 6A and 6B, positions where the waste ink 4 is in contact with at least two of a bottom face, air and a waste ink absorbent member 31.

An example of the method in which areas, contacted by the waste liquid present in the vicinity of a waste ink introducing portion, do not generate an equilibrated state of the surface energy of the waste liquid, includes a hole portion formed in a waste ink absorbent member, having an aperture part, opened on a lateral face of the waste ink absorbent member.

Figure 7A:
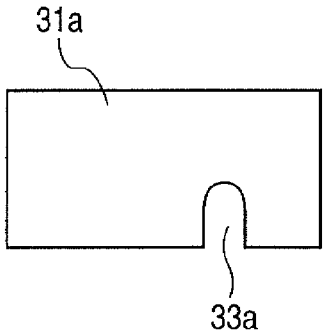
FIGS. 7A, 7B and 7C are plan views showing various examples of the hole portion provided in the waste ink absorbent member and having an open part.
Figure 7B:
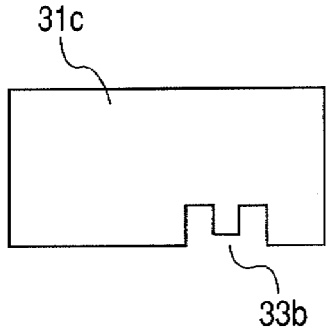
Figure 7C:
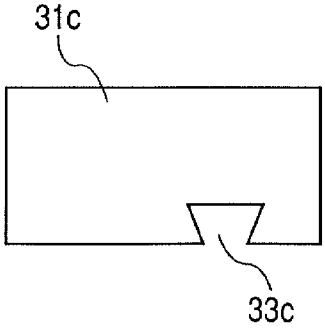

FIGS. 7A to 7C show examples of the waste ink absorbent member having such hole portion. In a waste ink absorbent member 31*a* shown in FIG. 7A, a hole portion 33*a* has a semi-circular distal end. A waste ink absorbent member 31*b* shown in FIG. 7B is provided with a hole portion 33*b* of a shape, formed by connecting base portions of two mutually distanced slits. In a waste ink absorbent member 31*c* shown in FIG. 7C, a hole portion 33*c* becomes wider toward a distal end. Any of the hole portions 33*a* to 33*c* is not a closed hole but is partially opened on a lateral face of the waste ink absorbent members 31*a* to 31*c*.

Another example of the method for realizing different absorbing abilities for the waste liquid on the waste ink absorbent member is to treat the waste ink absorbent member in such a manner that the waste liquid has at least two different surface energies. A specific example is to apply a hydrophilic treatment or a water-repellent treatment on a part of the internal surface of the pore portion. For rendering a part of the internal surface of the hole portion hydrophilic or water-repellent, there can be conceived a method of executing a hydrophilic treatment or a water-repellent treatment on the waste ink absorbent member itself in a part of the internal surface of the hole portion, or a method of constructing a part of the internal surface of the hole portion by a separate member having a surface energy different from that of the waste ink absorbent member.

Figure 8:
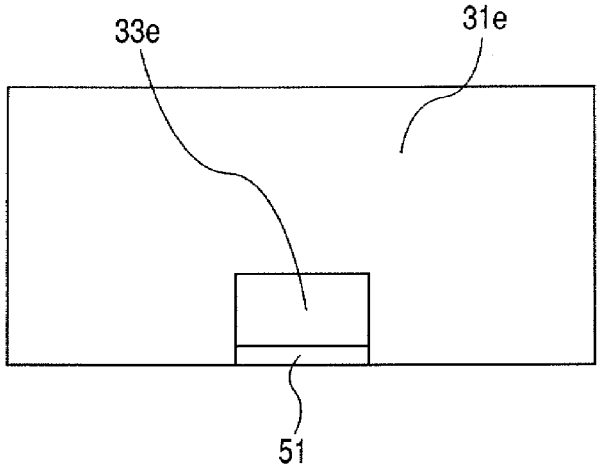
FIG. 8 is a plan view showing an example of a waste ink absorbent member, so constructed as to provide an internal surface of a hole portion with at least two different surface energies.

An example of the latter method is shown in FIG. 8. A waste ink absorbent member 31*e* shown in FIG. 8 includes a hole portion 33*e*, and a plate 51 is so mounted as to close an open part of the hole portion 33*e*. The plate 51 is formed for example by a resinous material, which does not absorb the ink. The plate 51 may be subjected to a water-repellent treatment at least on a surface constituting an inner surface of the hole portion 33*e*.

Absorption of the use ink in this case into the waste ink absorbent member will be explained with reference to FIGS. 9A and 9B, and to FIG. 10 which is a cross-sectional view along a line E-F in FIG. 9A. In the following, a case where the plate 51 is subjected to a water-repellent treatment will be explained as an example.

Figure 9A:
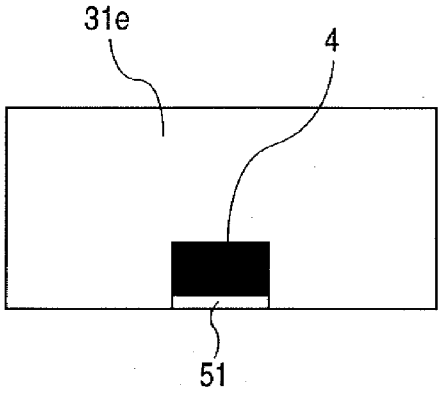
FIGS. 9A and 9B are plan views showing a waste ink absorption in the structure shown in FIG. 8, respectively showing a state in which the waste ink is dropped and a state in which the waste ink is absorbed in the absorbent member.
Figure 9B:
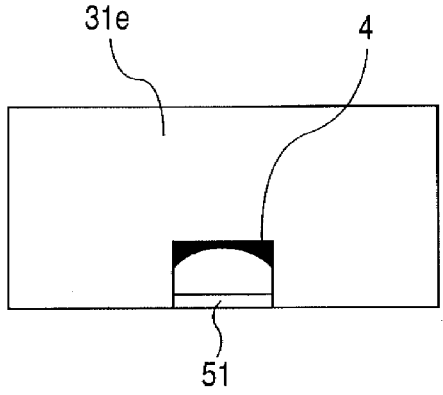
Figure 10:
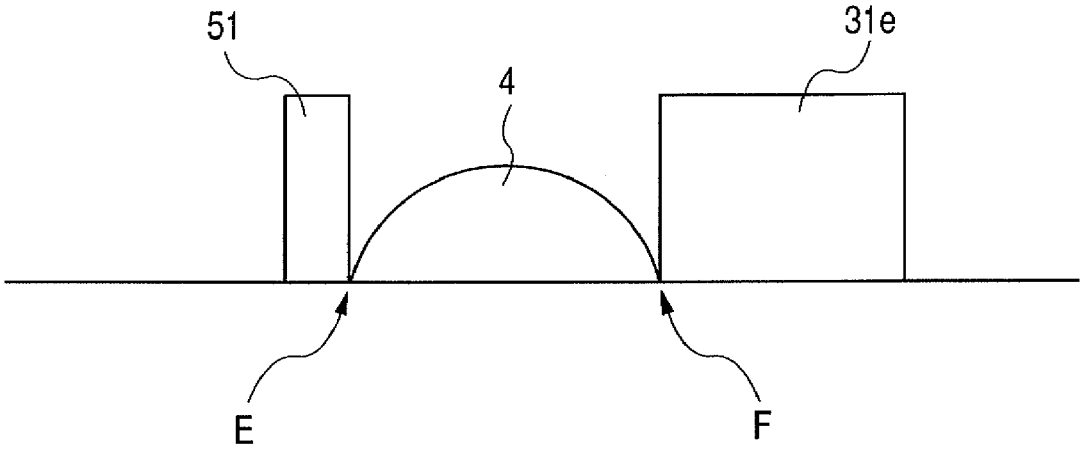
FIG. 10 is a cross-sectional view, showing a vicinity of a hole portion of a waste ink tank, and showing a waste ink absorption in the structure shown in FIG. 8.

FIGS. 9A and 10 show a state immediately after the introduction of the waste ink 4. With the lapse of time thereafter, the waste ink 4 moves toward the waste ink absorbent member 31*e* and is eventually absorbed without being left at all.

This phenomenon can also be explained by a fact that the surface energy of the waste liquid is so maintained as not to reach an equilibrated state. In a state immediately after the introduction of the waste ink 4, the contacting area of the waste ink 4 includes, as shown in FIG. 10, an area E in contact with the plate 51, and an area F in contact with the waste ink absorbent member 31*e*. In a comparison of these areas E and F, the area E, where the waste ink 4 is in contact with the water-repellent component, has a larger surface energy in comparison with the area F. As a result, the waste ink 4 is pulled toward the interior of the waste ink absorbent member 31*e* having a lower surface energy, and thus moves to and is absorbed in the waste ink absorbent member 31*e* entirely.

Figure 11:
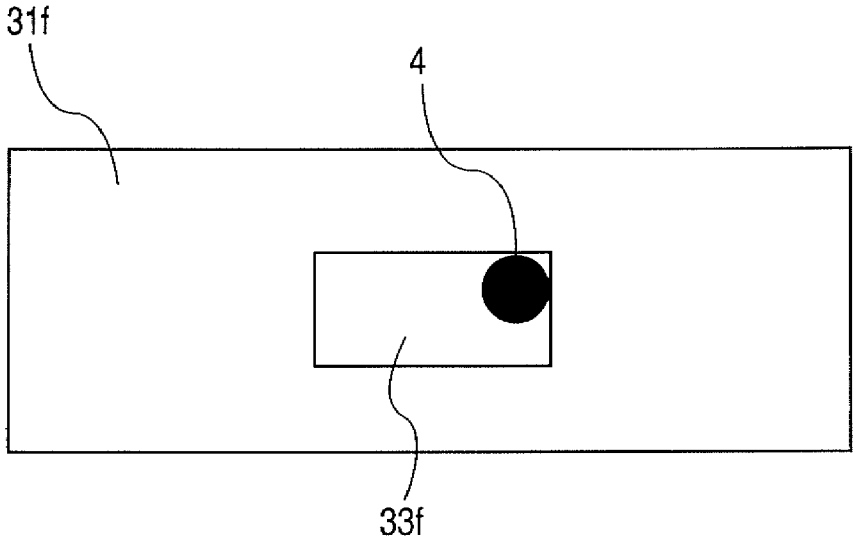
FIG. 11 is a plan view of a waste ink absorbent member, showing an example in which, in a hole portion not having an open part, an interfacial energy is made uneven in an area contacted by a drop of the waste ink.

By controlling an area of the hole portion 33*f* or a discharge speed of the waste ink 4 in such a manner that the introduced waste ink 4 is in contact, only in a part of the external periphery thereof, with the waste ink absorbent member 31*f* as shown in FIG. 11, there is realized a state where the surface energy around the external periphery of the waste liquid is partially different, and a phenomenon that the waste ink 4 is left at the approximate center as shown in FIG. 5B does not occur.

In the following, an ink with an improved bleeding resistance will be explained.

Such ink utilizes, for example, as a colorant, a self-dispersing pigment (such as carbon black) including a hydrophilic group which is bonded either directly or across another atomic group, and, plural water-soluble organic solvents of which at least one is a poor water-soluble organic solvent having a property of reducing the dispersion stability of the pigment (first ink). When such ink is deposited on a recording medium, along with the evaporation of water, a ratio of the poor solvent to the pigment becomes higher and the pigments start to coagulate in an upper layer part of the recording medium. Therefore, such ink, even singly, has a bleeding-suppressing effect even when another ink is present in the vicinity. Also in case the colorant of such ink is constituted of a pigment in which a hydrophilic group bonded to the pigment surface is made present at a high density with respect to the surface of the pigment, because of a steric hindrance caused by the structure of the colorant, the solvent in the ink shows less affinity (solvated) to such pigment in comparison with the prior self-dispersing pigment, whereby the pigment tends to lose the dispersion stability even by a slight water evaporation. As a result, there is obtained an effect of more reducing the bleeding. Also an ink showing a viscosity increase or a particle size increase by a water evaporation, more specifically an ink, showing a change in the average particle size by 25% or more when water is evaporated by 40% from the liquid, is capable of further reducing the bleeding. The particle size can be easily confirmed by a particle size measurement without dilution, utilizing a concentrated system particle size analyzer FPAR-1000 (trade name; manufactured by Otsuka Denshi Co.).

When such ink is not absorbed in the waste ink absorbent member and causes a coagulate formation or a viscosity increase by the water evaporation from the ink, it is difficult to re-disperse or to lower the viscosity for example by supplying a waste ink with little water evaporation by repeating the recovery operation. An amount of evaporation from the waste ink varies, for example depending on a material of a waste liquid tube, an internal diameter thereof, and an amount of the waste ink discharged per a recovery operation. However, the material and the internal diameter of the waste liquid tube, commonly used, are within limited ranges, and the amount of the waste ink discharged per a recovery operation is generally within a certain range.

In an ink jet recording apparatus utilizing such ink, the absorbing ability of the waste ink absorbent member shows an evident difference between when the waste ink absorbent member of the present invention is utilized and when that is not utilized.

In the present invention, a poor solvent is defined as a solvent showing a property that "when a pigment dispersion, containing a solvent to be evaluated by about 50 wt % and a colorant to be employed in an ink in a dispersed state, is stored at 60° C. for 48 hours, a particle size in such dispersion is larger than the particle size in a pigment dispersion, free or almost free from the solvent to be evaluated and containing the colorant to be employed in the ink". Also a good solvent means a solvent of characteristics other than those of a poor solvent.

Figure 12:
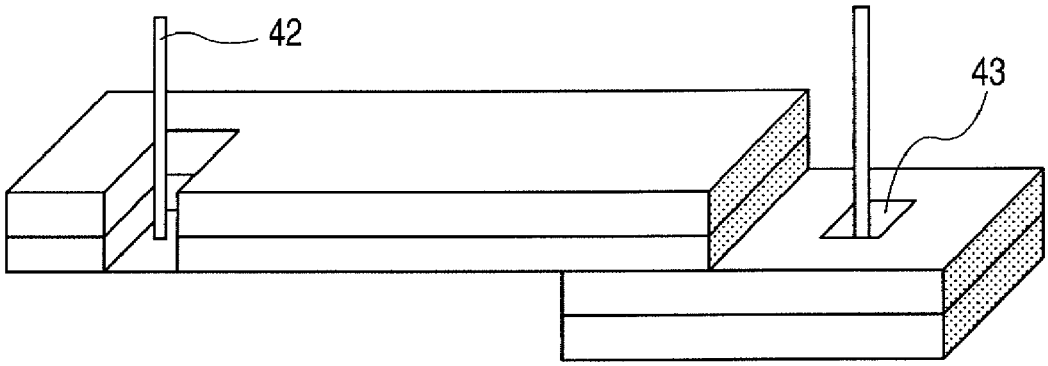
FIG. 12 is a perspective view showing a structure of a magnesium for absorbing two waste inks.

The waste ink absorbent member of the present invention may also be used for absorbing a waste liquid, derived from a second ink, other than the aforementioned first ink containing the solvent and the colorant as described above in which the solvent includes a poor solvent for the colorant. An introducing position for the waste liquid, derived from the second ink, is not particularly restricted. However, when the waste liquid derived from the ink containing the solvent and the colorant as described above in which the solvent includes a poor solvent for the colorant and the waste liquid derived from the second ink come in mutual contact on or in the waste ink absorbent member and hinder a diffusion or a displacement into the waste ink absorbent member, it is necessary to consider the introducing positions of both liquids into the waste ink absorbent member. More specifically, the introducing positions have to be separated by such a distance that, when both waste liquids are introduced into the waste ink absorbent member, the solvent contained in the waste liquid, derived from the liquid containing the solvent and the colorant as described above in which the solvent includes a poor solvent for the colorant, can singly diffuse or move in the waste ink absorbent member and that thus displaced waste liquid can contact the waste liquid derived from the second ink. More specifically, as shown in FIG. 12, a shortest distance between an introducing position 42 for the liquid, derived from the liquid containing the solvent and the colorant as described above in which the solvent includes a poor solvent for the colorant, and an introducing position 43 for the waste liquid derived from the second liquid is from 5 to 20 cm.

Examples of the second ink which hinders, when the first and second inks come into mutual contact, the diffusion or displacement of both liquid into the waste ink absorbent member include an ink containing a solvent, constituting a poor solvent for the colorant contained in the first ink, for the purpose of reducing the bleeding on the recording medium, and further an ink containing at least a colorant of a structure including a benzene ring in a terminal part (the structure may be partly hydrophilic if a major part is hydrophobic). A colorant of a structure having a benzene ring in a terminal part generally has a property of being easily adsorbed on a pigment. This property hinders the dispersion stability of the pigment and, when the waste liquids derived from the first and second inks come into contact in the waste ink absorbent member, tends to constitute a barrier, hindering the diffusion or movement thereof into the waste ink absorbent member. Therefore the problem for the invention becomes conspicuous, and the effect obtained by solving such problem will also become conspicuous.

Specific examples of the second colorant which tends to constitute, when the waste liquids derived from the first and second inks come into contact in the waste ink absorbent member, a barrier hinder the diffusion or the movement thereof into the waste ink absorbent member, include colorants represented by following structural formulas (1) and (2):

structural formula (1)

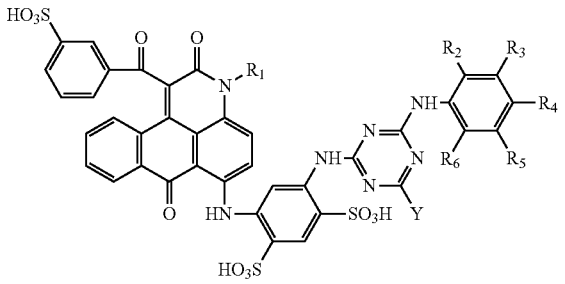

In the structural formula (1), R1 represents a hydrogen atom, an alkyl group, a lower hydroxyalkyl group, a cyclohexyl group, a mono- or di-alkylaminoalkyl group, or a lower cyanoalkyl group; Y represents a chlorine atom, a hydroxyl group, an amino group, or a mono- or di-alkylamino group (which may have a substituent, selected from a group of a sulfo group, a carboxyl group and a hydroxyl group, on the alkyl group); and R2, R3, R4, R5 and R6 each independently represents a hydrogen atom, an alkyl group containing 1 to 8 carbon atoms, or a carboxyl group, in which all of R2, R3, R4, R5 and R6 do not become hydrogen atoms at the same time.

Examples of the compound represented by the structural formula (1) include example compounds which assume following structures in a state of a liberated acid, and an example compound M7 is particularly preferably employed.

compound example M1

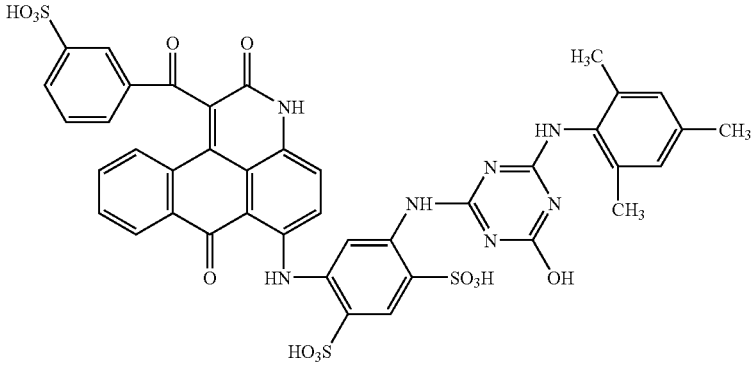

compound example M2

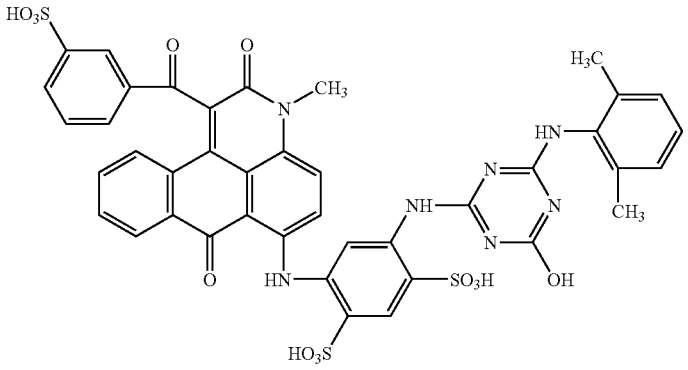

-continued
compound example M3
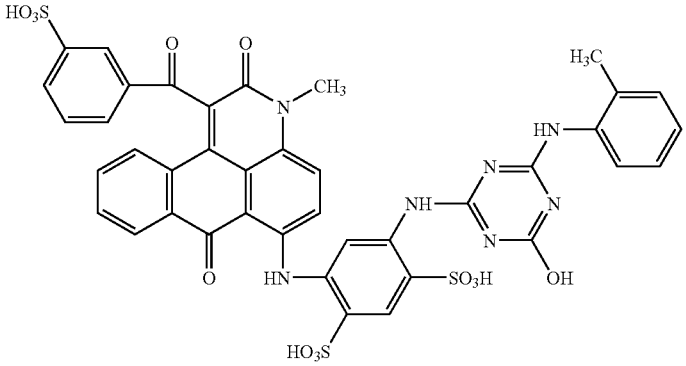
compound example M4
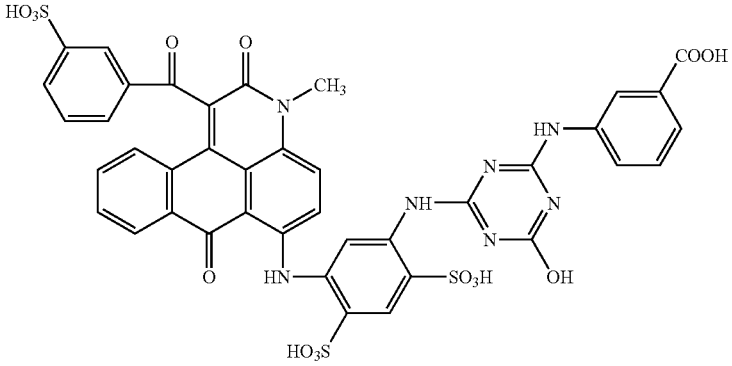
compound example M5
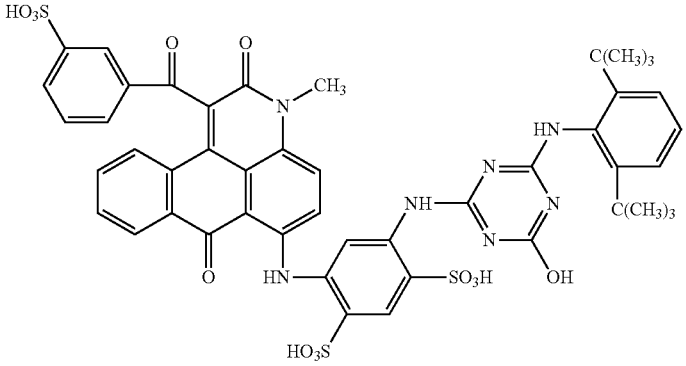
compound example M6
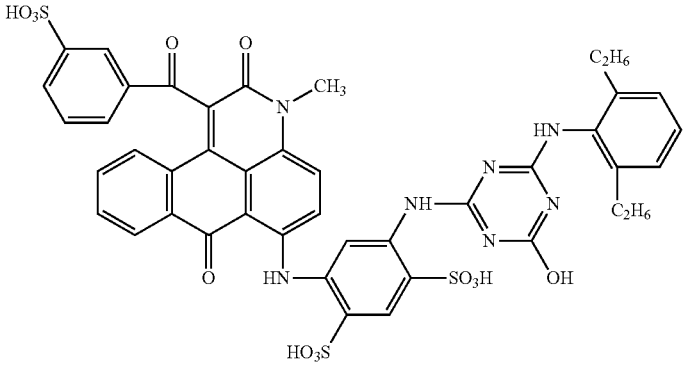

-continued compound example M7

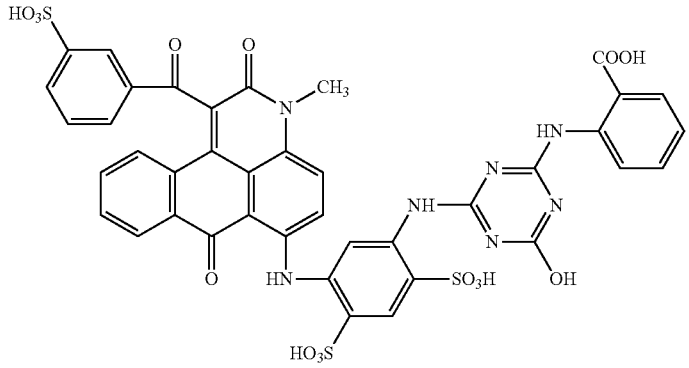

structural formula (2)

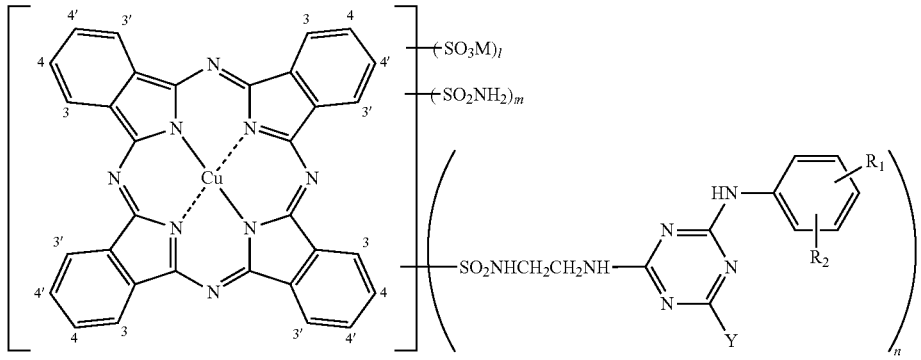

In the structural formula (2), l=0−2, m=1−3, and n=1−3 but l+m+n=3−4;

substituents being substituted in 4- or 4'-position; M represents an alkali metal or an ammonium group; R1 and R2 each independently represents a hydrogen atom, a sulfo group, or a carboxyl group, but R1 and R2 do not become hydrogen atoms at the same time; and Y represents a chlorine atom, a hydroxyl group, an amino group or a mono- or di-alkylamino group.

The colorant represented by the structural formula (2) is a phthalocyanine compound which is obtained by utilizing a phthalocyanine compound, obtained by reacting a 4-sulfophthalic acid derivative, or a 4-sulfophthalic acid derivative and a phthalic acid (anhydride) derivative in the presence of a metal compound, as a raw material, then converting a sulfone group into a chlorosulfone group, and reacting an aminating agent in the presence of an organic amine, namely a phthalocyanine compound in which a non-substituted sulfamoyl group (—$SO_2NH_2$) and a substituted sulfamoyl group (represented by a following structural formula (3)) are introduced only in 4- and 4'-positions (R2, R3, R6, R7, R10, R11, R14 and R15 in the structural formula (2)), and an ink employing such compound as a colorant is found to have an extremely good resistance to environmental gases.

structural formula (3)

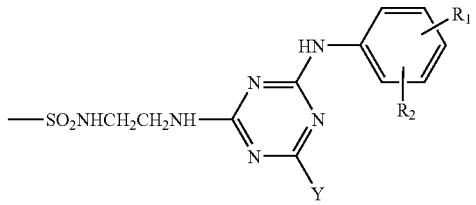

Examples of the compound represented by the structural formula (3) include example compounds which assume following structures in a state of a free (liberated) acid, and an example compound C1 is particularly preferably employed.

compound example C1

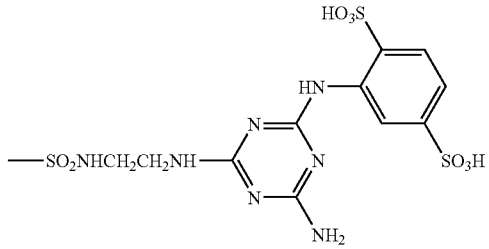

-continued compound example C2

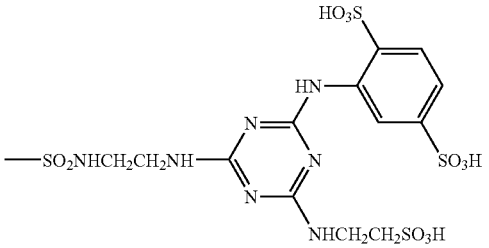

compound example C3

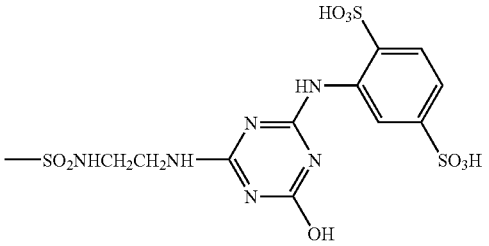

compound example C4

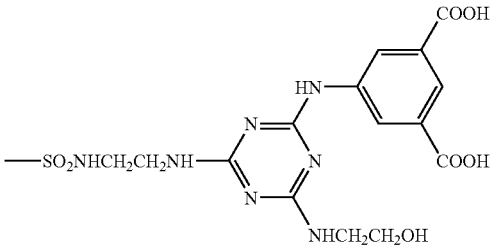

-continued compound example C5

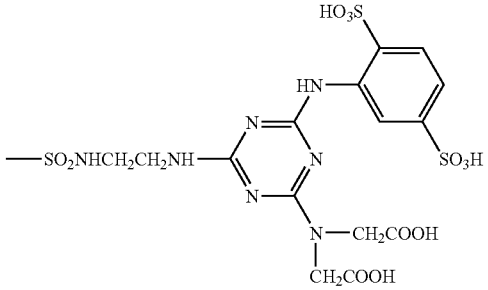

compound example C6

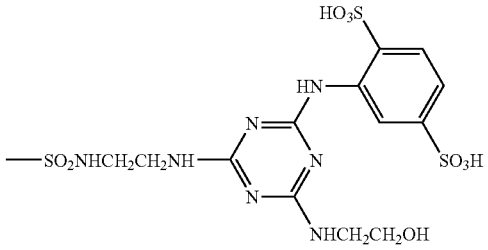

compound example C7

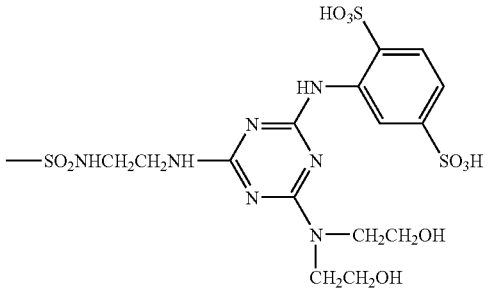

The first and second inks having the characteristics mentioned above allow to significantly improve the bleeding resistance, in comparison with the prior ink. However, waste liquids of these inks, when dropped in adjacent portions of a waste ink absorbent member, a hitherto unknown phenomenon of forming a barrier that hinders a diffusion or a movement of the inks into the waste ink absorbent member.

Also in a preferred embodiment of the present invention, the first ink is formed by a black ink utilizing a pigment as a colorant, and the second ink is formed by a black ink utilizing a dye as a colorant. In such case, the black ink containing a preferable dye as the colorant is similar to the case of the aforementioned color ink, and examples of the preferred colorant include those represented by following structural formulas (4) and (5):

structural formula (4)

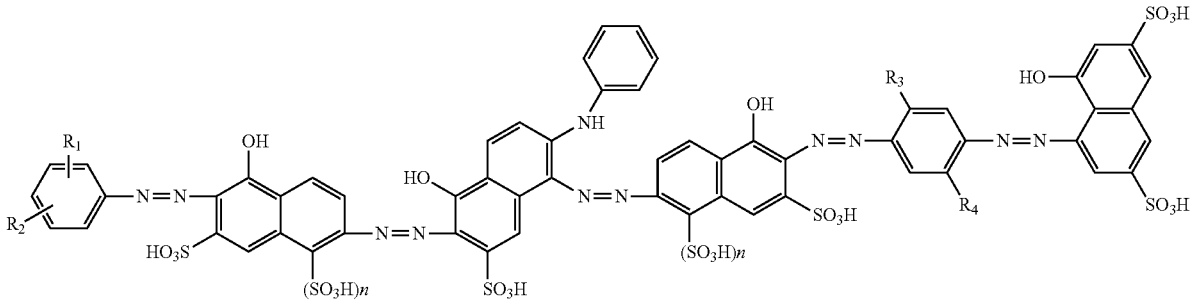

wherein R1 and R2 each represents a hydrogen atom, a hydroxyl group, an amino group, a carboxyl group, a sulfo group, an alkyl group containing 1 to 4 carbon atoms, or an alkoxy group containing 1 to 4 carbon atoms; R3 and R4 each represents a hydrogen atom, an alkyl group containing 1 to 4 carbon atoms, an alkoxy group containing 1 to 4 carbon atoms, a hydroxyl group, an alkyl group containing 1 to 4 carbon atoms that may be substituted with a hydroxyl group or an alkoxy group containing 1 to 4 carbon atoms, an alkoxy group containing 1 to 4 carbon atoms that may be substituted with a hydroxyl group, an alkoxy group containing 1 to 4 carbon atoms, a sulfo group or a carboxyl group, or an amino group substituted with an alkyl group or an acyl group; and n represents 0 or 1.

structural formula (5)

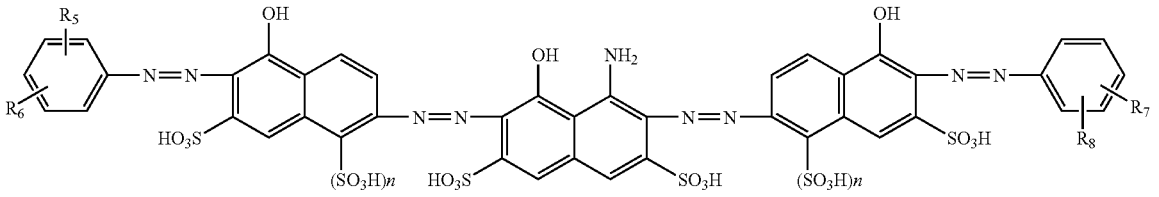

wherein R5, R6, R7 and R8 each represents a hydrogen atom, a hydroxyl group, an amino group, a carboxyl group, a sulfo group, an alkyl group containing 1 to 4 carbon atoms, an alkoxy group containing 1 to 4 carbon atoms, an alkoxy group substituted with a hydroxyl group, an alkoxy group containing 1 to 4 carbon atoms, a sulfo group or a carboxyl group, an alkoxy group containing 1 to 4 carbon atoms that may be further substituted with a carboxyl group or a sulfo group, or an amino group substituted with a phenyl group, an alkyl group or an acyl group; and n represents 0 or 1.

In the following, example compounds Bk1-Bk3 as specific examples of the dye represented by the structural formula (4) and examples compounds BK4-Bk6 as specific examples of the dye represented by the structural formula (5) are shown in the form of a liberated acid, but the colorant to be employed in the present invention is not limited to these examples. Also two or more of the following colorants may be employed at the same time, and it is particularly preferable to use the example compounds Bk3 and Bk4 at the same time.

Example Compounds compound example Bk1

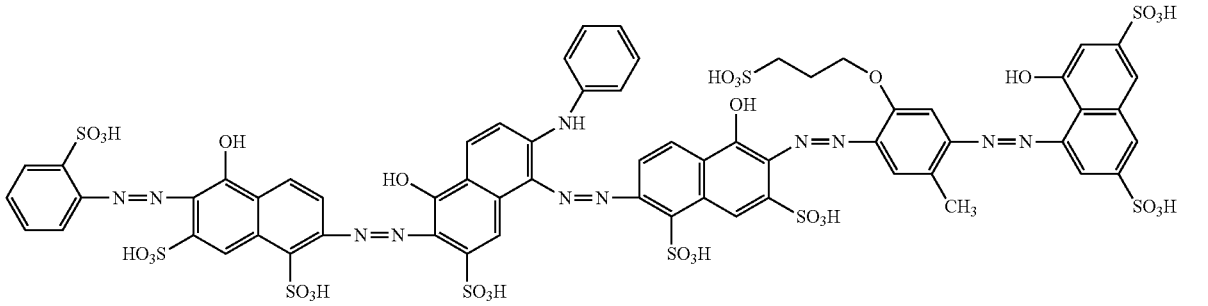

-continued compound example Bk2

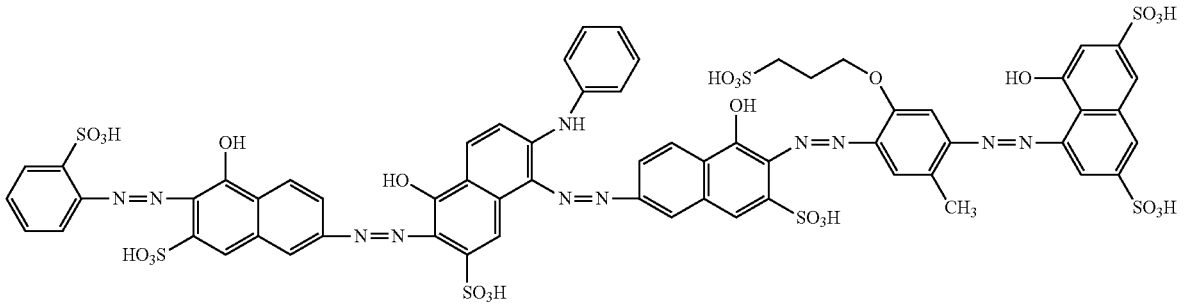

compound example Bk3

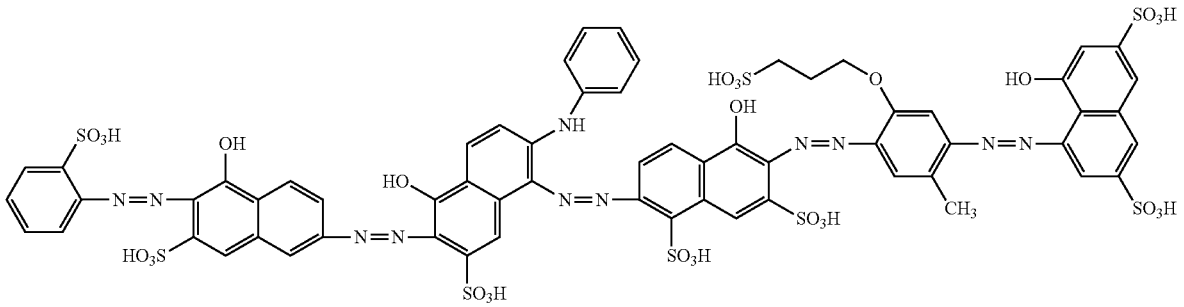

compound example Bk4

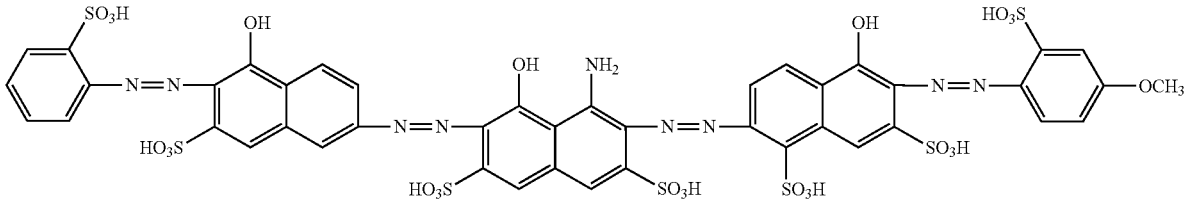

compound example Bk5

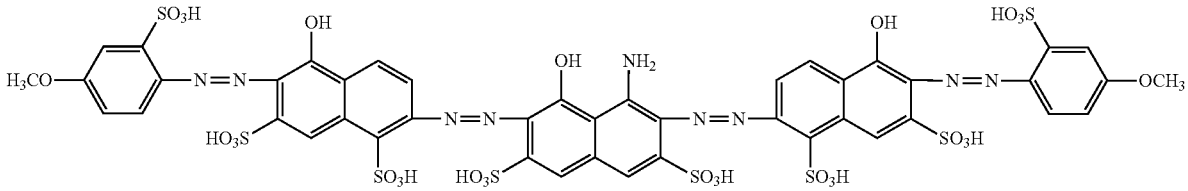

compound example Bk6

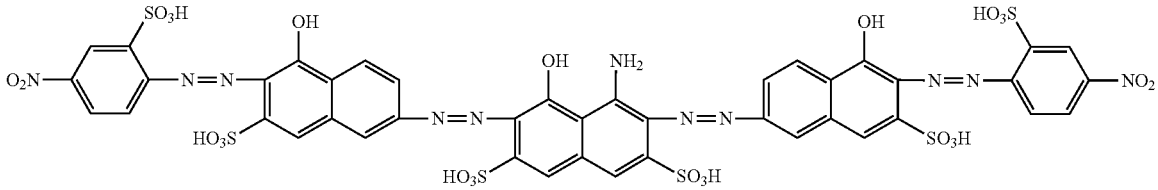

In the present invention, whether the surface energy of the waste liquid is in an equilibrated state can be confirmed by confirming that an ink drop, formed by introducing a waste ink in a hole portion, diffuses not uniformly but in a specified direction.

An ink jet recording apparatus embodying the present invention utilizes a waste ink absorbent member as explained above, in which an area contacted by a total water liquid, discharged in a single recovery operation, does not generate an equilibrated state of the surface energy.

In a case where a waste liquid drop generated by the waste liquid of a single recovery operation does not come into contact with the waste ink absorbent member, it remains unabsorbed at least to a next recovery operation, thereby facilitating a coagulate generation or a viscosity increase. It is therefore important, in order to securely absorb the discharged water liquid, that the waste liquid drop generated from the total waste liquid discharged by a single recovery operation comes securely in contact with the waste ink absorbent member. Then an efficient absorption in the waste ink absorbent member can be realized by maintaining the surface energy of the waste liquid, in the areas contacted by the waste liquid drop, in a non-equilibrated state.

In the present invention, a recovery operation means an operation of sucking out a solidified or viscosity-increased ink in an ink discharge port of the recording head, thereby recovering the ink discharge ability of the recording head. An ink amount discharged in a single recovery operation may be different depending on a period of pause between the recording operations, but the single recovery operation as used in the present invention means a case with a minimum ink discharge amount among the recovery operations to be executed in the recording apparatus. Therefore, in case an ink of such amount or larger is discharged, a part of an ink drop, formed by such discharged ink, contacts as a waste liquid with the waste ink absorbent member.

A liquid discharge from a discharge aperture for the waste liquid to the hole portion is preferably executed by a dropping. The dropping, as used in the present invention, means that the waste liquid is discharged from the discharge aperture without simultaneously contacting the discharge aperture and the bottom of the hole portion.

When the waste liquid is not dropped, for example when the discharge aperture is in direct contact with the waste ink absorbent member, a coagulate may be easily formed in the hole portion, thereby undesirably clogging the discharge aperture. Also when the discharge aperture for the waste ink is in contact with the absorbent member, an efficient absorption is not achievable as the absorbing position of the waste liquid is concentrated in the absorbent member. Also a case where the unabsorbed waste ink generates a coagulate is undesirable, as it may immediately clog the discharge aperture.

A shape of the hole portion is not particularly restricted as long as the ink drop, formed by the ink discharged in a single recovery operation, has an uneven surface energy.

Second Embodiment for Accomplishing the First Target

In the following there will be explained a second embodiment for accomplishing the first target.

The waste ink absorbent member of the invention is to recover a waste liquid, which is generated in an ink jet recording apparatus for image formation by discharging an ink from a recording head. The ink jet recording apparatus is equipped with a recovery mechanism for forcedly discharging the ink from the recording head, separately from the discharging operation at the image recording operation, thereby maintaining discharge characteristics of the recording head (head recovery operation). The apparatus is also equipped with a waste ink absorbent member for absorbing and holding a waste liquid generated by such head recovery operation, and introduction means which guides the waste liquid from the recovery mechanism to the waste ink absorbent member and introduces the waste liquid into the waste ink absorbent member.

The waste ink absorbent member includes, as a basic structure, a hole portion including an introducing portion where the waste liquid guided by the guiding means is introduced, and a slit extending from such hole portion. The waste ink absorbent member may be incorporated, for example, directly in a lower case of the ink jet recording apparatus or in a waste ink receiving tank, but the present invention is not restricted to such forms.

In the following, embodiments of the present invention will be clarified in detail, with reference to the accompanying drawings.

Figure 13:
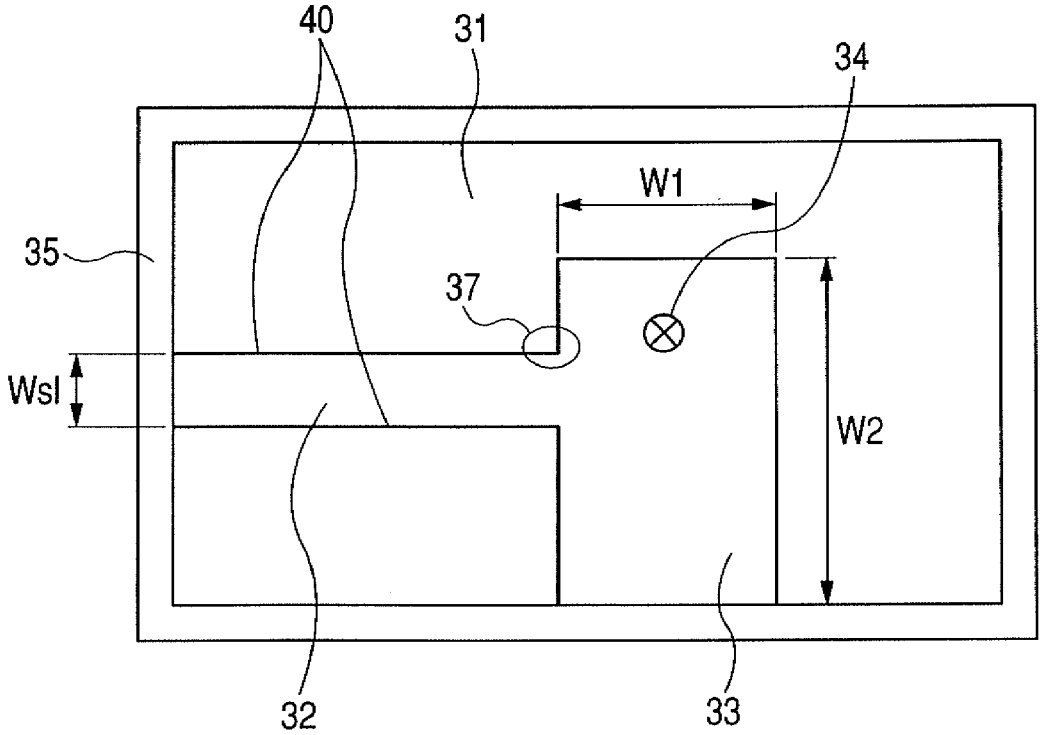
FIG. 13 is a plan view showing an example of a waste ink absorbent member in which a hole portion and a slit are combined.

FIG. 13 is a plan view showing an example of a waste ink absorbent member, incorporated in a lower case of an ink jet recording apparatus.

A waste ink absorbent member 31 has an approximately rectangular parallelopiped shape, of such a dimension that lateral faces and a bottom face thereof are in contact with the internal walls of the lower case 35 of the ink jet recording apparatus. The waste ink absorbent member 31 is provided with a hole portion 33 and a slit 32, penetrating through a thickness (height) of the waste ink absorbent member 31. Therefore, the bottom wall of the lower case 35 of the ink jet recording apparatus is exposed in areas where the hole portion 33 and the slit 32 are formed.

The hole portion 33 is formed as a notched portion, extending from a lateral face of the waste ink absorbent member 31 toward an opposed lateral face. The slit 32 extends, from an interim position in a length of the hole portion 33, with a width Ws1 in a direction perpendicular to the hole portion 33, and reaches a lateral face of the waste ink absorbent member 31. The dimension of the hole portion 33 is defined by a width W1 in a direction parallel to the longitudinal direction of the slit 32 and a width W2 inn a direction perpendicular to the longitudinal direction of the slit 32, and the width Ws1 of the slit 32 is smaller than the width W1 or W2 of the hole portion 33. The width Ws1 of the slit 32 means a dimension of the slit 32 in a direction perpendicular to the longitudinal direction thereof.

A material constituting the waste ink absorbent member 31 is not particularly restricted as long as it can appropriately hold the waste liquid. Advantageously employable is a porous member such as sponge, a fibrous member formed by pulp, a polymer absorbent material or a paper-like member covered with a polymer absorbent material.

The waste liquid is dropped from a waste liquid introducing part 34, positioned inside the hole portion 33. The waste liquid introducing part 34 indicates a waste liquid introducing position by introduction means, such as a tube, which guides the waste liquid generated in the aforementioned recovery process to the waste ink absorbent member 31. In an embodiment shown in FIG. 13, since the waste liquid introducing part 34 is positioned inside the hole portion 33, the waste liquid is directly dropped onto the bottom wall of the lower case 35 of the ink jet recording apparatus.

The waste ink absorbent member of the present invention is featured by that a width of a connecting part of the hole portion and the slit is smaller than a shortest dimension in the hole portion, passing through a center of the waste liquid introducing position in the hole portion. This feature will be explained more specifically with reference to FIG. 13. The slit 32 in FIG. 13 extends, along the lower case of the ink jet recording apparatus, maintaining a substantially same width from the connecting portion with the hole portion 31. Therefore, in FIG. 13, a width of the connecting part between the hole portion 33 and the slit 32 corresponds to Ws1. Also the shortest dimension in the hole portion, passing through a center of the waste liquid introducing position in the hole portion means W1 in the hole portion 33. Thus the present invention is characterized by a fact that the width Ws1 is smaller than the width W1.

Figure 14A:
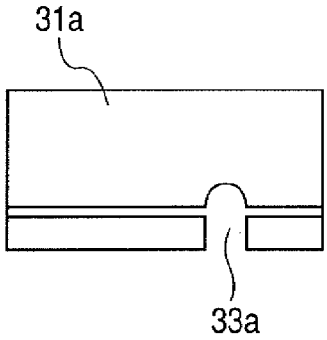
FIGS. 14A, 14B and 14C are plan views showing various examples of a waste ink absorbent member in which a hole portion and a slit are combined.
Figure 14B:
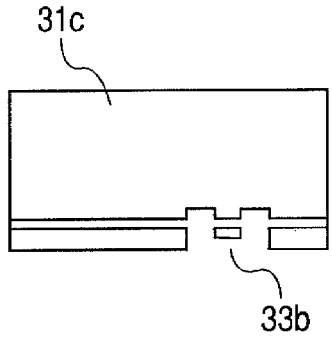
Figure 14C:
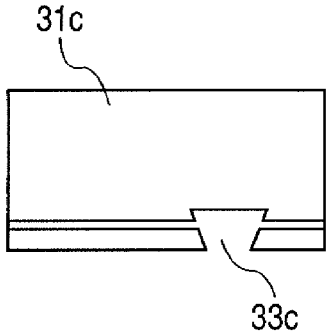

In the foregoing, the hole portion 33 has been explained by an example of having a rectangular shape, but the shape of the hole portion 33 is not limited to such example but may assume any shape such as a circular shape, a polygon shape, or shapes as will be shown in FIGS. 14A to 14C. In any of such shapes, the width of the connecting part between the hole portion and the slit and the smallest dimension in the hole portion, passing through the center of the waste liquid introducing position in the hole portion, are to be construed reflecting the concept explained above.

Also a part of the dropped waste liquid has to come into contact with the waste ink absorbent member at least before the dispersion stability of the colorant is lost by a water evaporation. Therefore, the introducing position of the waste liquid introducing part 34 and the width W1 have to be selected in consideration of the foregoing. The waste liquid, dropped from the waste liquid introducing part 34 into the hole portion 33 is partly absorbed by the waste ink absorbent member 31, and, at the same time, a part of the remainder moves toward the slit 32 as if sucked by the slit 32. The slit 32 has a dimensional relationship to the hole portion 32 as explained above. The waste ink absorbent member 31 shaped in such manner drastically improves the absorbing ability for the waste liquid, even in case of an ink which tends to hinder a displacement or a diffusion of the waste liquid to the waste ink absorbent member 31 by a coagulation or a viscosity increase for example induced by a water evaporation, thereby reducing the absorbing ability. The reason for this phenomenon is still not clarified, but is estimated by the present inventors as follows.

A first reason will be the presence of a boundary portion 37 between the slit 32 and the hole portion 33. Presence of the boundary portion 37 exerts, by a capillary force of the waste ink absorbent member 31 itself, a force of directing the waste liquid toward the slit 32. Therefore, an ink flow is generated in a direction from the waste liquid introducing part 34 toward the slit 32. The waste liquid moved toward the slit 32 spreads while it is being absorbed by a waste ink absorbent member 40 constituting the slit 32.

A second reason will be a dimensional relationship of the widths W1, W2 of the hole portion 33 and the width Ws1 of the slit 32 so as to generate so-called capillary phenomenon. Thus, the waste liquid, introduced from the waste liquid introducing part 34 to the hole portion 33, is subjected to a moving force toward a narrower slit 32. The introducing position of the waste liquid introducing part 34 is preferably such that the waste liquid immediately after the dropping comes in contact with the boundary portion 37.

The drastic improvement in the absorbing ability for the waste liquid is estimated to be induced by these two functions. The patent references 6 and 7 disclose, as explained above, a recess or a notched groove formed extending from a position including a waste liquid introducing part. However the patent references 6 and 7 do not include disclosures on the width of the waste liquid introducing part and the width of the slit, and merely illustrate these parts in similar widths in the drawings, so that the concept of the present invention cannot be read at all from these references, and the present invention is not easily conceivable from these references.

Figure 15:
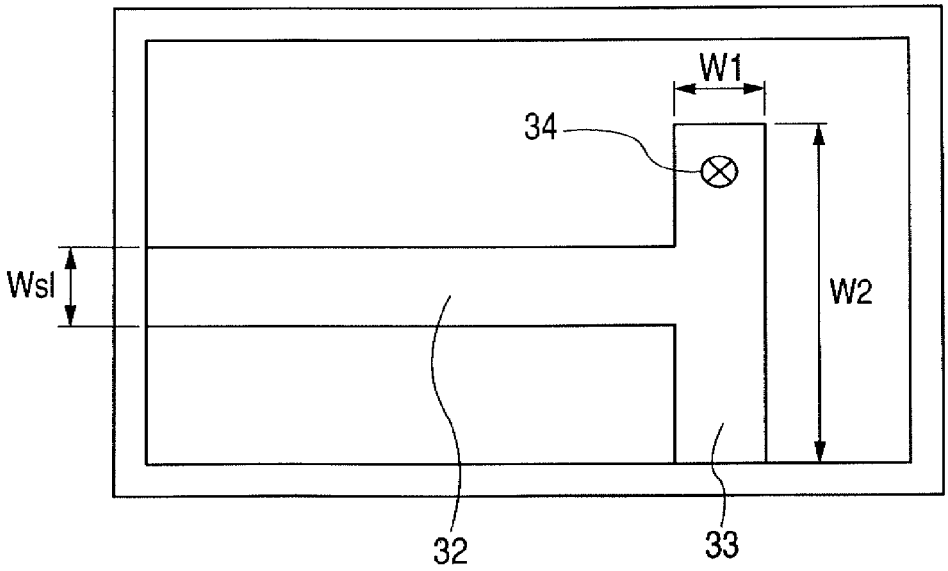
FIG. 15 is a plan view showing a reference example of the waste ink absorbent member.
Figure 16:
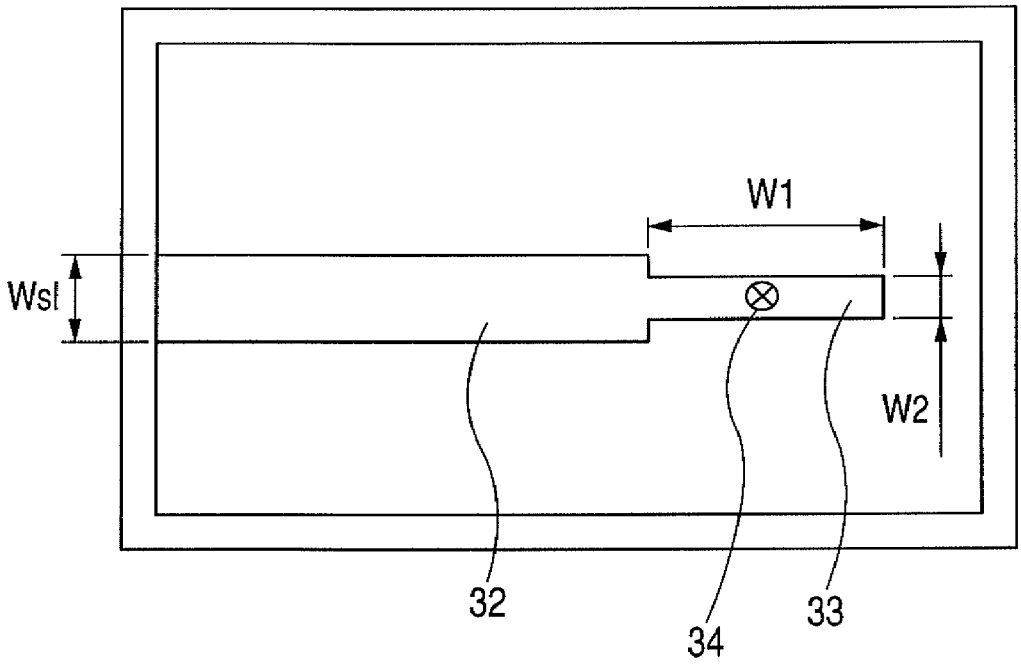
FIG. 16 is a plan view showing another reference example of the waste ink absorbent member.

FIGS. 15 and 16 illustrate, as reference example to the present invention, structures in which either of the widths W1, W2 of the hole portion 33 is same as or narrower than the width Ws1 of the slit 32.

In FIG. 15, the width Ws1 of the slit 32 is same as the width W1 of the hole portion 33 in a direction parallel to the slit 32. Therefore, when the waste liquid is introduced from the waste liquid introducing part 34, in a crossing part of the hole portion 33 and the slit 32, there is generated a capillary force also toward the open end of the hole portion 33 (downwards in the drawing), comparable to the capillary force toward the slit 32. As a result, the waste liquid flow toward the slit 32 is significantly hindered. Such tendency becomes more eminent as the width W1 of the hole portion becomes smaller.

FIG. 16 shows an example in which the width W1 of the hole portion 33 in a direction parallel to the slit 32 is larger than the width Ws1 of the slit 32, but the width W2 in a perpendicular direction is smaller than the width Ws1 of the slit 32. In such case, the capillary force from the waste liquid introducing part 34 toward the slit 32 is exceeded by the capillary force in the opposite direction, so that the slit 32 cannot be utilized effectively.

Figure 17:
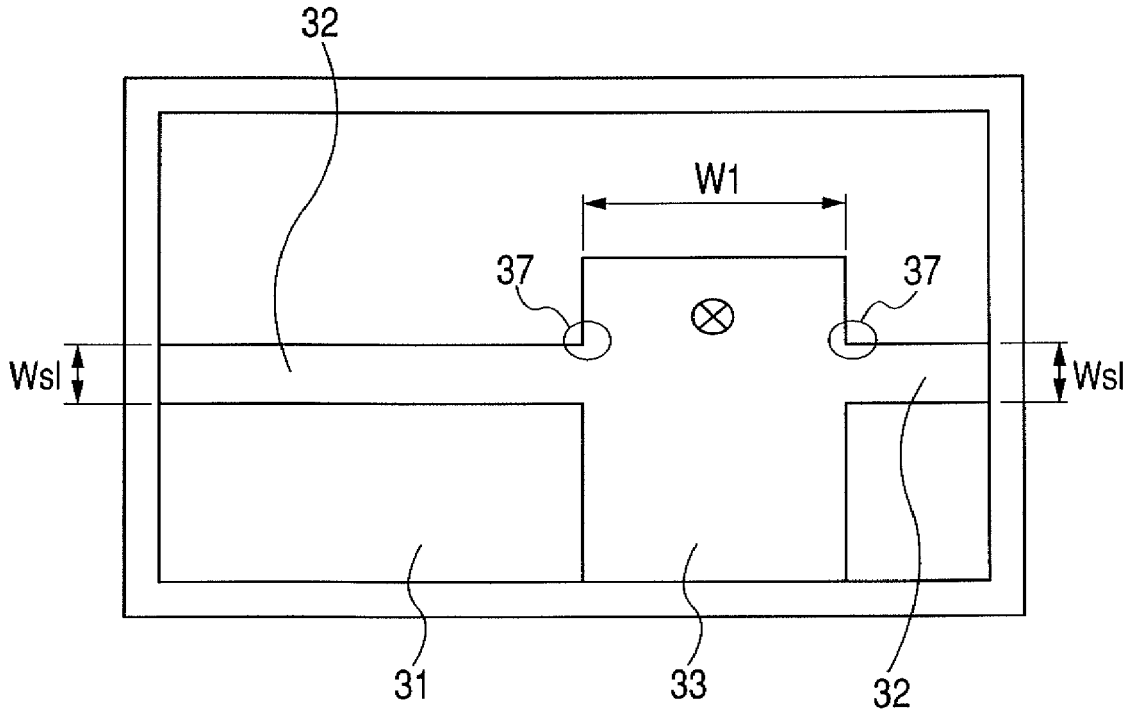
FIG. 17 is a plan view showing another example of the waste ink absorbent member in which a hole portion and a slit are combined.
Figure 18:
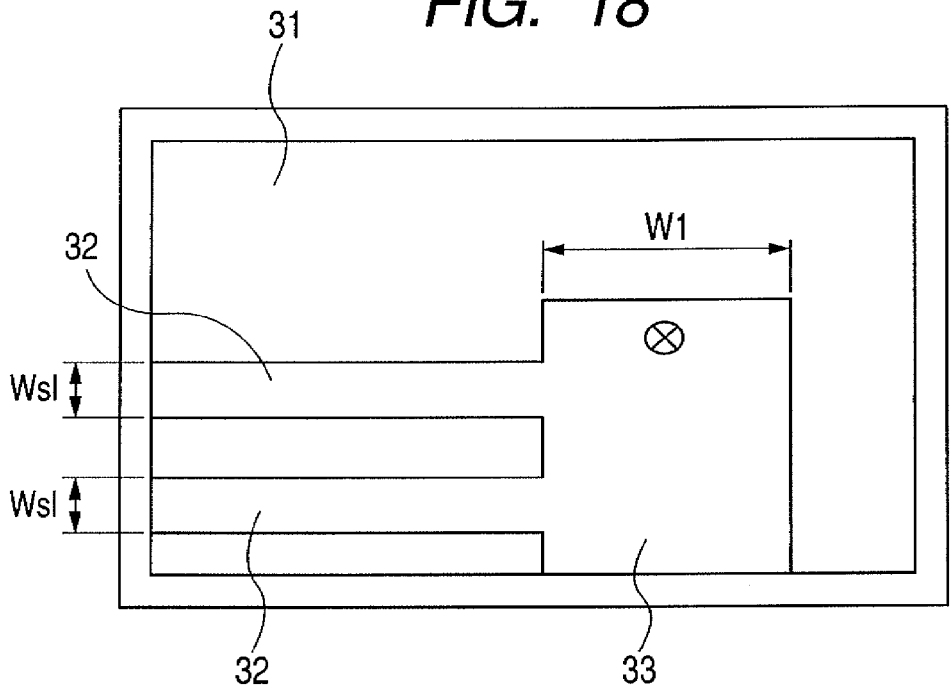
FIG. 18 is a plan view showing still another example of the waste ink absorbent member in which a hole portion and a slit are combined.

FIGS. 17 and 18 show variations of the embodiment shown in FIG. 13, each having two slits 32 extending from the hole portion 33. Naturally, the width Ws1 of each slit 32 is smaller than the width W1 of the hole portion 33. A number of the slits 32 extending from the hole portion 33 is not particularly restricted. However, an excessively large number of the slits 32 is undesirable as it reduces the volume of the waste ink absorbent member 31, thereby reducing the total absorption capacity for the waste liquid. Also the slits 32 need not necessarily be mutually parallel, but may for example extend radially from the hole portion 33.

The width Ws1 of the slit 32 is not particularly restricted as long as it satisfies a condition specified in the present invention. However, with an excessively small width Ws1 of the slit 32, the slit 32 itself may be clogged by a viscosity-increased waste liquid. On the other hand, with an excessively large width Ws1 of the slit 32, the total volume of the waste ink absorbent member 31 is reduced, thereby reducing the absorbing capacity for the waste liquid. For these reasons, the width Ws1 of the slit 32 is preferably from 3 to 15 mm, and more preferably equal to or larger than 3 mm but less than 5 mm. Also the width W1 of the hole portion 33 is preferably from 6 to 30 mm, and more preferably equal to or larger than twice of the width Ws1. A width W1 equal to or larger than the width Ws1 may provide, depending on the position of the waste liquid introducing part 34, a very eminent function of the capillary force, constituting the technical feature of the present invention. Also the width W2 of the hole portion 33 is preferably from 6 to 30 mm, and more preferably equal to or larger than twice of the width Ws1. A width W2 equal to or larger than the width Ws1 may provide, depending on the position of the waste liquid introducing part 34, a very eminent function of the capillary force, constituting the technical feature of the present invention.

Figure 19:
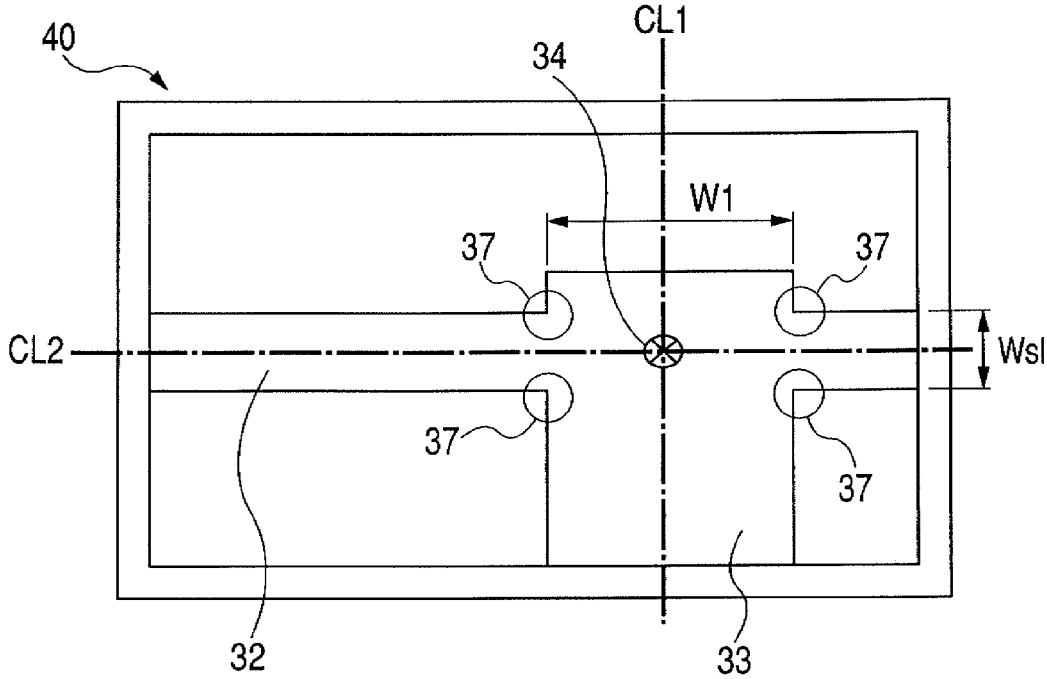
FIG. 19 is a plan view showing still another example of the waste ink absorbent member in which a hole portion and a slit are combined.

FIG. 19 is a plan view showing another example of the waste ink absorbent member accommodated in the lower case of the ink jet recording apparatus.

The waste ink absorbent member 31 shown in FIG. 17 is same in its shape, such as the positions and dimensions of the hole portion 33 and the slit 32, as that shown in FIG. 17, but is different in a position of the waste liquid introducing position 34. In this embodiment, the waste liquid introducing position 34 is positioned at a crossing point of a center line of the width W1 of the hole portion 33 and a center line of the width Ws1 of the slit 32.

In this embodiment, since the waste liquid introducing part 34 is positioned at the center of the crossing portion between the hole portion 33 and the slits 32, a number of the boundary portions 37, effective for guiding the waste liquid into the slit, is doubled in comparison with the embodiment shown in FIG. 17. In the embodiment shown in FIG. 17, in the hole portion 33, the slits 32 are formed in the course of a waste liquid flow from the waste liquid introducing part 34. Therefore, the boundary portions 37, functioning effectively as a source of force guiding the waste liquid toward the slits 32, exist in two locations at the upstream side in the waste liquid flow direction. On the other hand, in the embodiment shown in FIG. 19, since all the boundary portions 37 between the hole portion 33 and the slits 32 are equally distanced from the waste liquid introducing part 34, four boundary portions 37 function effectively. As a result, it is rendered possible to more efficiently guide the waste liquid to the slits 32.

Figure 20:
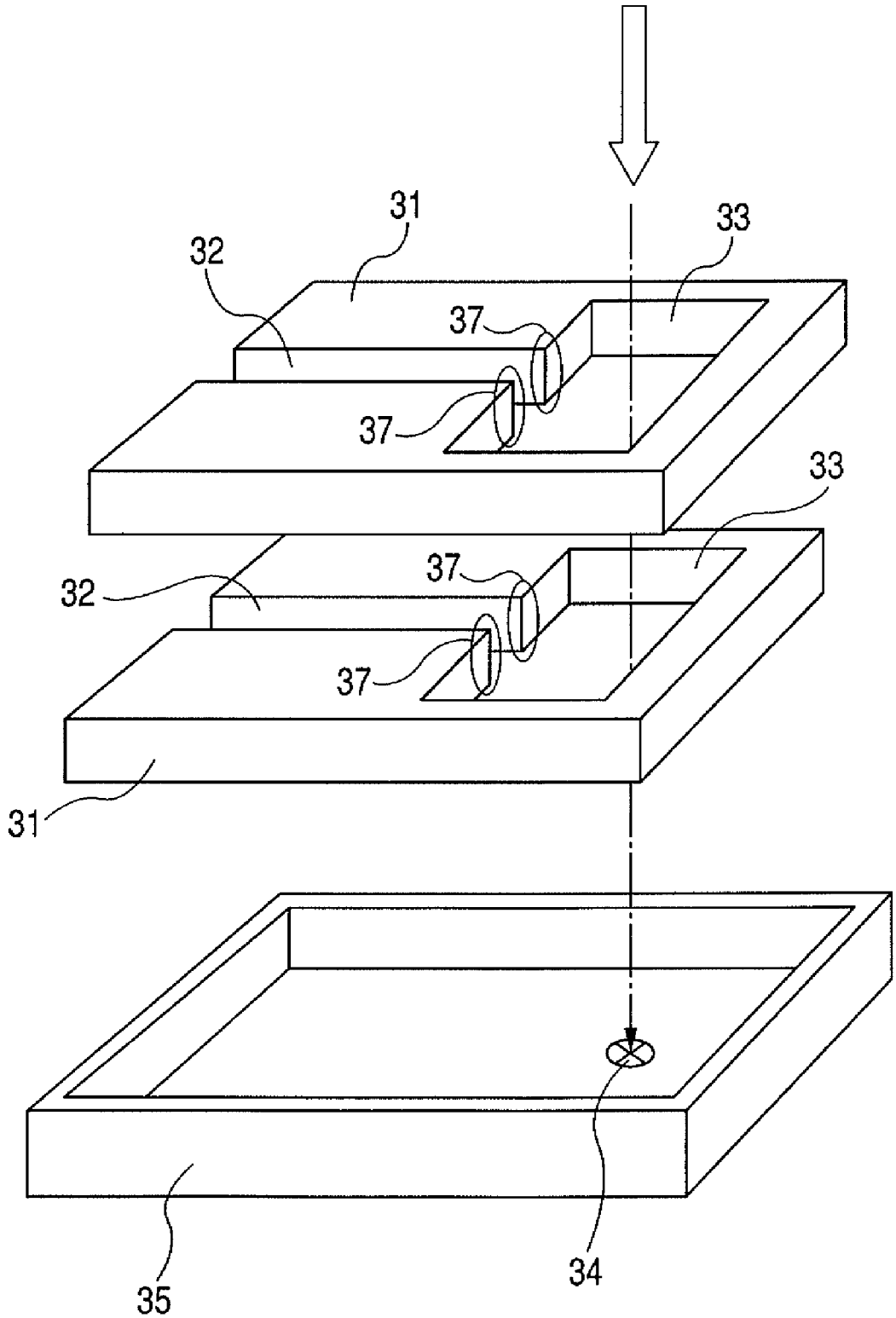
FIG. 20 is a plan view showing still another example of the waste ink absorbent member in which a hole portion and a slit are combined.

FIG. 20 is an exploded perspective view of a waste ink absorbent member and a lower case of the ink jet recording apparatus, incorporating the waste ink absorbent member.

In this embodiment, the waste ink absorbent member has a structure that two waste ink absorbent members, each having a hole portion 33 and a slit 32, are accommodated, in a stacked state, in the lower case of the ink jet recording apparatus. The waste ink absorbent members 31 are formed in same shape and size, including the hole portion 33 and the slit 32, and are so stacked that the hole portions 33 and the slits 32 are substantially completely match mutually. FIG. 20 shows an example in which the hole portion 33 does not reach a lateral end face of the waste ink absorbent member 31, but various structures explained in the foregoing embodiments may also be applied. Also the slit 32 is not limited to that illustrated in FIG. 20, but various structures explained in the foregoing embodiments may also be applied. Also the waste ink absorbent member 31 may be formed by three or more stacked layers.

The waste liquid is dropped, as indicated by a white arrow, from above the waste ink absorbent member 31, and is introduced into a waste ink containing tank, from a waste liquid introducing part 34, which is positioned on the bottom wall of the lower case 35 of the ink jet recording apparatus, in the aperture area of the hole portion 33. The introducing position of the waste liquid introducing part 34 is not particularly restricted, but it is required, as explained above, that a part of the dropped waste liquid drop comes into contact with the waste ink absorbent member before the dispersion stability of the colorant is lost at least by the water evaporation.

The structure constituted of a stack of plural waste ink absorbent members 31 as in the present embodiment is most effective for exploiting the effect of the shape of the waste ink absorbent member 31, having the hole portion 33 including the waste liquid introducing part 34 and the slit 32 extending from the hole portion 33 and narrower than the width of the hole portion 33. This effects results from an increased vertical height of the boundary portion 37. By stacking plural waste ink absorbent members 31, even when a certain amount of the solidified substance is generated in the vicinity of the boundary portion, the waste ink absorbent member 31 having the boundary portion 37 exists to a higher position. Therefore, a capillary force directed upwards and a capillary force directed along the slit 32 generates a force to move the waste liquid along the direction of the slit 32 trespassing such solidified substance. As a result, the waste liquid securely spreads to the distal end of the slit 32, then spreads to the entire planar area, and eventually is three-dimensionally absorbed over the entire structure, in succession from the lowermost layer.

Stacking of the waste ink absorbent members 31 in the vertical direction is known in the prior technologies, but the technology of the present invention is not conceivable from such known prior technologies. For example, in an example disclosed in the patent reference 6, a slit in a lower layer is completely covered by an upper layer. Such structure induces a solid-liquid separation as explained before. Also the patent reference 7 discloses a stacking in such a manner that the notched grooves are mutually displaced and do not match each other, and does not contemplate a stacking with a mutually matching position of the notched grooves.

A vertical height of the waste ink absorbent member 31 in all the layers is preferably 8 mm or larger in order to obtain the effects of the present invention, and more preferably 10 mm or larger.

Also in the case of stacking two or more layers of the waste ink absorbent members 31, it is preferable to employ a waste ink absorbent member 31 having small pores in an upper layer. In such structure, between vertically adjacent waste ink absorbent members 31, the upper layer has a larger capillary force than in the lower layer, whereby an upward capillary force is exerted between such adjacent layers and the waste liquid is more easily absorbed from a lower layer to an upper layer.

The pore size of the waste ink absorbent member may be regulated by varying a compression rate in a same material, or by using different materials.

Also the effects of the present invention may be obtained, even when the dimensions of the hole portions 33 and the slits 32, in the two or more waste ink absorbent members 31 to be stacked, are not exactly same, by positioning the hole portions and the slits so as to be mutually superposed substantially.

Figure 21:
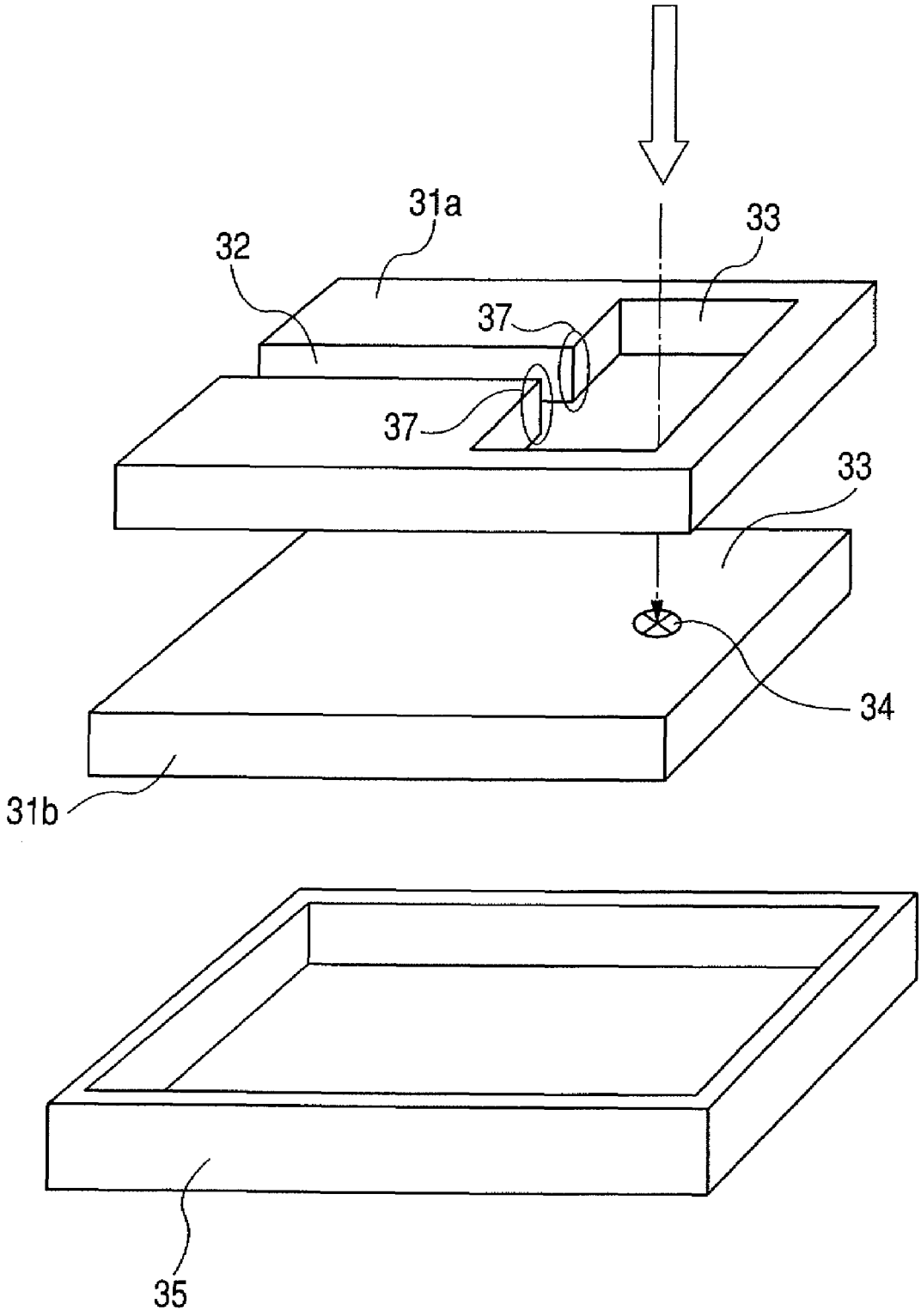
FIG. 21 is a plan view showing still another example of the waste ink absorbent member in which a hole portion and a slit are combined.

FIG. 21 is an exploded perspective view, showing another example of a waste ink absorbent member and a lower case of the ink jet recording apparatus, accommodating the waste ink absorbent member.

In the present embodiment, two waste ink absorbent members 31*a*, 31*b*, having a hole portion 33 and a slit 32 are mutually stacked and accommodated in a lower case 35 of an ink jet recording apparatus. The waste ink absorbent member 31*a* of the upper layer has a hole portion 31 and a slit 32, but the waste ink absorbent member 31*b* of the lower layer does not have such hole portion and slit. FIG. 21 shows an example in which the hole portion 33 does not reach a lateral end face of the waste ink absorbent member 31, but various structures explained in the foregoing embodiments may also be applied. Also the slit 32 is not limited to that illustrated in FIG. 21, but various structures explained in the foregoing embodiments may also be applied. Also there may be employed three or more layers by stacking a waste ink absorbent member including a hole portion 33 and a slit 32, or a waste ink absorbent member having a hole portion and a slit.

The waste liquid is dropped, as indicated by a white arrow, from above the waste ink absorbent member 31*a* of the upper layer, and is introduced from a waste liquid introducing part 34, which is positioned in the lower waste ink absorbent member 31*b*, in the aperture area of the hole portion 33. The introducing position of the waste liquid introducing part 34 is not particularly restricted.

A vertical height of the waste ink absorbent members 31*a*, 31*b* in all the layers is preferably 8 mm or larger in order to obtain the effects of the present invention, and more preferably 10 mm or larger.

Also in the case of stacking two or more layers of the waste ink absorbent members, it is preferable to employ a waste ink absorbent member having small pores in an upper layer. In such structure, between vertically adjacent waste ink absorbent members, the upper layer has a larger capillary force than in the lower layer, whereby an upward capillary force is exerted between such adjacent layers and the waste liquid is more easily absorbed from a lower layer to an upper layer.

The pore size of the waste ink absorbent member may be regulated by varying a compression rate in a same material, or by using different materials.

The present invention has been explained by certain embodiments thereof, and, in the following, there will be explained a shape and the like of the hole portion, applicable in the foregoing embodiments.

The hole portion is required to have a width, larger than the width of the slit, in order to realize the effects of the present invention. A specific size is not particularly restricted, but is preferably such that, when the waste liquid discharged in a single recovery operation is dropped in the waste liquid introducing part, a waste liquid drop thus formed contacts at least a part of the waste ink absorbent member.

The hole portion preferably has such a shape that, in an area to be contacted by the waste liquid in the internal surface (internal cross section) of the hole portion, the surface energy of the waste liquid is not equilibrated.

The area contacted by the waste liquid drop, as used in the present invention, means positions where the waste liquid 4 is in contact with the air and a part of the waste ink absorbent member 31, as indicated by regions A, B in FIG. 6.

Figure 22:
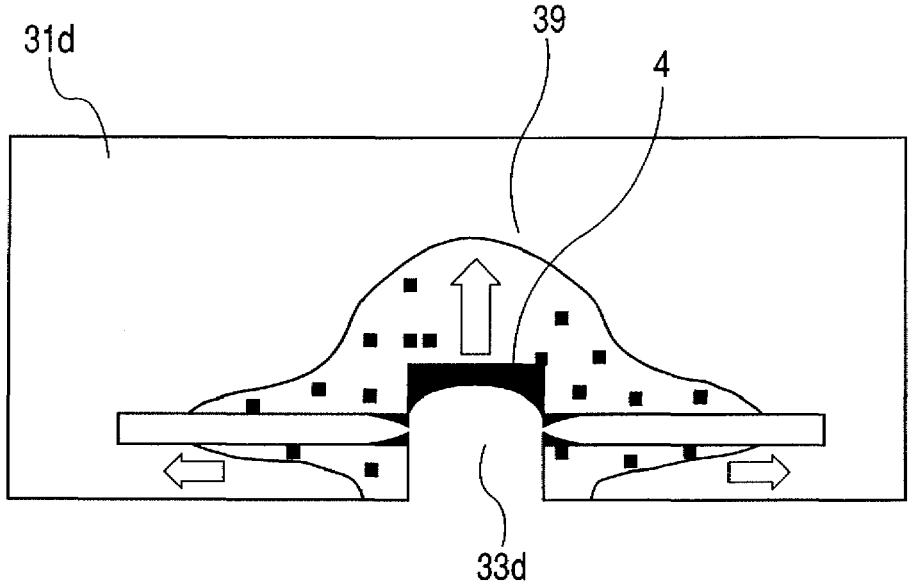
FIG. 22 is a plan view of a waste ink absorbent member, for explaining a phenomenon in which a surface energy of the waste liquid is not equilibrated.

Also the phenomenon that "the surface energy of the waste liquid is not equilibrated" means a phenomenon, as shown in FIG. 22, that the waste liquid 4 shows a deviated absorption in a certain direction within the waste ink absorbent member 31. In FIG. 22, a symbol 33*d* indicates a hole portion.

FIGS. 14A to 4C show other examples of the waste ink absorbent member. In a waste ink absorbent member 31*a* shown in FIG. 14A, a hole portion 33*a* has a semi-circular distal end. in a waste ink absorbent member 31*b* shown in FIG. 14B, two mutually distanced waste ink absorbent members 33*b* are mutually connected by a slit at base portions. In a waste ink absorbent member 31*c* shown in FIG. 14C, a hole portion 33*c* becomes wider toward a distal end. Any of the hole portions 33*a* to 33*c* is not a closed hole but is partially opened on a lateral face of the waste ink absorbent members 31*a* to 31*c*. Also slits extend from the hole portions 33*a*-33*c*.

Figure 23:
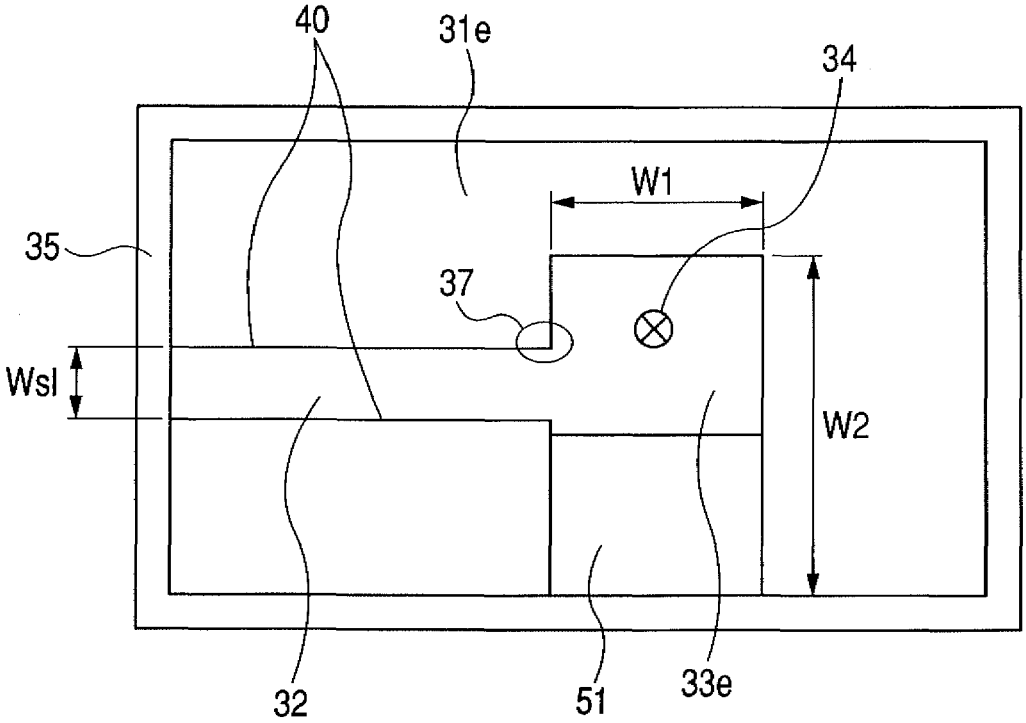
FIG. 23 is a plan view showing an example of a waste ink absorbent member, so constructed as to provide an internal surface of a hole portion with at least two different surface energies.

Another method of maintaining the surface energy of the waste liquid in a non-equilibrated state, in the area contacted by the waste liquid in the vicinity of the waste liquid introducing part, is to provide the internal surface of the hole portion with at least two different surface energies. An example of the method of providing different surface energies is a method of applying a hydrophilic treatment or a water-repellent treatment on a part of the internal surface of the hole portion. Examples of the method of applying a hydrophilic treatment or a water-repellent treatment on a part of the internal surface of the hole portion include a method of applying a hydrophilic treatment or a water-repellent treatment to the waste ink absorbent member itself in a part of the internal surface of the hole portion, and a method of constituting a part of the internal surface of the hole portion, by another ember having a surface energy different from that of the waste ink absorbent member. An example of the latter case is shown in FIG. 23. The waste ink absorbent member 31*e*, shown in FIG. 23, is provided, in a part thereof, with a hole portion 33*e* having an aperture part in a part thereof. A plate 51 is so mounted as to close the aperture part of the hole portion 33*e*. The plate 51 is formed for example by a resinous material, which is subjected to a water-repellent treatment at least on a surface constituting an inner surface of the hole portion 33*e*.

Figure 24:
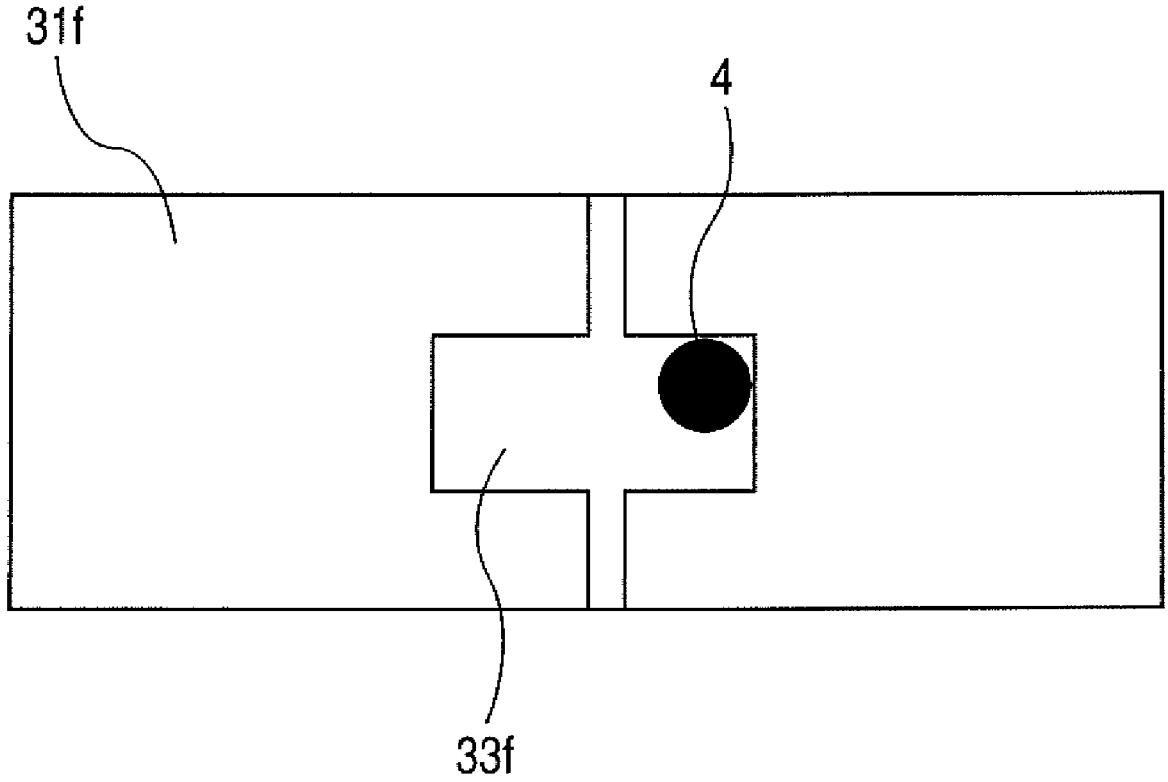
FIG. 24 is a plan view of a waste ink absorbent member, showing an example in which, in a hole portion not having an open part, an interfacial energy is made uneven in an area contacted by a drop of the waste ink.

In order that the surface energy of the area contacted by the waste liquid drop is in a non-equilibrated state, it is possible, also in case the hole portion does not have an aperture part, to control an area of the hole portion 33*f* or a discharge speed of the waste ink 4 in such a manner that the introduced waste ink 4 is in contact, only in a part of the external periphery thereof, with the waste ink absorbent member 31*f* as shown in FIG. 24.

In the present invention, whether the waste ink absorbent member is so formed as to have a non-equilibrated state of the surface energy can be confirmed by confirming that an ink drop, formed by introducing the waste liquid in the hole portion, diffuses not uniformly but in a specified direction.

Also the ink jet recording apparatus is preferably so designed that an area contacted by a total water liquid, discharged in a single recovery operation, does not generate an equilibrated state of the surface energy.

In a case where a waste liquid drop generated by the waste liquid of a single recovery operation does not come into contact with the waste ink absorbent member, it remains unabsorbed at least to a next recovery operation, thereby facilitating a coagulate generation or a viscosity increase. It is therefore important, in order to securely absorb the discharged water liquid, that the waste liquid drop generated from the total waste liquid discharged by a single recovery operation comes securely in contact with the waste ink absorbent member. Then an efficient absorption in the waste ink absorbent member can be realized by maintaining the surface energy of the areas contacted by the waste liquid drop, in a non-equilibrated state.

In the present invention, a recovery operation means an operation of sucking out a solidified or viscosity-increased ink in an ink discharge port of the recording head, thereby recovering the ink discharge ability of the recording head. An ink amount discharged in a single recovery operation may be different depending on a period of pause between the recording operations, but the single recovery operation as used in the present invention means a case with a minimum ink discharge amount among the recovery operations to be executed in the recording apparatus. Therefore, in case an ink of such amount or larger is discharged, a part of an ink drop, formed by such discharged ink, contacts as a waste liquid with the waste ink absorbent member.

The introduction of the waste liquid from the waste liquid introduction means to the waste ink absorbent member is preferably executed in a non-contacting state with the waste ink absorbent member, the lower case of the main body of the ink jet recording apparatus or the main body of a water ink tank. The non-contacting state means that the waste liquid discharged from the waste liquid introducing means is discharged without a simultaneous contact with the waste liquid introducing means and the waste ink absorbent member or the lower case or the bottom portion of the tank itself.

The main body of the waste ink tank means a tank accommodating the waste ink absorbent member.

A direct contact of the waste liquid with the waste ink absorbent member may generate a solid sticking to a cross section of the hole portion, and is undesirable as it may cause a clogging of the waste liquid introducing means.

The shape of the hole portion is not particularly restricted as long as the ink drop, formed by the ink discharged in a single recovery operation, does not have an equilibrated surface energy state, but is required to have a large width both in a parallel direction and a perpendicular direction to the slit.

Figure 25A:
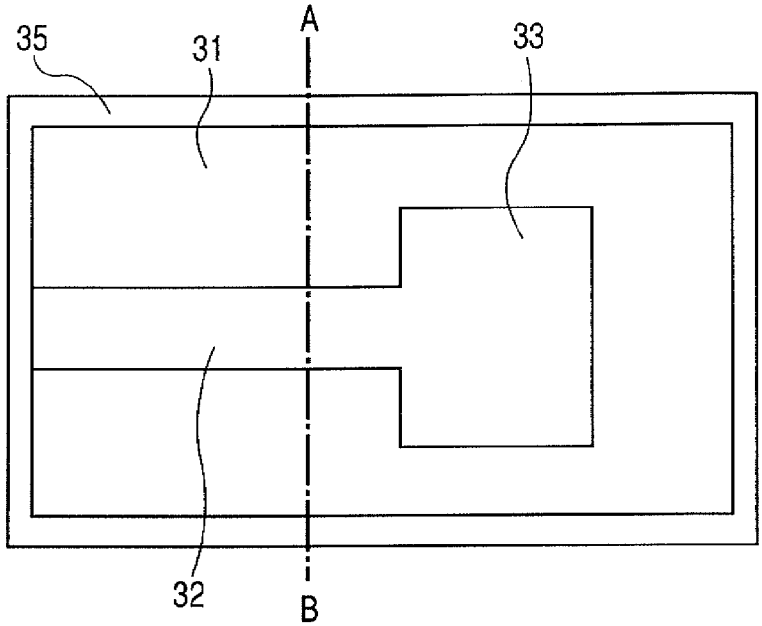
FIGS. 25A, 25B, 25C and 25D are views showing various cross-sectional shapes of a slit to be employed in the invention.
Figure 25B:
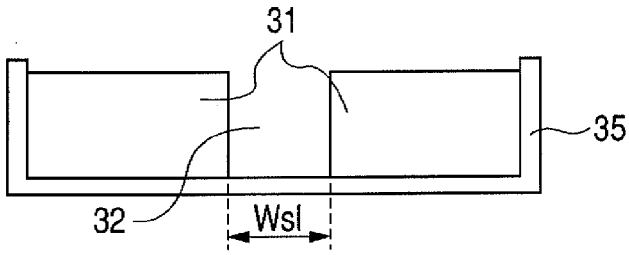
Figure 25C:
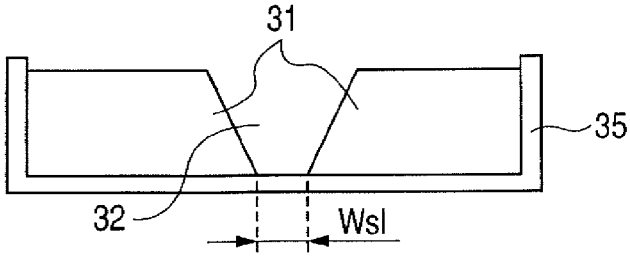
Figure 25D:
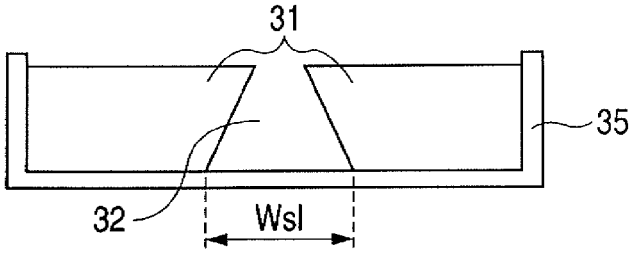

The slit may be used in any shape, without a particularly restriction. Preferred specific examples are shown in FIGS. 25A to 25D, but these examples are not restrictive. FIG. 25A is a plan view of a waste ink absorbent member 31 accommodated in a lower case 35 of an ink jet recording apparatus, and FIGS. 25B to 25D show examples the slit shape, illustrated in cross-sectional views along a line A-B in FIG. 25A.

A slit 32 shown in FIG. 25B has such a shape that a width Ws1 of the slit 32 is substantially equal in an upper part and in a lower part. A slit 32 shown in FIG. 25C has such a shape that a width Ws1 of the slit 32 is larger in an upper part than in a lower part. A slit 32 shown in FIG. 25D has such a shape that a width Ws1 of the slit 32 is narrower in an upper part than in a lower part.

In the following, examples of the ink and the colorant, advantageously employable in the present invention. The present invention exhibits a superior effect on such an ink, which is designed for a higher bleeding resistance and which shows a hitherto unknown phenomenon that causes a colorant sedimentation on the waste ink absorbent member. Causes or factors inducing such phenomenon are analyzed to include characteristics of the colorant singly, a relation of the colorant and the solvent, and a novel phenomenon in a bonding state, as will be explained in the following. However the present invention is not limited to the following description but is naturally applicable to any ink colorant or any ink that brings about the newly found phenomenon.

An ink with improved bleeding resistance includes, for example, as a colorant, a self-dispersing pigment (such as carbon black) including a hydrophilic group which is bonded either directly or across another atomic group, and, plural water-soluble organic solvents of which at least one is a poor water-soluble organic solvent having a property of reducing the dispersion stability of the pigment (first ink). When such ink is deposited on a recording medium, along with the evaporation of water, a ratio of the poor solvent to the pigment becomes higher and the pigments start to coagulate in an upper layer part of the recording medium. Therefore, such ink, even singly, has a bleeding-suppressing effect even when another ink is present in the vicinity. Also in case the colorant of such ink is constituted of a pigment in which a hydrophilic group bonded to the pigment surface is made present at a high density with respect to the surface of the pigment, because of a steric hindrance caused by the structure of the colorant, the solvent in the ink shows less affinity to such pigment in comparison with the prior self-dispersing pigment, whereby the pigment tends to lose the dispersion stability even by a slight water evaporation. As a result, there is obtained an effect of more alleviating the bleeding.

Also an ink showing a viscosity increase or a particle size increase by a water evaporation, more specifically an ink, showing a change in the average particle size by 25% or more when water is evaporated by 40% from the liquid, is capable of further alleviating the bleeding. The particle size can be easily confirmed by a particle size measurement without dilution, utilizing a concentrated system particle size analyzer FPAR-1000 (trade name; manufactured by Otsuka Denshi Co.).

Also such first and second inks, that show, in a mixture, a viscosity higher than the viscosity of the first ink and the viscosity of the second ink, have an alleviating effect on the bleeding.

Such ink is difficult to absorb in the waste ink absorbent member and when causing a coagulate formation or a viscosity increase by the water evaporation from the ink, it is difficult to re-disperse or to lower the viscosity for example by supplying a waste ink with little water evaporation by repeating the recovery operation.

An amount of evaporation from the waste ink varies, for example depending on a material of a waste liquid tube, an internal diameter thereof, and an amount of the waste ink discharged per a recovery operation. However, the material and the internal diameter of the waste liquid tube, commonly used, are within limited ranges, and the amount of the waste ink discharged per a recovery operation is generally within a certain range.

In an ink jet recording apparatus utilizing such ink, the absorbing ability of the waste ink absorbent member shows an evident difference when the waste ink absorbent member of the present invention is utilized.

In the present invention, a poor solvent is defined as a solvent showing a property that "when a pigment dispersion, containing a solvent to be evaluated by about 50 wt % and a colorant to be employed in an ink in a dispersed state, is stored at 60° C. for 48 hours, a particle size in such dispersion is larger than the particle size in a pigment dispersion, free or almost free from the solvent to be evaluated and containing the colorant to be employed in the ink". Also a good solvent means a solvent of characteristics other than those of a poor solvent.

The waste ink absorbent member of the present invention may also be used for absorbing a waste liquid, derived from a second ink, other than the aforementioned first ink containing the solvent and the colorant as described above, in which the solvent includes a poor solvent for the colorant. An introducing position for the waste liquid, derived from the second ink, is not particularly restricted. However, when the waste liquid derived from the ink containing the solvent and the colorant as described above, in which the solvent includes a poor solvent for the colorant, and the waste liquid derived from the second ink come in mutual contact on or in the waste ink absorbent member and hinder a diffusion or a displacement into the waste ink absorbent member, it is necessary to consider the introducing positions of both liquids into the waste ink absorbent member. More specifically, the introducing positions have to be separated by such a distance that, when both waste liquids are introduced into the waste ink absorbent member, the solvent contained in the waste liquid, derived from the liquid containing the solvent and the colorant as described above in which the solvent includes a poor solvent for the colorant, can singly diffuse or move in the waste ink absorbent member and that thus displaced waste liquid can contact the waste liquid derived from the second ink. More specifically, as shown in FIG. 32, a shortest distance between an introducing position 12 for the waste liquid, derived from the first ink, and an introducing position 13 for the waste liquid derived from the second ink is from 5 to 20 cm.

Figure 26:
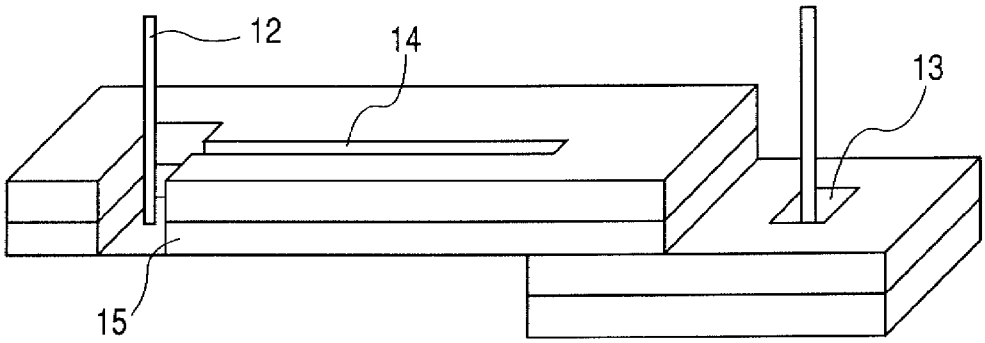
FIG. 26 is a perspective view showing an example of a waste ink absorbent member in which plural waste liquids are introduced.

Referring to FIG. 26, the introducing positions 12, 13 for the waste liquids derived from the first and second inks are provided, at bottoms thereof, with plastic plates without an ink absorbing property. Each waste liquid is dropped on such plastic plate, and thereafter diffuses to the waste ink absorbent member.

Also as shown in FIG. 26, the waste ink absorbent member may be utilized more efficiently, by positioning the introducing position 12, for the waste liquid derived from an ink having a relatively smaller diffusion rate in the waste ink absorbent member, relatively higher than the introducing position 12, for the waste liquid derived from an ink having a relatively larger diffusion rate in the waste ink absorbent member.

The diffusion rate of a waste liquid in the waste ink absorbent member may be compared by a following method.

A member of a material, same as that of the waste ink absorbent member to be used in the ink jet recording apparatus, is formed into a size of a width of 5 mm, a length of 150 mm and a thickness of 5 mm. 10 ml of a liquid to be measured are placed in a 50-cc beaker, and an waste ink absorbent member of the above-mentioned size is immersed therein. After a standing for 5 minutes, the waste ink absorbent member is taken out from the beaker, and a displaced distance of each liquid is measured to determine a diffusion rate.

In the following, there will be explained examples of a second ink, which, when the first and second inks are in mutual contact, hinder diffusion or displacement of both liquids into the waste ink absorbent member. Examples include a second ink which contains, for the purpose of alleviating the bleeding phenomenon on the recording medium, a solvent that constitutes a poor solvent for a pigment contained in the first ink, and an ink containing at least a colorant which has a structure including a benzene ring in a terminal portion (the structure may be partly hydrophilic if a major part is hydrophobic). A colorant of a structure having a benzene ring in a terminal part generally has a property of being easily adsorbed on a pigment. This property hinders the dispersion stability of the pigment and, when the waste liquids derived from the first and second inks come into contact in the waste ink absorbent member, tends to constitute a barrier, hindering the diffusion or movement thereof into the waste ink absorbent member. Therefore the problem for the invention becomes conspicuous, and the effect obtained by solving such problem will also become conspicuous.

It is also necessary, in a case where the first and second inks are in a following relation, to specify the introducing positions of the waste liquids derived from the respective inks as explained above. A specific example includes a first ink and a second ink which show, in a mixture, a viscosity higher than the viscosity of the first ink and the viscosity of the second ink.

Such ink is difficult to absorb in the waste ink absorbent member and when causing a coagulate formation or a viscosity increase by the water evaporation from the ink, it is difficult to re-disperse or to lower the viscosity to the original state for example by supplying a waste ink with little water evaporation by repeating the recovery operation.

Examples of the second colorant which tends to constitute a barrier which hinders the diffusion or the movement into the waste ink absorbent member, when the waste liquids derived from the first and second inks, include the colorant preferred in the first embodiment explained above.

First Embodiment for Accomplishing the Second Target

In the following there will be explained a second embodiment for accomplishing the first target.

The waste ink absorbent member of the invention is to recover a waste liquid, which is generated in an ink jet recording apparatus for image formation by discharging an ink from a recording head. The ink jet recording apparatus is to execute an image formation by a recording head which discharges at least a first liquid and a second liquid, as explained above, and is equipped with a recovery mechanism for forcedly discharging these liquids from the recording head, thereby maintaining discharge characteristics of the recording head, a waste ink absorbent member for absorbing and holding waste liquids generated by the forced discharge of the liquids from the recording head, and introduction means for guiding the waste liquid from the recovery mechanism to the waste ink absorbent member for introduction of the waste liquids into the waste ink absorbent member.

The liquids giving rise to the waste liquids to be absorbed by the waste ink absorbent member include the first liquid and the second liquid, but may further include another liquid. The liquid in the present invention may be any liquid that is deposited on a recording medium for recording an image or the like thereon and includes not only an ink but also other liquids such as a reaction liquid. Combinations of the first and second liquids include a case in which both liquids are inks, a case in which the first liquid is a black ink and the second liquid is a color ink, and a case which includes also other color inks. Naturally the present invention is not limited to such combinations.

Also the present invention employs first and second liquids having such a property that, when the first and second liquids are contacted in the waste ink absorbent member, at least either of the first and second liquids constitutes a barrier which hinders a diffusion or a movement of the first or second liquid in the waste liquid. It means that, when the first and second liquids are absorbed in the waste ink absorbent member, a mutual contact of the both liquids causes the first liquid and/or the second liquid to constitute a barrier, hindering a further diffusion or movement of the first liquid or the second liquid into the waste ink absorbent member. "Constituting a barrier" means, for example, a case in which a mutual contact of the first and second liquids in the waste ink absorbent member induces a viscosity increase of the first liquid, whereby it no longer diffuse or move further into the waste ink absorbent member. Barrier as used in the present invention includes any and all factors that hinders a diffusion or a movement into the waste ink absorbent member, and includes, for example, a viscosity increase in a liquid and a coagulation of a colorant in a liquid, but is not limited to these cases.

Whether a barrier is generated by the contact of the first and second liquids can be identified by comparing, on all the combinations of two liquids among the plural liquids employed for recording in the ink jet recording apparatus, characteristics of respective liquids before mixing and characteristics after mixing. Examples of such characteristics include a viscosity and a particle size. As a specific example, when viscosities of two liquids are respectively measured before mixing, and, in the case that a liquid after mixing has a viscosity higher than the viscosity of each liquid, such viscosity increase is considered as a barrier. As another example, in a case where at least one of the two liquids is an ink employing a pigment as the colorant, the particle size of the pigment is measure before and after the mixing, and, when the particle size increases by mixing, a barrier formation can be estimated. The particle size can be easily confirmed by a particle size measurement without dilution, for example utilizing a concentrated system particle size analyzer FPAR-1000 (trade name; manufactured by Otsuka Denshi Co.).

Such barrier constitutes a factor that inhibits a diffusion or a movement of the waste liquid derived from the first liquid or the water liquid derived from the second liquid, in the waste ink absorbent member. Therefore, the introducing positions for the waste liquids into the waste ink absorbent member have to be distanced in such a manner that the barrier by the mutual contact of the waste liquids is not formed at least until the approximately entire area of the waste ink absorbent member is filled by the waste liquids.

On the other hand, in an ink with an improved bleeding resistance, a prompt coagulation of the colorant takes place after deposition on the recording medium. This phenomenon also occurs in the waste ink absorbent member. Thus, the ink with an improved bleeding resistance has, in itself, a property of not easily diffusing or moving into the waste ink absorbent member.

As a result of investigations undertaken by the present inventors, it is found that the distance between the introducing position for the waste liquid derived from the first liquid and that for the waste liquid derived from the second liquid has an optimum range that facilitates the diffusion or movement of the waste liquids in the waste ink absorbent member, when a specified liquid, to be explained later, is employed. The absorbing ability of the waste ink absorbent member can be fully exploited by selecting the introducing positions for the waste liquids at such optimum distance.

The introducing position of the waste liquid means a position where the waste liquid is absorbed by the waste ink absorbent member, and does not mean a position where introducing means for introducing the waste liquid into the waste ink absorbent member, such as a waste liquid tube, contacts the waste ink absorbent member. The waste liquid tube or the like may be or may not be in contact with the waste ink absorbent member, and may have, for example, a structure of dropping the waste liquid from above the waste ink absorbent member. Also when a waste liquid is introduced into a waste ink absorbent member, the waste liquid is in fact absorbed with a certain spreading on a surface of the waste ink absorbent member. The introducing position of the waste liquid means a center of the waste liquid, presenting a spread area on the surface of the waste ink absorbent member.

Also by selecting the introducing positions for the waste liquids at such optimum distance, it is rendered possible to utilize a waste ink absorbent member so as to efficiently absorb the waste liquids even when the waste ink absorbent member is restricted in the volume or the installation area thereof in order to achieve a cost reduction in the ink jet recording apparatus. In the case that the distance is excessively long, a system for introducing the waste liquid into the waste ink absorbent member, such as a waste liquid tube, has to be made longer and becomes costly, thus hindering a cost reduction. Also in certain cases, there may result a solidification of the waste liquid for example by an evaporation in such system, thereby deteriorating the reliability of the apparatus and deteriorating the waste ink absorbing ability.

Figure 27A:
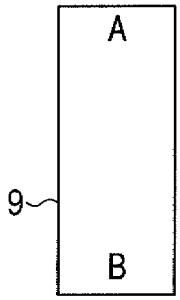
FIGS. 27A, 27B, 27C, 27D and 27E are plan views of a waste ink absorbent member, showing changes in a waste ink holding area in an order along the progress of absorption of the waste ink.
Figure 27B:
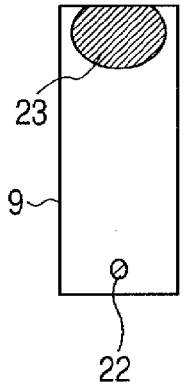
Figure 27C:
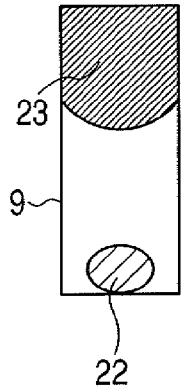
Figure 27D:
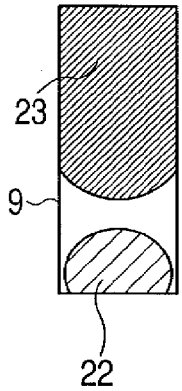
Figure 28A:
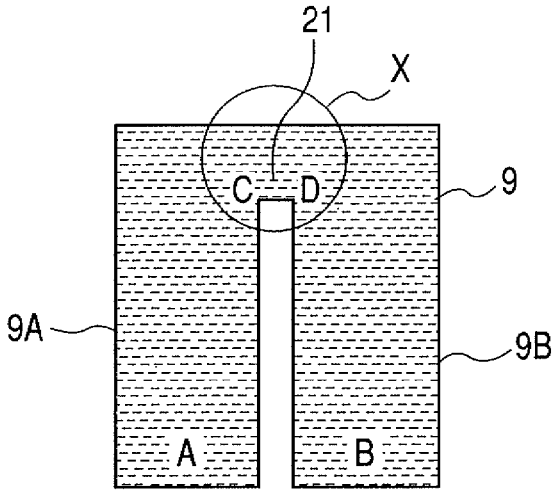
FIGS. 28A, 28B, 28C and 28D are plan views of another waste ink absorbent member, showing changes in a waste ink holding area in an order along the progress of absorption of the waste ink.

An optimum distance between the introducing positions for the waste liquids is not a distance defined by connecting the introducing positions with a straight line, but a shortest distance between the introducing positions for the waste liquids in the waste ink absorbent member. For example, in the case of a rectangular parallelopiped-shaped waste ink absorbent member as shown in FIG. 27A, with introducing positions A and B for the waste liquids, the shortest distance is a linear distance between A and B. Also in the case of a notched waste ink absorbent member 9 as shown in FIG. 28A, with the introducing positions A and B for the waste liquids in respective areas across a notch, the shortest distance is defined by a path passing through corners C, D of the notch, namely by a sum of straight line segments AC, CD and CB. Such distances are defined in consideration of the absorption path for the waste liquid from the introducing position A and that for the waste liquid from the introducing position B, and may also be considered a shorted absorption path in the waste ink absorbent member.

More specifically, in the case of employing the first liquid and the second liquid utilized in the present invention and employing an ordinarily utilized waste ink absorbent member principally constituted of pulp fibers, the shortest distance between the introducing positions for the waste liquids is preferably from 5 to 20 cm.

When the distance between the introducing positions for the waste liquids is excessively large, the waste liquid may cause an evaporation, as explained above, in the system for introducing the waste liquid into the waste ink absorbent member, thereby resulting in a solidification or a loss of the absorbing ability of the waste ink absorbent member. An amount of evaporation varies, for example depending on a material of a waste liquid tube, an internal diameter thereof, and an amount of the waste ink discharged per a recovery operation (forced ink discharge from the ink jet recording head). However, the material and the internal diameter of the waste liquid tube, commonly used, are within limited ranges, and the amount of the waste ink discharged per a recovery operation is generally within a certain range.

The present inventors find that, within such ranges, the phenomena of solidification and loss in the absorbing ability of the waste ink absorbent member are not affected significantly by the ordinarily utilized tube and the amount of the waste ink discharged per a recovery operation, but affected significantly by the distance between the introducing positions for the waste liquids. Therefore, the effects of the present invention can be exhibited sufficiently when the distance between the introducing positions for the waste liquids is within the aforementioned range.

Also in the present invention, the waste ink absorbent member preferably has a continuous absorbing property of continuously absorbing the first liquid and the second liquid. The continuous absorbing property of continuously absorbing the first liquid and the second liquid indicates, instead of providing a waste ink absorbent member exclusive for the first and a waste ink absorbent member exclusive for the second liquid, a structure of utilizing a common single waste ink absorbent member in which the introducing positions for the waste liquids are provided at a specified distance. Examples of the common waste ink absorbent member for the first and second liquids include a structure constituted of a single waste ink absorbent member, and a structure constituted of plural waste ink absorbent members in which the first and second liquids absorbed therein can mutually contact within the waste ink absorbent members.

Such continuous absorbing property, without relying on separate waste ink absorbent members respectively for the first liquid and the second liquid, allows to adapt to various ratios of the first and second liquid, variable depending on the user, and to efficiently exploit the ability of the waste ink absorbent member.

An embodiment of the present invention provides a waste ink absorbent member, adapted for use in an ink jet recording apparatus that executes an image formation, utilizing, as the first liquid, a black ink which contains a solvent and a colorant and in which the solvent includes a poor solvent for the colorant, and, as the second liquid, a color ink containing a solvent which constitutes a poor solvent for the colorant of the black ink.

The black ink and the color ink in this case constitutes an ink set designed for improving the bleeding resistance. For improving the bleeding resistance, in addition to above, various ink sets are proposed, such as an ink set utilizing a pigment as the colorant of the black ink and containing a salt in the black ink or the color ink, and an ink set utilizing colorants of different polarities as those for the black ink and the color ink. As a result of investigations undertaken by the present inventors, a most excellent bleeding resistance among these is found in an image formed by a black ink which utilizes a pigment as the colorant and contains a solvent constituting a poor solvent for the pigment, and a color ink containing such poor solvent. The poor solvent, to be defined later in more details, indicates, in the present invention, a water-soluble organic solvent to which a water-insoluble colorant (pigment) shows a poor dispersion stability. Also a good solvent indicates a water-soluble organic solvent to which a water-insoluble colorant shows a good dispersion stability.

However, in the case of introducing a waste liquid of a black ink which contains a pigment as the colorant and a solvent constituting a poor solvent for the pigment, and a waste liquid of a color ink containing the poor solvent, in a same position or adjacent positions as in the prior technology, there is induced a phenomenon that the waste liquids overflow and lead from the waste ink absorbent member, and such phenomenon is not experienced in other investigated ink sets.

The aforementioned phenomenon appears more conspicuously than in other ink sets, presumably because of following reasons.

In order to improve the bleeding resistance, it is important that the colorant promptly coagulates after the ink is deposited on the recording medium. In the case of an image formation with an ink set, in which the black ink and the color ink both contain a poor solvent to the pigment employed in the black ink, it is estimated that a coagulated substance of the pigment is formed almost simultaneously with the contact of both inks on the recording medium, thereby attaining a bleeding resistance improved in comparison with the prior inks. Such phenomenon takes place also in the waste ink absorbent member. When the waste inks of the black ink and the color ink have a same introducing position or adjacent introducing positions, a mutual contact of the inks generates a coagulate of the pigment. In other black ink and color ink, the ink shows a viscosity increase by a water evaporation, thereby eventually forming a coagulate, but the rate of viscosity increase after water evaporation is slower. In the case of an ink that forms a coagulate of the pigment almost simultaneously with the contact, a large coagulated substance is formed before the waste ink can diffuse in the waste ink absorbent member, because of a rapid viscosity increase. The present inventors conclude that the absorbing ability of the waste ink absorbent member is thus deteriorated to induce a phenomenon that the waste ink leaks from the waste ink absorbent member. Embodiments of the present invention provides constitutions for solving this problem.

Figure 29A:
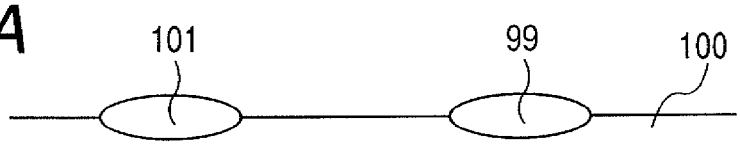
FIGS. 29A, 29B and 29C are cross-sectional views showing a progress of diffusion of a waste liquid in a waste ink absorbent member.

In the case of utilizing, as a first liquid, a black ink which contains solvents and a colorant and in which the solvents includes a poor solvent for the colorant, and, as the second liquid, a color ink containing a solvent which constitutes a poor solvent for the colorant of the black ink, and when the waste liquids of these liquids are absorbed in mutually separate positions by the waste ink absorbent member, the waste liquids are considered to show following behaviors in the waste ink absorbent member. FIG. 29A shows a state immediately after a first waste liquid 101, which is a waste liquid of the first liquid, and a second waste liquid 99, which is a waste liquid of the second liquid, are dropped in mutually distanced positions on a waste ink absorbent member 100. In such state, the waste liquids 101, 99 are still present in the vicinity of the surface of the waste ink absorbent member 100.

Figure 29B:
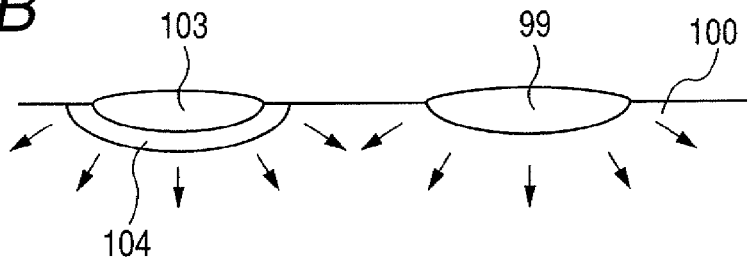
Figure 29C:
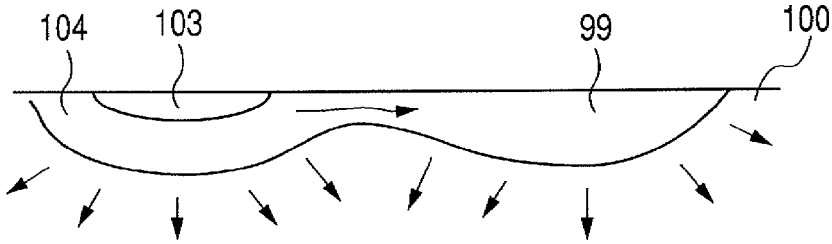

Thereafter, the waste liquids 101, 99 diffuse or move into the waste ink absorbent member 100. By maintaining the distance, on the waste ink absorbent member 100, between the introducing positions for the waste liquids 101, 99 at the aforementioned optimum distance, the waste liquids 101, 99 show phenomena as shown in FIGS. 29B and 29C in the course of diffusion or movement. In the first waste liquid 101, since a solvent 104 thereof contains a poor solvent for a colorant 103, the dispersion of the colorant 103 becomes unstable along with the evaporation of water, but the solvent 104 alone continues to diffuse or move into the waste ink absorbent member 100. On the other hand, the second waste liquid 99 diffuses or moves into the waste ink absorbent member 100, while maintaining its state.

With a further lapse of time, the solvent 104 of the first waste liquid 101 and the second waste liquid 99 further diffuse or move in the waste ink absorbent member 100, whereupon the solvent 104 of the first waste liquid 101 comes into contact with the second waste liquid 99 as shown in FIG. 29C. As the solvent 104 scarcely contains the colorant 103, the dispersion of the colorant 103 hardly occurs when the second waste liquid 99 contacts the solvent 104 of the first waste liquid 101.

By the mutual contact of the solvent 104 and the second waste liquid 99, the solvent 104 is pulled toward the second waste liquid 99. In the waste ink absorbent member 100, as a suction force toward the second waste liquid 99 functions in the introducing area of the first waste liquid 101, not only the solvent 104 but also the colorant 103 can spread further when the first waste liquid 101 is dropped next time.

On the other hand, when the distance between the introducing position of the first waste liquid 101 and the introducing position of the second waste liquid 99 is excessively small, the colorant 103 of the first waste liquid 101 and the second waste liquid 99 cause a direct contact to form an aforementioned barrier, thereby hindering the diffusion or movement of the waste liquids 101, 99 into the waste ink absorbent member 100. On the other hand, when the distance between the introducing positions of the waste liquids 101, 99 is excessively large, each of the waste liquids 101, 99 causes a coagulation singly, and the diffusion or movement of the waste liquids into the waste ink absorbent member 100 is hindered also in this case.

Thus, by maintaining the distance between the introducing positions of the waste liquids 101, 99 at such a distance as to cause, by a contact of the solvent 104 of the first waste liquid 101 and the second waste liquid 99, a phenomenon that the solvent 104 is pulled to the side of the second waste liquid 99, the waste liquids 101, 99 can be effectively absorbed in the waste ink absorbent member 100.

The phenomenon of pulling the solvent 104 toward the side of the second waste liquid 99 occurs more effectively in the case that the first waste liquid 101 further contains a good solvent for the colorant 103 in the solvents 104 and that, among the solvents 104, a solvent having a largest Ka value, determined by Bristow's method, is a good solvent.

In such case, in the course of diffusion of the solvent 104 of the first waste liquid 101 in the waste ink absorbent member 101, the poor solvent diffuses in the waste ink absorbent member 100 preceding the good solvent, thereby forming a solvent-rich region containing the colorant 103, between the colorant 103 and the diffusion area of the poor solvent. In such region, the colorant 103 does not easily coagulate. Therefore, the colorant 103 is rendered easily diffusible in the waste ink absorbent member 100 together with the good solvent, which diffuses following the diffusion of the poor solvent.

Now, the Ka value determined by Bristow's method will be explained. This value is used as an index, indicating a penetrability of an ink into the interior of the waste ink absorbent member. A penetration amount V ($mL/m^2=\mu m$) of the ink into the interior of a recording medium (ink penetration amount per 1 $m^2$ of recording medium), after a time t from the deposition of an ink drop onto the surface of the recording medium, is represented by following Bristow's equation:

$$V=Vr+Ka(t-tw)^{1/2}$$

Immediately after the ink drop is deposited on the surface of the recording medium, the ink is mostly absorbed by surface irregularities (surface roughness part) of the recording medium, and scarcely penetrates into the interior of the recording medium. Such period is called a contact time, and Vr indicates an ink amount absorbed in the surface irregularities of the recording medium during the contact time. After the ink drop is deposited on the surface of the recording medium and beyond the contact time, the ink penetrates into the interior of the recording medium by an amount proportional to a 1/2-th power of a time beyond the contact time, namely (t−tw). Ka is a proportional coefficient corresponding to a penetration velocity. The Ka value can be measured with a dynamic liquid penetrability testing apparatus based on Bristow method (for example Dynamic Penetrability Testing Apparatus S (trade name), manufactured by Toyo Seiki Seisakusho Co.).

The Ka value by Bristow's method as used in the present invention is measured utilizing, as a recording medium, a plain paper (for example a PB paper, manufactured by Canon Inc. for an electrophotographic copying apparatus, a page printer (laser beam printer) or an ink jet printer) or a PPC paper for electrophotographic copying apparatus). Also the environment of measurement assumes an ordinary office environment, for example with a temperature of 20-25° C. and a humidity of 40-60%.

In another embodiment of the present invention, a barrier generated by the contact of the first liquid and the second liquid may have a reversibly generating and vanishing property. "Barrier having a reversibly generating and vanishing property" means, for example, that a contact of a black ink and a color ink generates a coagulated substance constituting a barrier, but the coagulated substance has a property of being re-dissolved (re-dispersed) and vanishing when the coagulated substance is placed in the black ink or the black ink only is continuously dropped onto the coagulated substance.

In the case of utilizing an excessively reactive liquid such as a reactive liquid, the coagulated substance, once formed, cannot be re-dissolved (re-dispersed). Therefore, the ink jet recording apparatus is so constructed as not to contact the ink and the reactive liquid, in order not to generate a coagulated substance. However, in the case that the barrier has the reversibly generating and vanishing property, it becomes unnecessary to prevent the contact of the two liquids in the apparatus with an additional cost, and the ink jet recording apparatus can therefore be simplified.

In the following, the waste ink absorbent member and the introducing positions for the waste inks in the present invention will be explained in more details.

The positional relationship, on the waste ink absorbent member, of an introducing position A for the waste liquid of the black ink and an introducing position B for the waste liquid of the color ink includes following structures:

structure 1: A and B are provided on suitable positions on a same plane of a waste ink absorbent member;

structure 2: A and B are positioned on mutually different planes of a waste ink absorbent member; and structure 3: A and B are positioned on different absorbent members in a waste ink absorbent member formed by plural absorbent members.

More preferably, a following structure is conceivable. For example in the structure 1 and in the longitudinal direction of the waste ink absorbent member, the introducing position for a waste ink is provided at an end portion of the waste ink absorbent member, and the introducing position for the other waster ink is provided in any position in an area opposite to the end portion and beyond the center. Further preferably, The waste ink to be introduced to the end portion of the waste ink absorbent member has a larger diffusion velocity in the waste ink absorbent member, among the two inks. In this manner, it is possible to utilize the waste ink absorbent member more efficiently.

Also as another preferred structure, in the structure 2, a waste ink is introduced from a surface (upper surface) of the waste ink absorbent member, and the other waste ink is introduced from a rear surface (lower surface) of the waste ink absorbent member, thereby causing the waste inks to diffuse in the waste ink absorbent member. This structure is particularly effective in the case of employing a waste ink absorbent member, of which a constituent material has a property that the liquid diffusion velocity is larger in a lateral direction than in a thickness direction. Such structure allows the waste inks to be absorbed even to the corner portions of the waste ink absorbent member until the waste inks mutually contact, whereby the waste ink absorbent member can be utilized very efficiently. Also in the case of utilizing a waste ink absorbent member of a material of the above-mentioned property, it is possible to provide the introducing position A for the waste ink of the color ink on a surface (upper surface) of the waste ink absorbent member, and to so construct the introducing position B for the waste ink of the black ink that the diffusion starts from a lateral surface of the waste ink absorbent member. Also in this case, the waste inks are absorbed even to the corner portions of the waste ink absorbent member until the waste inks mutually contact, whereby the waste ink absorbent member can be utilized very efficiently.

Also various structures are conceivable in the structure 3, such as a structure in which plural waste ink absorbent members are placed in parallel in the horizontal direction, and a structure in which plural waste ink absorbent members are placed vertically stacked, and most preferably the latter.

The present inventors have investigated these structures in various combinations, the absorbing ability has been superior, in all the structures, to that in a case where the introducing positions for the waste liquids of the black ink and the color ink are in a same position or in adjacent positions, and the phenomenon of ink leakage from the waste ink absorbent member has not been observed. Among these, a structure shown in FIG. 30 is found to be most excellent.

Figure 30:
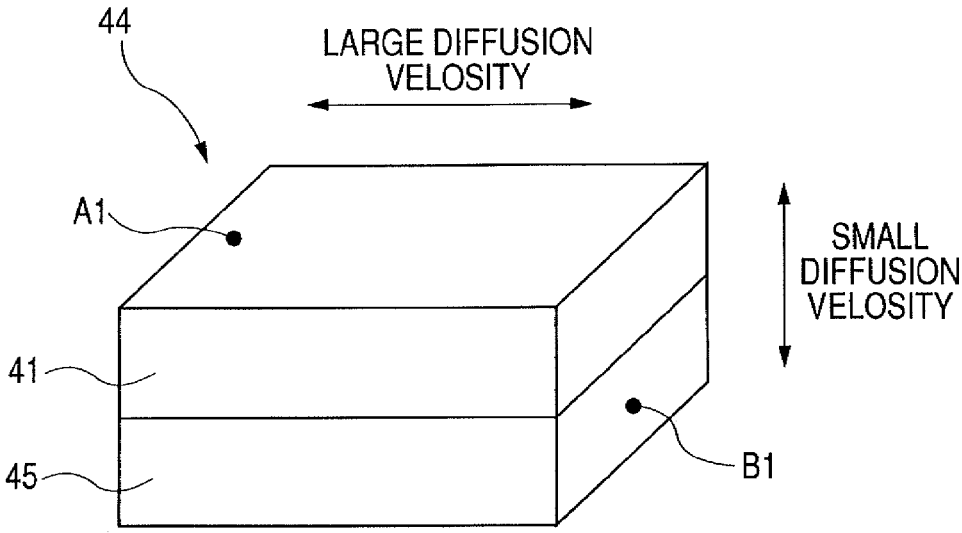
FIG. 30 is a perspective view showing an example of a waste ink absorbent member constituted of plural absorbing members.

A waste ink absorbent member 44 shown in FIG. 30 includes mutually stacked plural waste ink absorbent members 41, 45. Each of the waste ink absorbent members 41, 45 has different diffusion velocities for the liquid, depending on faces thereof. In such waste ink absorbent member 44, an introducing position A1 for a waste ink, which has a relatively higher diffusion velocity to the waste ink absorbent members 41, 45, among the two waste inks to be absorbed, is provided in an end portion of a face of the waste ink absorbent member 41, showing a high diffusion velocity to the waste ink. On the other hand, an introducing position B1 for a waste ink, which has a relatively lower diffusion velocity to the waste ink absorbent members 41, 45, is provided, in a waste ink absorbent member 45 different from the waste ink absorbent member 41 in which the waste ink of a relatively higher diffusion velocity is introduced, in a longitudinal center of a face showing a low diffusion velocity to the waste ink. The phenomenon of waste ink leakage from the waste ink absorbent member 44 is least observable in such structure.

In all the structures above, the introducing positions for the waste inks to the waste ink absorbent member are so positioned as to have a shortest distance therebetween within the aforementioned range.

Now, more specific examples of the foregoing structures will be explained with reference to FIGS. 27A to 27E. On a waste ink absorbent member 9, an introducing position A for a waste ink 22 derived from the color ink, and an introducing position B for a waste ink 23 derived from the black ink are provided on respective end portions in the longitudinal direction thereof.

Figure 27E:
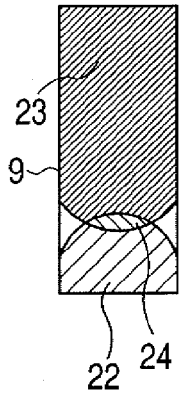

FIGS. 27B to 27E illustrate changes in holding areas of the waste inks 22, 23 along with a progress of the absorption of the waste inks 22, 23. Along a process from FIGS. 27B to 27D, the absorption amounts of the waste inks 22, 23 increase, and FIG. 27E shows a state in which the waste ink 22 derived from the color ink and the waste ink 23 derived from the black ink constitute a mutual penetration portion 24 in a part of the waste ink absorbent member 9 to form a barrier in such mutual penetration portion 24, whereby the absorption and diffusion of the waste inks 22, 23 are almost no longer possible in the waste ink absorbent member 9.

Thus, the waste inks 22, 23 diffuse toward the central part in the longitudinal direction of the waste ink absorbent member 9, and, even when the waste ink 22 derived from the color ink and the waste ink 23 derived from the black ink are not equal in amount, the entire waste ink absorbent member 9 can be satisfactorily utilized as a region for waste ink absorption, without being influenced by the amount of either waste ink.

The waste ink absorbent member 9 in this embodiment has a substantially rectangular parallelopiped shape, but such shape is not restrictive and a cylindrical shape may also be utilized in a similar manner. A waste ink absorbent member 9 of such structure can be accommodated in a relatively oblong space in the ink jet recording apparatus, thereby easily achieving a space saving. More specifically, for example a dead space, such as under a platen, in an ink jet recording apparatus may be utilized for installing the waste ink absorbent member 9 and it becomes unnecessary to spare a particular space for the waste ink recovery.

In the foregoing description, the waste ink absorbent member 9 is assumed to be installed in an ink jet recording apparatus, but the waste ink absorbent member 9 may be accommodated in a waste liquid container such as a tray and then installed in the ink jet recording apparatus. Also such tray may be detachably mounted on the ink jet recording apparatus and may be replaced by detecting the amount of the waste liquid. It is naturally also effective to construct the waste ink absorbent member 9 alone replaceable.

For the waste ink absorbent member 9, any material having an ability of appropriately holding a liquid may be employed without restriction, but a porous member such as sponge, a fibrous member formed by pulp, a polymer absorbent material or a paper-like member covered with a polymer absorbent material may be employed advantageously.

Figure 28C:
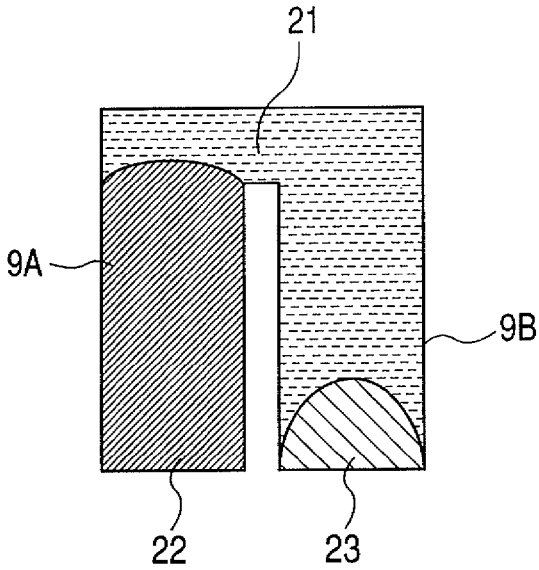
Figure 28B:
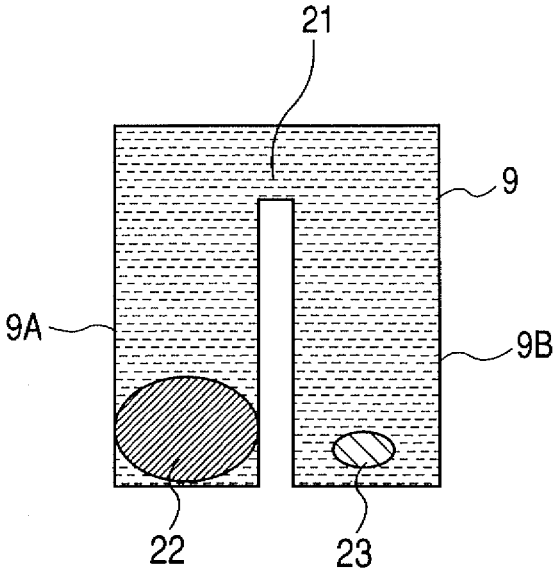

Now, other embodiments of the present invention will be explained with reference to FIGS. 28A to 28D. FIGS. 28A to 28D illustrate the diffusion of the waste inks 22, 23 along the lapse of time. A waste ink absorbent member 9 includes an absorbing portion 9A for the waste ink 22 derived from the color ink, and an absorbing portion 9B for the waste ink 23 derived from the black ink, with a notch at the center in such a manner that the absorbing portions 9A, 9B are connected by a region X (connecting portion 21). As shown in FIG. 28A, the waste ink 22 derived from the color ink and the waste ink 23 derived from the black ink, generated in a recovery operation, are dropped respectively in positions A, B respectively in the absorbing portion 9A for the waste ink 22 derived from the color ink, and the absorbing portion 9B for the waste ink 23 derived from the black ink. As the number of recovery operation increases, the waste inks 22, 23 absorbed in the waste ink absorbent member 9 increase in cumulative amounts and diffuse and penetrate therein as shown in FIGS. 28B and 28C. Thus, each of the dropped waste inks 22, 23 expands the region held in the waste ink absorbent member 9, according to the cumulative dropped amount. This embodiment illustrates a case where the recovery amount of the waste ink 22 is larger than that of the waste ink 23, so that the waste ink 22 passes through the connecting portion 21 and proceeds to the absorbing portion 9B for the waste ink 23 (see FIG. 28D). Thereafter, the recovery of the waste inks 22, 23 reaches an end state when the waste ink 22 derived from the color ink and the waste ink 23 derived from the black ink meet each other.

In the structure of the waste ink absorbent member 9 shown in FIGS. 28A to 28D, a notch is formed in a single waste ink absorbent member 9 to separate the recovery regions for the waste ink 22 derived from the color ink and the waste ink 23 derived from the black ink, but a structure in which two waste ink absorbent members are connected for example at the connecting portion 21 may also be employed. Also instead of the notch, a wall-like barrier may be provided. Also the waste ink absorbent member 9 may be installed directly in the ink jet recording apparatus, or may naturally be accommodated in a waste liquid container such as a tray and then installed in the ink jet recording apparatus.

Further, the connecting portion 21 is preferably present within a range twice of either larger one of a width of the absorbing portion 9A for the waste ink 22 derived from the color ink, and a width of the absorbing portion 9B for the waste ink 23 derived from the black ink.

For the waste ink absorbent member 9, any material having an ability of appropriately holding a liquid may be employed without restriction, but a porous member such as sponge, a fibrous member formed by pulp, a polymer absorbent material or a paper-like member covered with a polymer absorbent material may be employed advantageously. In case of a fibrous member, it may have a structure in which the fibers are linearly aligned from the dropping point of the waste inks 22, 23 toward the connecting portion 21, or may have a felt-like texture. Fibers having such directionality allow to satisfactorily guide the waste inks 22, 23.

Figure 28D:
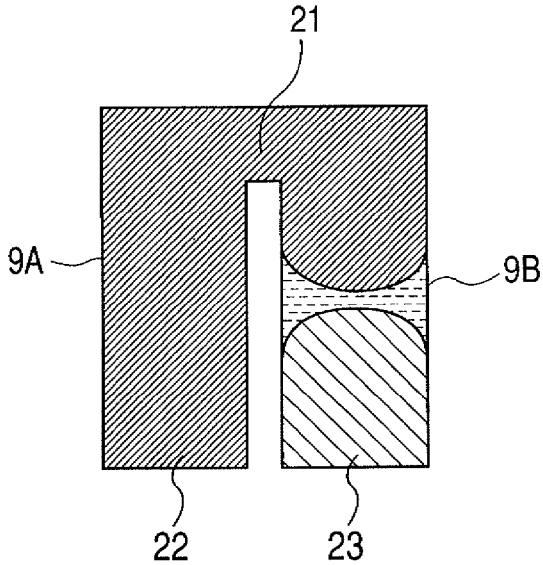

In either structure shown in FIGS. 27A and 28A, even when the amounts of the waste inks 22, 23 are unbalanced with respect to the capacity of the waste ink absorbent member 9, the waste inks 22, 23 held in the waste ink absorbent member 9 respectively expand the respective regions whereby, as shown in FIG. 28D, a substantially entire area of the waste ink absorbent member 9 is filled with the waste inks 22, 23 when they contact each other.

In the following, examples of inks and colorants preferred in the present invention will be explained.

A target to be solved by the present invention is, as described above, a hitherto unknown phenomenon of a colorant sedimentation in a barrier state on the surface of the waste ink absorbent member (including a barrier formed by a penetration from a lower surface). Causes or factors inducing such phenomenon are analyzed to include characteristics of the colorant singly, a relation of the colorant and the solvent, and a novel phenomenon in a bonding state, as will be explained in the following. However the present invention is not limited to the following description but is naturally applicable to any ink colorant or any ink that brings about the newly found phenomenon.

Certain inks provide an advantage of improving the bleeding resistance among the imaging characteristics, but, in a simple mixing, result in a barrier formation (colorant sedimentation), on a surface of a waste ink absorbent member by an upward penetration from a lower surface. Such phenomenon occurs when the first ink is a black ink, when the second ink is a color ink (cf. following examples), or a combination thereof. Such first ink utilizes, as a colorant, a self-dispersing pigment (such as carbon black) including a hydrophilic group which is bonded either directly or across another atomic group, and, plural water-soluble organic solvents of which at least one is a poor water-soluble organic solvent having a property of reducing the dispersion stability of the pigment. When such first ink is deposited on a recording medium, along with the evaporation of water, a ratio of the poor solvent to the pigment becomes higher and the pigments start to coagulate in an upper layer part of the recording medium.

Therefore, such ink, even singly, has a bleeding-suppressing effect even when another ink is present in the vicinity. Also in case the colorant of such ink is constituted of a pigment in which a hydrophilic group bonded to the pigment surface is made present at a high density with respect to the surface of the pigment, both the aforementioned advantage and the barrier formation become more conspicuous. In such case, because of a steric hindrance caused by the structure of the colorant, the solvent in the ink shows less affinity to such pigment in comparison with the prior self-dispersing pigment, whereby the pigment tends to lose the dispersion stability even by a slight water evaporation. As a result, there is obtained an effect of more alleviating the bleeding.

In the present invention, a poor solvent is defined as a solvent showing a property that "when a pigment dispersion, containing a solvent to be evaluated by about 50 wt % and a colorant to be employed in an ink in a dispersed state, is stored at 60° C. for 48 hours, a particle size in such dispersion is larger than the particle size in a pigment dispersion, free or almost free from the solvent to be evaluated and containing the colorant to be employed in the ink". Also a good solvent means a solvent of characteristics other than those of a poor solvent.

Now, there will be explained a color ink effective as the second ink or for the specific examples above. A preferred color ink contain a solvent, constituting a poor solvent for the black ink, and the aforementioned effect becomes more enhanced in case the poor solvent is contained in such an amount sufficient for causing the black ink to form the barrier when the color ink and the black ink are contacted. Such color ink naturally improves the bleeding resistance. Also such color ink, when contacted with a black ink (which may utilize an ordinary colorant), causes the black ink to securely form a barrier hindering the diffusion or movement of the black ink and the color ink into the waste ink absorbent member.

Also such barrier formation becomes more conspicuous in the case that the first ink is a black ink (which may utilize an ordinary colorant) and the second ink is a color ink and that the color ink is an ink containing at least a colorant which has a structure including a benzene ring in a terminal portion (the structure may be partly hydrophilic if a major part is hydrophobic). A colorant of a structure having a benzene ring in a terminal part generally has a property of being easily adsorbed on a pigment. This property hinders the dispersion stability of the pigment and, when the color ink and the black ink are contacted, tends to constitute a barrier, hindering the diffusion or movement thereof into the waste ink absorbent member. Therefore the problem for the invention becomes conspicuous, and the effect obtained by solving such problem will also become conspicuous.

Specific examples of the colorant preferably employed in the color ink include the colorant preferred in the first embodiment for accomplishing the first target.

Second Embodiment for Accomplishing the Second Target

In the following there will be explained a second embodiment for accomplishing the second target.

In this embodiment of the present invention, as to the waste liquids derived from the first and second liquids, an ink showing a relatively smaller diffusion velocity, in the comparison of ink diffusion velocity in the waste ink absorbent member, is taken as the waste liquid derived from the first liquid, and an ink showing a relatively larger diffusion velocity is taken as the waste liquid derived from the second liquid.

At first there will be explained a history leading to the present invention. When the introducing positions on the waste ink absorbent member were selected at mutually adjacent positions for waste liquids derived from an ink set showing a superior color developing property and a superior bleeding resistance in comparison with prior ink sets, there were observed reductions in the diffusion velocities of the waste liquids as the waste liquids were absorbed in the waste ink absorbent member. As a result, the waste liquids were no longer absorbed in the waste ink absorbent member and caused an overflow therefrom. Therefore, the present inventors have undertaken a detailed investigation on such ink set and the phenomenon induced on the used ink absorbent member, and it is thus clarified that the contact of the waste liquids on or in the used ink absorbent member induces a prompt viscosity increase thereby significantly hindering the absorption of the waste liquids into the used ink absorbent member. Such phenomenon is considered to be significantly correlated with a fact that, for further improving the bleeding resistance in comparison with the prior ink sets, in the black ink utilizing a pigment as the colorant, the characteristics of the pigment, solvent and additives are so designed as to facilitate a coagulate formation by the pigment on a paper, and with a fact that the color ink to be used in combination is changed in the ink formulation and in the characteristics of the colorant so as to promote the coagulation of pigment when it is contacted with the pigment ink on the paper.

Furthermore, an ink employing a pigment as the colorant shows phenomena that such ink, because of a slow diffusion into the used ink absorbent member, causes a viscosity increase before the diffusion can take place thereby hindering the absorption of a newly discharged waste liquid, and that, in the course of absorption of the waste ink into the used ink absorbent member, the pigment and the solvent are separated and the solvent diffuses more into the used ink absorbent member. It is furthermore identified that an ink, so designed as to facilitate the coagulate formation by the pigment on the paper in order to improve the bleeding resistance, causes a clogging in the used ink absorbent member, whereby the used ink absorbent member can be utilized only in a part thereof, thus leading to an ink overflow. Therefore the present inventors obtains a conclusion that, in order to utilizing the used ink absorbent member more efficiently, a waste liquid derived from the first liquid having a relatively smaller diffusion velocity and a waste liquid derived from the second liquid having a relatively larger diffusion velocity should not contact each other immediately after the introduction into the used ink absorbent member, and that at least the waste liquid derived from the first liquid should be positioned in a relatively upper part of the used ink absorbent member so as to promote a diffusion to a lower part by its weight.

It is furthermore found that the efficiency of the used ink absorbent member can be drastically improved by positioning the waste liquid derived from the second liquid, in a lower position than the waste liquid derived from the first liquid. Reasons for this phenomenon is estimated as follows. The waste liquid of a larger diffusion velocity, when positioned in a lower position, spreads in a lateral direction in a wide area in a lower part of the used ink absorbent member, and then spreads upwards. On the other hand, the waste liquid derived from the first liquid shows an increased downward diffusion by the weight thereof, but the diffusion of the colorant in the used ink absorbent member rapidly decreases at a certain depth from the upper part of the used ink absorbent member, because the colorant becomes unstable by a water evaporation. When the evaporation of water is further promoted, the dispersion of the colorant becomes unstable, thereby terminating the diffusion of the colorant. However, a liquid, separated by a solid-liquid separation, diffuses further downwards. Such separated liquid further shows a fast diffusion toward the lower part of the used ink absorbent member, by an influence of the waste liquid, derived from the second liquid and having diffused upwards from the lower part of the used ink absorbent member. As a result, the waste liquid, derived from the first liquid and discharged to the used ink absorbent member at a portion where the colorant has lost the dispersion stability within the used ink absorbent member, is facilitated to further diffuse to the lower part of the used ink absorbent member beyond the limit area of the solid-liquid separation mentioned above.

The foregoing has lead to the present invention of defining the introducing positions for the waste liquids, according to the diffusion velocities thereof in the used ink absorbent member, namely defining a higher position for the waste liquid derived from the first liquid having a relatively smaller diffusion velocity and a lower position for the waste liquid derived from the second liquid having a relatively larger diffusion velocity, thereby forming a difference in the vertical direction between the introducing positions of both waste liquids.

In the following, specific embodiments of the present invention will be explained.

Figure 31A:
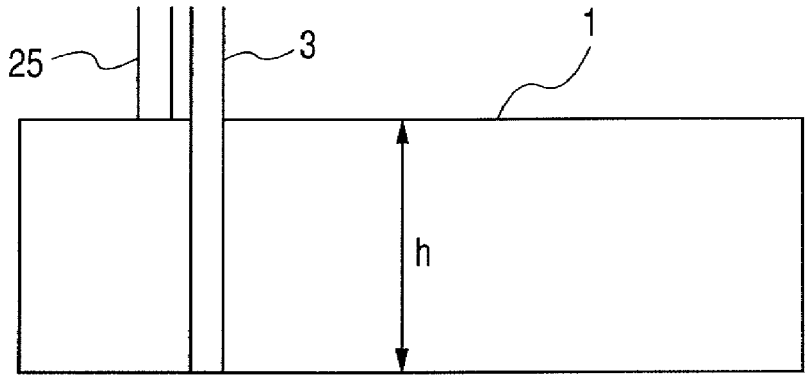
FIGS. 31A, 31B and 31C are cross-sectional views, showing that first and second waste ink introducing portions are provided on a same face of a waste ink absorbent member.
Figure 31B:
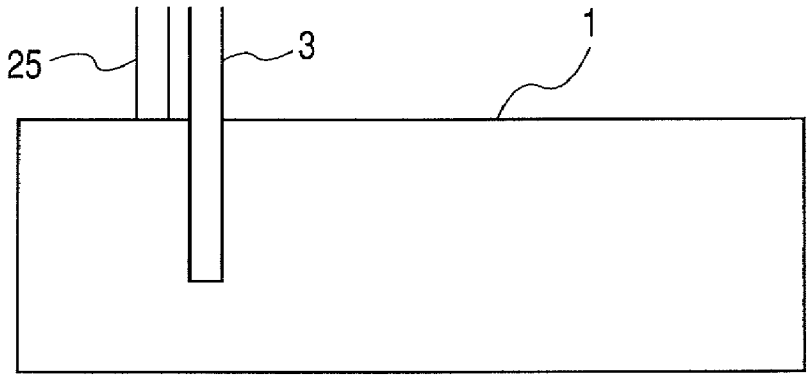

Representative embodiments of the invention are illustrated in FIGS. 31A to 33C, wherein a numeral 1 indicates a waste ink absorbent member, a numeral 25 indicates an introducing part for a waste liquid derived from the first liquid having a relatively smaller diffusion velocity; and a numeral 3 indicates an introducing part for a waste liquid derived from the second liquid having a relatively larger diffusion velocity. FIGS. 31A to 31C show an example in which an introducing part for the waste liquid derived from the first liquid having a relatively smaller diffusion velocity and an introducing part for the waste liquid derived from the second liquid having a relatively larger diffusion velocity are positioned on a same surface of the used ink absorbent member. FIG. 31A shows a structure in which the waste liquid derived from the first liquid having a relatively smaller diffusion velocity is absorbed from an uppermost part of the used ink absorbent member while the waste liquid derived from the second liquid having a relatively larger diffusion velocity is absorbed from a lowermost part; FIG. 31B shows a structure in which the waste liquid derived from the first liquid is absorbed from an uppermost part of the used ink absorbent member while the waste liquid derived from the second liquid is absorbed from an internal part of the used ink absorbent member; and FIG. 31C shows a structure in which the first and second waste liquids are absorbed from internal parts of the used ink absorbent member. In contrast to FIGS. 31A-31C, FIGS. 32A-32C show a structure in which the introducing parts for the first and second waste liquids are provided on mutually opposite faces. The positions of the introducing parts in FIGS. 32A-32C are same as those in FIGS. 31A-31C.

Figure 32A:
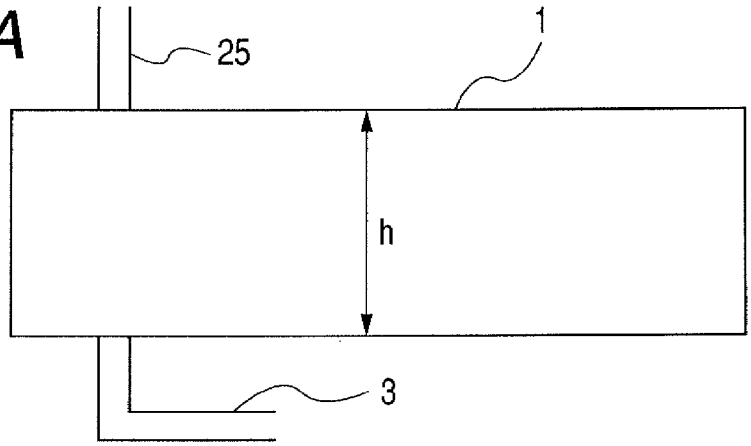
FIGS. 32A, 32B and 32C are cross-sectional views, showing that first and second waste ink introducing portions are provided on opposite faces of a waste ink absorbent member.
Figure 32B:
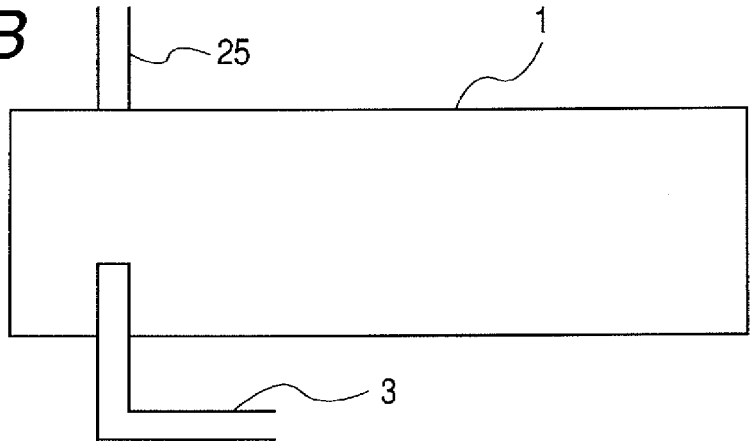
Figure 32C:
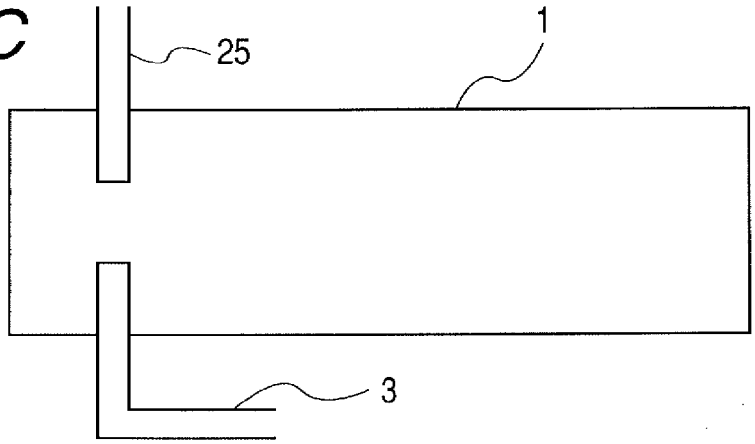
Figure 33A:
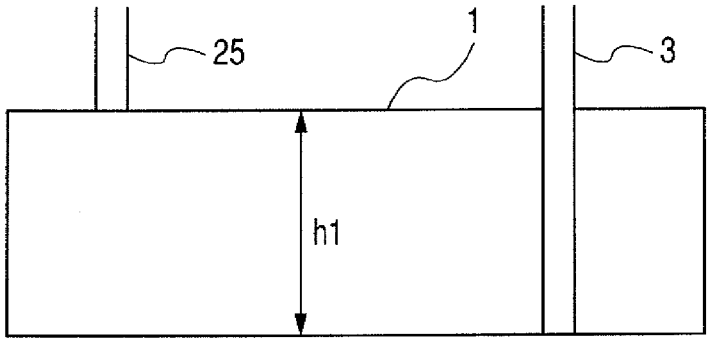
FIGS. 33A, 33B and 33C are cross-sectional views, showing that first and second waste ink introducing portions are provided separately at left and right sides of a waste ink absorbent member.
Figure 33B:
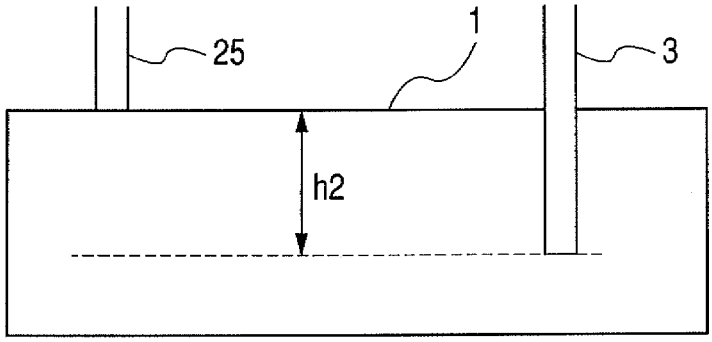
Figure 33C:
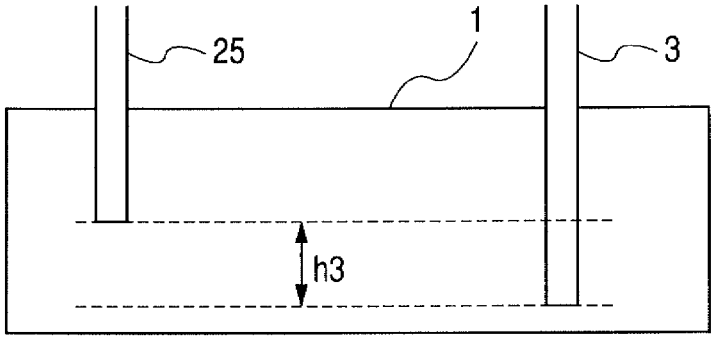
Figure 34:
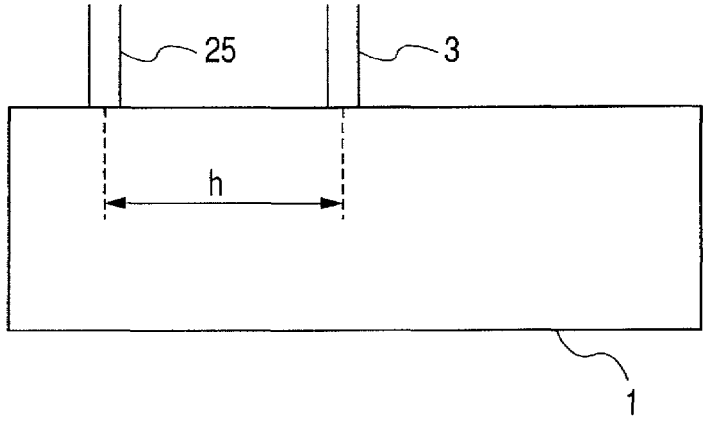
FIG. 34 is a cross-sectional view, showing that first and second waste ink introducing portions are both provided in an upper part of a waste ink absorbent member.

Then, for the purpose of confirming the diffusion effect for the waste liquids in the present invention, the present inventors have prepared a structure of utilizing, in the structures shown in FIGS. 31A to 33C, an ink having a relatively smaller diffusion velocity in the used ink absorbent member for the introducing part 25 for the waste liquid derived from the first liquid, and an ink having a relatively larger diffusion velocity in the used ink absorbent member for the introducing part 3 for the waste liquid derived from the second liquid, and also prepared a structure in which the introducing parts for the two waste inks into the used ink absorbent member are positioned in a same upper part of the used ink absorbent member as shown in FIG. 34, and have compared these structures with the embodiments of the present invention. FIGS. 31A to 33C and FIG. 34 are cross-sectional views of the used ink absorbent member seen from a lateral direction. As a result, it is confirmed that all the structures shown in FIGS. 31A to 33C and satisfying the requirement of the present invention (the introducing part for the waste liquid derived from the first liquid having the relatively smaller diffusion velocity in the used ink absorbent member being positioned higher than the introducing part for the waste liquid derived from the second liquid having the relatively larger diffusion velocity in the used ink absorbent member) achieves a more efficient diffusion of the waste liquids in the used ink absorbent member, in comparison with the structure shown in FIG. 34. The reason for the improved diffusion efficiency in the structures of the present invention, shown in FIGS. 31A to 33C, in comparison with the structure shown in FIG. 34, is shown below.

In any of these structures, a diffusion toward a lower part of the used ink absorbent member by the gravity and a diffusion in the lateral direction take place simultaneously. However, in a liquid having a high diffusion velocity, the diffusion velocity in the lateral direction of the used ink absorbent member is larger than the diffusion velocity toward the lower part. Therefore, it is identified that the waste liquid derived from the first liquid and the waste liquid derived from the second liquid are more easily mixed in a structure in which the introducing positions for the waste liquid derived from the first liquid and the waste liquid derived from the second liquid are on a same plane as shown in FIG. 34, in comparison with the structures shown in FIGS. 31A to 33C. Therefore, in the case of utilizing a recent ink set designed for improving the bleeding resistance, it is made possible to efficiently diffuse the waste liquids in the waste ink absorbent member, by positioning the liquid having a relatively larger diffusion velocity in an upper position and the liquid having a relatively smaller diffusion velocity in a lower position, as the introducing parts for the waste liquids derived from the respective liquids.

Figure 31C:
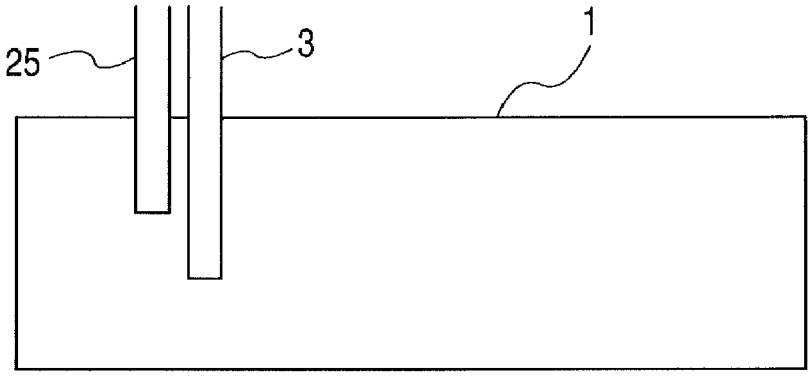

More preferably, the vertical difference between the introducing positions for the first and second waste liquids into the waste ink absorbent member is made larger, and it is further found preferable, as shown in FIGS. 31C and 32C, that the introducing position for the waste liquid, having the relatively smaller diffusion velocity, is provided in the interior of the waste ink absorbent member. In comparison with the case of introducing the waste liquid from an upper part of the waste ink absorbent member, a distal end of the introducing part for the waste liquid, provided in the interior of the absorbent member, increases a contact area of the waste liquid with the waste ink absorbent member whereby the waste liquid is supposed to be absorbed efficiently.

Figure 35A:
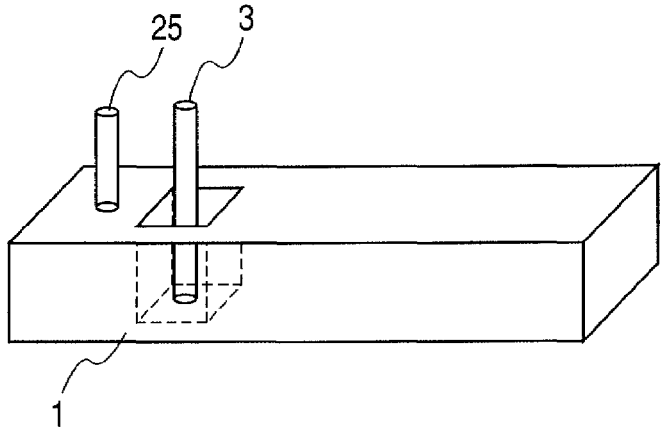
FIGS. 35A and 35B are perspective views showing a structure shown in FIG. 31B, respectively having an open part and without an open part.
Figure 35B:
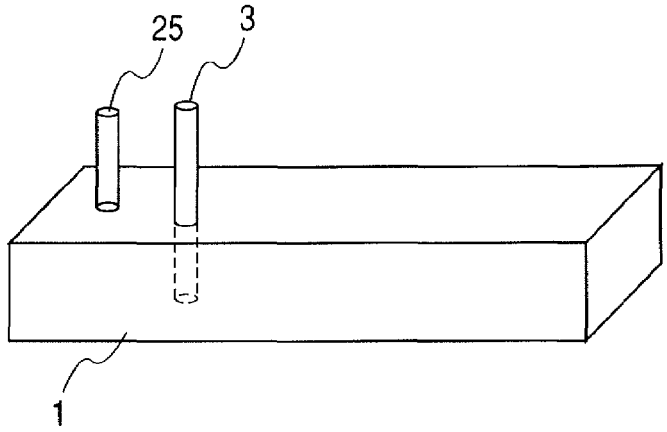

FIG. 35A shows an embodiment in which the waste ink absorbent member is provided, in a part for introducing the waste liquid, with an aperture portion in which the ink is dropped, and FIG. 35B shows an embodiment in which a waste liquid introducing part is directly provided in the waste ink absorbent member. In a comparison of the two, the structure shown in FIG. 35A is preferred to that in FIG. 35B, because the waste liquid has a wider contact area with the waste ink absorbent member because of the above-mentioned reason. It is further preferable to provide the waste ink absorbent member with aperture portions for introducing the waste liquids derived from the first and second liquids.

Also an investigation has been made, in the embodiments shown in FIGS. 31A-31C and FIGS. 32A-32C, on a distance between the first and second waste liquid introducing parts. As a result, in either of the structures shown in FIGS. 31A-31C and FIGS. 32A-32C, a sufficient filling of the waste ink absorbent member without an ink overflow is attained by separating the first and second waste liquid introducing parts by a predetermined distance. The "predetermined distance" means such a distance that, when the waste liquid derived from the first liquid and the waste liquid derived from the second liquid are introduced into the waste ink absorbent member, the solvent contained in the waste liquid derived from the first liquid can singly diffuse or displace in the waste ink absorbent member and that thus displaced waste liquid and the waste liquid derived from the second liquid can mutually contact. More specifically, in the case of employing a waste ink absorbent member principally constituted of pulp fibers commonly employed in the waste ink absorbent member, a distance between the introducing position of the waste liquid derived from the first liquid and the introducing position of the waste liquid derived from the second liquid is from 5 to 20 cm.

Still other embodiments are shown in FIGS. 33A to 33C, and are featured in that the introducing positions in the waste ink absorbent member for the waste liquids derived from the first and second liquids are separated by a certain distance or larger in the lateral direction, and are given a height difference h1, h2 or h3 in the vertical direction.

The waste ink absorbent member may be formed by an integral member or formed substantially integrally by plural members. Substantially integral means that a liquid can move between the waste ink absorbent members by a capillary action. A more preferable embodiment may be realized by utilizing members which are substantially integral and which are formed by different materials according to the diffusion velocities of the first and second waste liquids in the waste ink absorbent member. More specifically, an absorbent member having a larger liquid diffusion velocity (absorbent member having a relatively larger capillary force) is used for the waste liquid derived from the first liquid having a relatively smaller diffusion velocity, and an absorbent member having a smaller liquid diffusion velocity (absorbent member having a relatively smaller capillary force) is used for the waste liquid derived from the second liquid having a relatively larger diffusion velocity. In the case of utilizing a waste ink absorbent member formed by different members, an interface of the waste ink absorbent members governs the diffusion. Therefore, the waste liquid, after sufficiently diffusing in a waste ink absorbent member present in the waste liquid introducing part, causes a diffusion at the interface of the absorbent members and diffuses into the absorbent member of different material. Thus, the waste liquid derived from the second liquid at first spreads in the entire lower layer of the waste ink absorbent member, and then diffuses into the upper layer part. As a result, the diffusion of the waste liquid derived from the second liquid functions effectively on the diffusion of the waste liquid derived from the first liquid, whereby the waste liquid derived from the first liquid also spreads over the entire waste ink absorbent member. Also by employing an absorbent member having a relatively larger diffusion velocity for the waste liquid derived from the first liquid, the diffusion of the waste liquid is less hindered for an ink easily causing a clogging, such as a pigment-based ink.

Figure 36A:
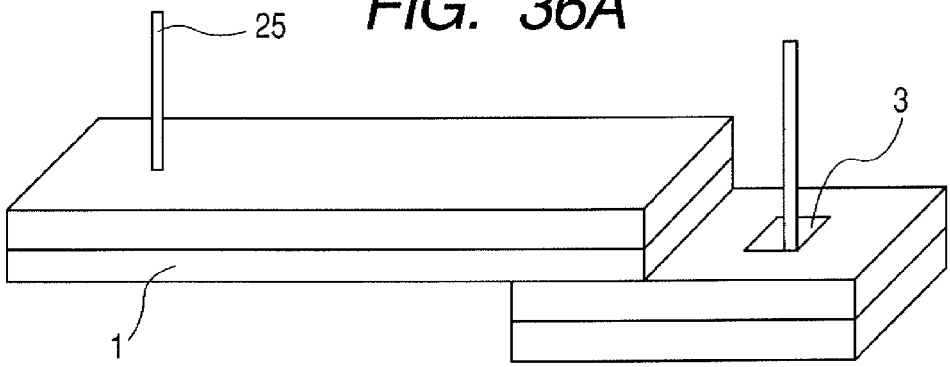
FIGS. 36A and 36B are views showing a shape and a waste ink introducing portion in a multi-layered waste ink absorbent member.
Figure 36B:
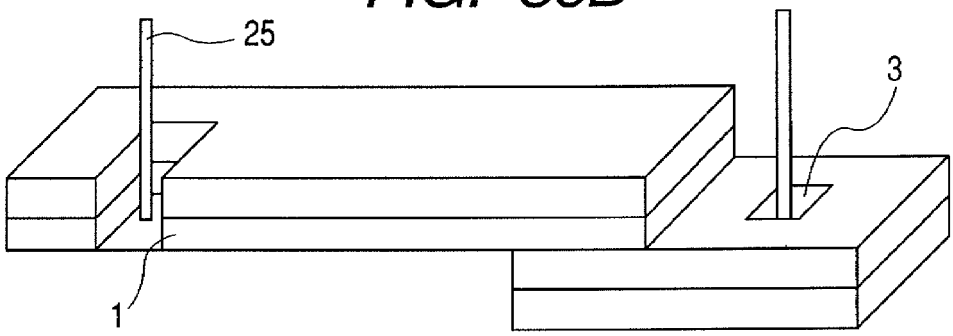

Still another embodiment includes a waste ink absorbent member of a multi-step structure, as shown in FIGS. 36A, 36B and 12. For example in the case of providing an ink jet recording apparatus, capable of automatic two-side printing, with a waste ink absorbent member by efficiently utilizing a space available in the recording apparatus, such waste ink absorbent member may have to assume a multi-stepped structure and may thus result in a deteriorated diffusing property of the waste liquid into the waste liquid, but the structure of the present invention allows to efficiently utilize the waste liquid without deteriorating the diffusion property into the waste ink absorbent member.

In the following, specific examples of the first liquid and the second liquid will be explained. The first and second liquids in the present invention are not particularly restricted as long as they have different diffusion velocities in the waste ink absorbent member, but examples of the first liquid capable of more evidently exhibiting the effects of the present invention include a liquid showing an increase in the viscosity or the particle size by a water evaporation, more specifically an ink showing a change in the particle size by 25% or more between before and after an evaporation of water by 40% from the liquid. Also examples of the second liquid includes a liquid utilizing a dye as a colorant, an ink utilizing a pigment as a colorant in which a solvent utilized in the ink can maintain a stable state to the pigment, and an ink which reduces, upon contacting the first liquid, the dispersion stability of the pigment contained in the first liquid. The particle size can be easily confirmed by a particle size measurement without dilution, utilizing a concentrated system particle size analyzer FPAR-1000 (trade name; manufactured by Otsuka Denshi Co.).

Also the waste ink absorbent member is principally formed by a non-woven cloth constituted of pulps and such non-woven cloth coated or impregnated with a water-absorbing polymer gel, but any material having an ability of appropriately holding a liquid may be employed without restriction, and a porous member such as sponge, a fibrous member formed by pulp, a polymer absorbent material or a paper-like member covered with a polymer absorbent material may be employed advantageously. In case of a fibrous member, it may have a structure in which the fibers are linearly aligned in a desired direction from the dropping point of the waste inks, or may have a felt-like texture. Fibers having such directionality allow to satisfactorily guide the waste liquid.

Figure 37:
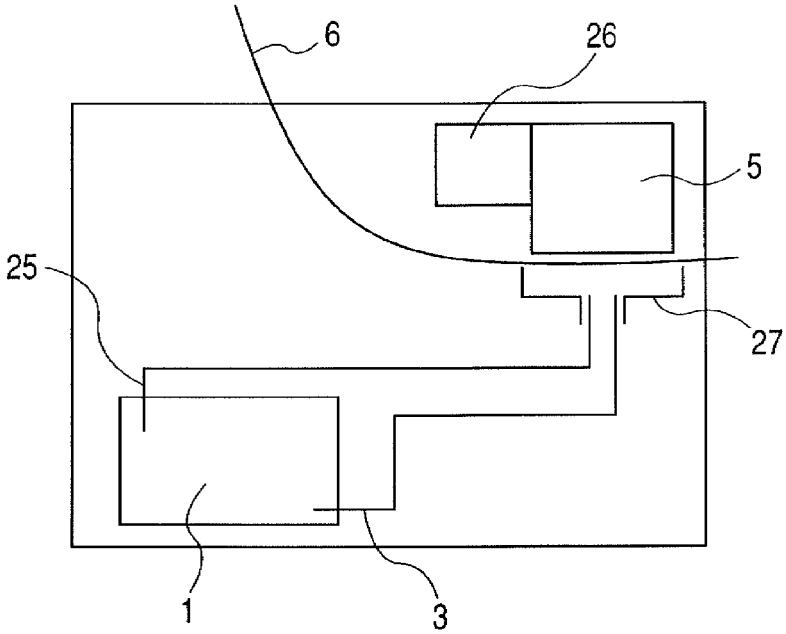
FIG. 37 is a schematic view of an ink jet recording apparatus utilizing a waste ink absorbent member of the present invention.

In the following, there will be explained an example of the ink jet recording apparatus equipped with the waste ink absorbent member. FIG. 37 is a schematic lateral view of an ink jet recording apparatus of the present invention. Referring to FIG. 37, the recording apparatus is equipped with an ink jet recording head 5, for discharging an ink droplet by a vibrational energy or a thermal energy. The recording head 5 includes an integral or detachable ink tank 26 for supplying the recording head with an ink. The ink tank 26 may also be provided separately from the recording head 5, and connected for example through a tube.

In the present example, ink discharge ports of the recording head 5 are directed downwards and opposed to a surface of a conveyed recording sheet 6. The recording head 5 executes a printing by an ink discharge, while horizontal moving in a direction which crosses the conveying direction of the recording sheet 6. Such structure is so-called serial scan type, but the recording head 5 may also be so-called line type, which executes a collective printing over the width of the recording sheet.

A recovery apparatus 27 is provided in a position, lower than the recording sheet 6, so as to be opposed to the ink discharge ports of the recording head 5, in order to cap the ink discharge ports of the recording head 5 and to forcedly suck out the ink from the discharge ports, thereby restoring a proper discharge state. The ink, sucked by the recovery apparatus 27, is discharged, as a waste liquid, to a waste ink absorbent member 1 accommodated in a bottom portion of the recording apparatus. In the accommodating part of the waste ink absorbent member 1, there are provided a first waste liquid introducing part 25 for introducing a waste liquid, derived from a first liquid having a relatively smaller diffusion velocity in the waste ink absorbent member 1, and a second waste liquid introducing part 3 for introducing a waste liquid, derived from a second liquid having a relatively larger diffusion velocity in the waste ink absorbent member 1. An introducing end, to the waste ink absorbent member 1, of the introducing part 25 for the waste liquid derived from the first liquid is positioned higher than an introducing end, to the waste ink absorbent member 1, of the introducing part 25 for the waste liquid derived from the second liquid. The positions of the introducing parts 25, 3 for the first and second liquids may assume various formed as shown in FIGS. 31A-33C, 35A, 35B, 36A and 36B.

(Examples of Ink and Colorant Preferred in the Invention)

Certain inks provide an advantage of improving the bleeding resistance among the imaging characteristics, but, in a simple mixing, result in a barrier formation (colorant sedimentation), on a surface of a waste ink absorbent member by an upward penetration from a lower surface. Such phenomenon occurs when the first ink is a black ink, when the second ink is a color ink (cf. following examples), or a combination thereof. Such first ink utilizes, as a colorant, a self-dispersing pigment (such as carbon black) including a hydrophilic group which is bonded either directly or across another atomic group, and, plural water-soluble organic solvents of which at least one is a poor water-soluble organic solvent having a property of reducing the dispersion stability of the pigment. When such first ink is deposited on a recording medium, along with the evaporation of water, a ratio of the poor solvent to the pigment becomes higher and the pigments start to coagulate in an upper layer part of the recording medium. Therefore, such ink, even singly, has a bleeding-suppressing effect even when another ink is present in the vicinity. Also in case the colorant of such ink is constituted of a pigment in which a hydrophilic group bonded to the pigment surface is made present at a high density with respect to the surface of the pigment, both the aforementioned advantage and the barrier formation become more conspicuous. In such case, because of a steric hindrance caused by the structure of the colorant, the solvent in the ink shows less affinity to such pigment in comparison with the prior self-dispersing pigment, whereby the pigment tends to lose the dispersion stability even by a slight water evaporation. As a result, there is obtained an effect of more alleviating the bleeding. In the present invention, a poor solvent is defined as a solvent showing a property that "when a pigment dispersion, containing a solvent to be evaluated by about 50 wt % and a colorant to be employed in an ink in a dispersed state, is stored at 60° C. for 48 hours, a particle size in such dispersion is larger than the particle size in a pigment dispersion, free or almost free from the solvent to be evaluated and containing the colorant to be employed in the ink". More specific features of the first ink is an ink showing an increase in the viscosity or the particle size by a water evaporation, more specifically an ink showing a change in the particle size by 25% or more between before and after an evaporation of water by 40% from the liquid.

Now, there will be explained a color ink effective as the second ink or for the specific examples above. A preferred color ink contain a solvent, constituting a poor solvent for the black ink, and the aforementioned effect becomes more enhanced in case the poor solvent is contained in such an amount sufficient for causing the black ink to form the barrier when the color ink and the black ink are contacted. Such color ink naturally improves the bleeding resistance. Also such color ink, when contacted with a black ink (which may utilize an ordinary colorant), causes the black ink to securely form a barrier hindering the diffusion or movement of the black ink and the color ink into the waste ink absorbent member.

Also such barrier formation becomes more conspicuous in the case that the first ink is a black ink (which may utilize an ordinary colorant) and the second ink is a color ink and that the color ink is an ink containing at least a colorant which has a structure including a benzene ring in a terminal portion (the structure may be partly hydrophilic if a major part is hydrophobic). A colorant of a structure having a benzene ring in a terminal part generally has a property of being easily adsorbed on a pigment. This property hinders the dispersion stability of the pigment and, when the color ink and the black ink are contacted, tends to constitute a barrier, hindering the diffusion or movement thereof into the waste ink absorbent member. Therefore the problem for the invention becomes conspicuous, and the effect obtained by solving such problem will also become conspicuous.

Specific examples of the colorant preferably employed in the color ink include the colorant preferred in the first embodiment for accomplishing the first target.

EXAMPLES

In the following, the present invention will be further clarified by examples and comparative examples, but the present invention is not limited to such examples unless the scope of the invention is exceeded.

Examples of the First Embodiment of the Invention for Accomplishing the First Target (Used Inks)

(Preparation of Pigment Dispersion for Black Ink)

In a solution of 5 g of concentrated hydrochloric acid in 5.5 g of water, 1.5 g of 4-amino-1,2-benzenedicarboxylic acid were added in a state cooled to 5° C. Then the solution was maintained at 10° C. or lower by agitation in an iced bath, and a solution of 1.8 g of sodium nitrite in 9 g of water cooled to 9° C. was added. After the solution was agitated for further 15 minutes, 6 g of carbon black, having a specific surface area of 220 $m^2/g$ and a DBP absorption amount of 105 mL/100 g were added under agitation. After agitation for further 15 minutes, an obtained slurry was filtered with a filter paper (Standard Filter Paper No. 2, manufactured by Advantech Co.) and the obtained particles were sufficiently washed with water, and dried in an oven of 110° C. to obtain self-dispersing carbon black. The obtained self-dispersing carbon black was dispersed in water so as to obtain a pigment concentration of 10 wt %, thereby obtaining a dispersion. Through the process above, there was obtained a pigment dispersion of self-dispersing carbon black, containing $—C_6H_3(COONa)_2$ groups introduced on the surface of the carbon black particles, dispersed in water.

(Ink Formulation)

A black ink of a following formulation was prepared: 35.0 parts of pigment dispersion above, 7.0 parts of glycerin, 6.0 parts of diethylene glycol, 0.5 parts of diammonium phthalate, 0.2 parts of Acetylenol E100* (manufactured by Kawasaki Fine Chemical Co.), and 45.3 parts of water.

*1: ethylene oxide addition product of acetylene glycol (manufactured by Kawasaki Fine Chemical Co.)

(Ink Jet Recording Apparatus)

An ink jet recording apparatus PIXUS550i (trade name, manufactured by Canon Inc.) was modified so as to accommodate a rectangular waste ink absorbent member as shown in FIG. 3, also by providing tubes for introducing the waste liquids into the waste ink absorbent member and forming a hole portion under the discharge port of the black ink. An evaluation was executed by loading the main body of the printer with the black ink only.

The waste ink absorbent member employed was a fibrous member formed by pulp.

Example 1

Figure 38A:
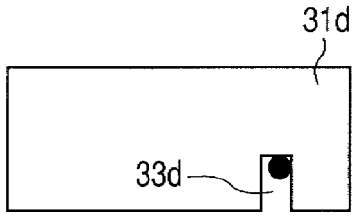
FIGS. 38A, 38B, 38C and 38D are plan views showing types of the waste ink absorbent member employed in examples.

A black ink 1, and a waste ink absorbent member of a shape as shown in FIG. 38A were used. A printing operation was executed with the black ink 1, and a waste ink derived from the ink was dropped in a hole portion shown in FIG. 38A.

At a recovery operation, a cross section of the hole portion provided in the waste ink absorbent member was observed. It was found that a part of the waste ink was in contact with the waste ink absorbent member.

Example 2

Figure 38B:
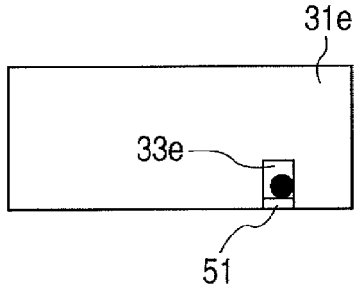

A waste ink absorbent member of a shape as shown in FIG. 38B was used. A printing operation was executed with the black ink 1, and a waste ink derived from the ink was dropped in a hole portion shown in FIG. 38B.

At a recovery operation, a cross section of the hole portion provided in the waste ink absorbent member was observed. It was found that the waste ink was in contact with the entire surface of the hole portion.

Comparative Example 1

Figure 38C:
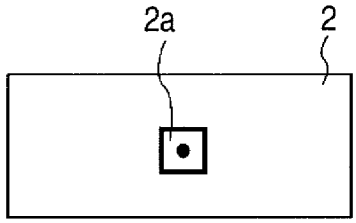

A black ink 1, and a waste ink absorbent member having a hole portion without an open part, as shown in FIG. 38C were used.

At a recovery operation, the hole portion provided in the waste ink absorbent member was observed. It was found that a part of the waste ink was not in contact at all with the waste ink absorbent member.

Comparative Example 2

Figure 38D:
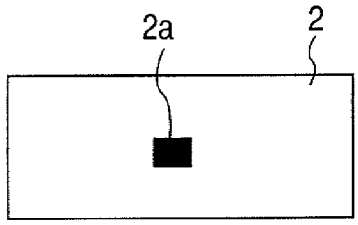

A black ink 1, and a waste ink absorbent member having a hole portion without an open part, as shown in FIG. 38D were used.

At a recovery operation, a cross section of the hole portion provided in the waste ink absorbent member was observed. It was found that a part of the waste ink was in contact with the entire surface of the hole portion.

(Result of Evaluation)

(Evaluation of Waste Ink Absorbing Property)

A print pattern of alphabetic characters from A to Z over several lines, was printed with the black ink on five Canon PPC sheets, and then a suction operation was conducted to introduce the black ink and the color ink into the waste ink absorbent member. This operation was repeated continuously, under replacement of the ink tank from time to time, until 3,000 sheets were printed. The result was evaluated by following criteria, and is shown in Table 1:

+: The waste ink absorbent member sufficiently absorbed the waste ink, without an overflow.

−: The waste ink absorbent member could not completely absorb the waste ink, and caused an overflow.

TABLE 1

| | Example 1 | Example 2 | Comp. Ex. 1 | Comp. Ex. 2 |
|---|---|---|---|---|
| Evaluation of waste ink absorbing property | + | + | − | − |

The present invention has been explained by certain embodiments thereof, but the present invention may more specifically be realized in the following manner.

Figure 39:
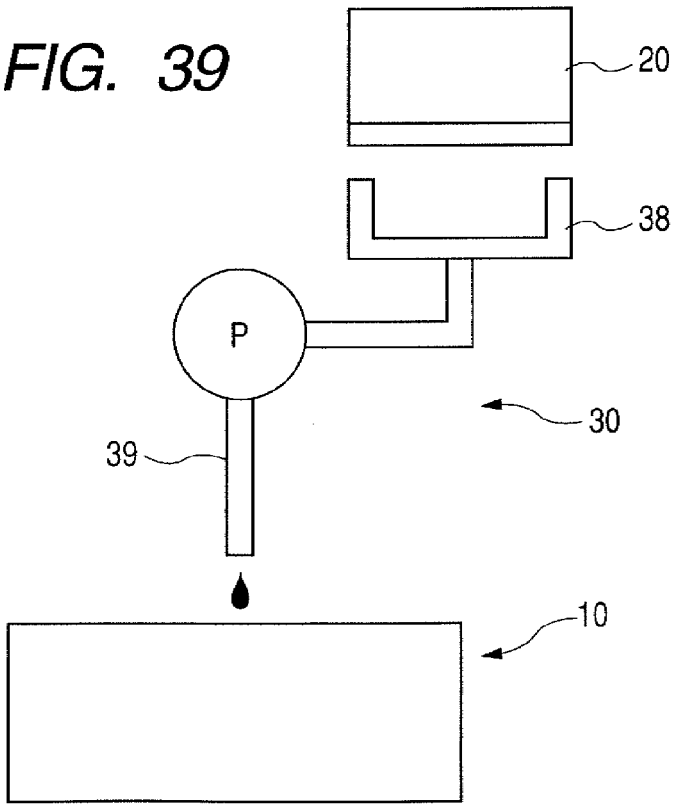
FIG. 39 is a schematic view showing a basic structure of an ink jet recording apparatus constituting an embodiment of the present invention.

An ink jet recording apparatus includes, as shown in FIG. 39, a recording head 20 for executing a recording by discharging inks from discharge ports, a suction recovery mechanism 30 for executing a recovery operation for maintaining a proper discharge operation from the recording head, and a waste ink tank 10 for absorbing and holding a waste ink, generated in the recovery operation. The recording head 20 and the suction recovery mechanism 30 are ordinary ones in the recording apparatus of this type, and the suction recovery mechanism 30 includes a cap 38 for covering a discharge port face of the recording head 20, a pump P serving as a drive source for ink suction, and a discharge pipe 39 for transferring the waste ink from the cap 38 to the waste ink tank 10.

Figure 40A:
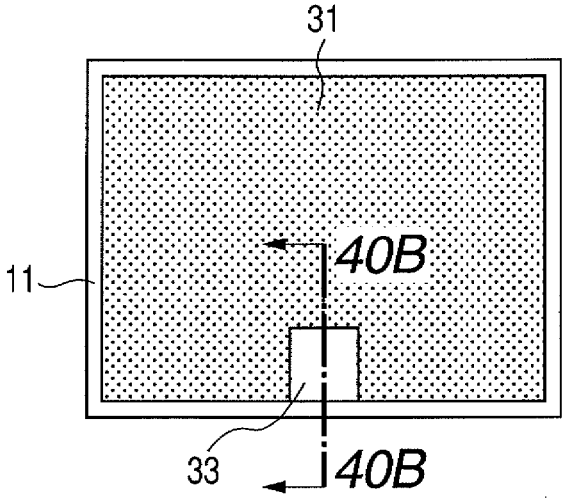
FIGS. 40A and 40B are respectively a plan view and a vertical cross-sectional view along a line 40B-40BA in FIG. 40A, showing a structure of a waste ink tank constituting an embodiment of the present invention.
Figure 40B:
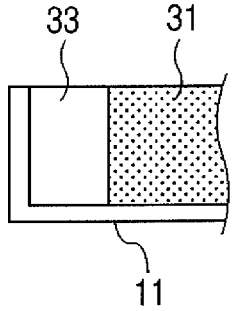

The waste ink tank includes, as shown in FIGS. 40A and 40B, a waste ink absorbent member 31 and a tank main body 11 accommodating the same. In a hole portion 33, a bottom surface of the tank main body 11 is partially exposed, and the waste ink is dropped toward the bottom surface.

The waste ink absorbent member may be formed by any material capable of absorbing and holding the ink by a capillary force, such as a sponge-like porous absorbent member or a fibrous absorbent member. FIG. 40 illustrates a waste ink absorbent member formed by a single member, but such structure is not restrictive and it may be formed by stacked plural absorbent members.

In such structure, since the absorbing property for the waste ink in the hole portion 33 is different between a position facing the absorbent member and a position facing the wall surface of the tank main body 11, the dropped waste ink is not sucked uniformly in all the directions but sucked in a specified direction. Therefore, the waste ink does not easily remain on the bottom of the hole portion. Thus a coagulate formation by the drying of remaining waste ink is also suppressed, and a growth of coagulate does not take place from the formed coagulate as a nucleus. As a result, an efficient waste ink absorption is made possible. Also the ink jet recording apparatus of the present embodiment, equipped with the waste ink tank 10, shows a high reliability without a leak from the tank.

The aforementioned effect of the present invention is brought about by a fact that the internal surface of the hole portion is so constructed as to provide the waste ink with an uneven surface energy. Therefore, the present invention may be modified in various manners as long as such structure is formed.

Figure 41A:
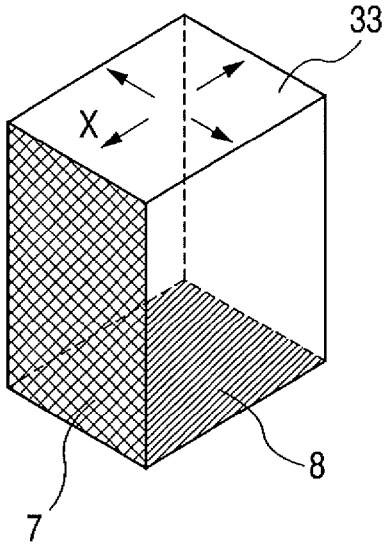
FIGS. 41A and 41B are views showing a hole portion and a non-absorbing area of a waste ink absorbent member.
Figure 41B:
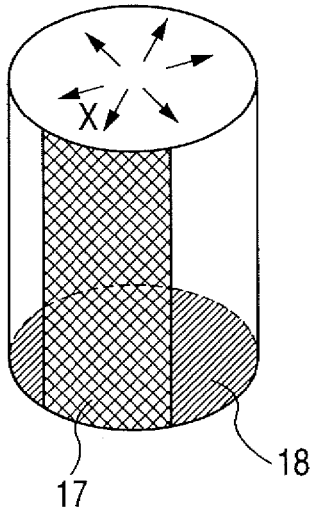

More specifically, the hole portion 33 may have a rectangular parallelopiped shape as shown in FIG. 41A, or a cylindrical shape as shown in FIG. 41B, and may also have a non-absorbing area 7 or 17 in a part of the internal surface. Because of presence of such non-absorbing area, the waste ink is not absorbed in such area and is thus not sucked uniformly in all the directions. The bottom 8 or 18 of the hole portion entirely constitutes a non-absorbing area which does not absorb the waste ink.

In the foregoing, a "hole portion" penetrating through the waste ink absorbent member is explained as an example, but, in the invention, the "hole portion" may be replaced by a "recessed portion" having a certain depth from the surface of the absorbent member. In such case, a bottom part of the recessed portion may be formed as a non-absorbing area, and a non-absorbing area (corresponding to the non-absorbing area 7, 17 in FIGS. 41A and 41B) in a part of the internal surface of the recessed portion.

Examples of the Second Embodiment of the Invention for Accomplishing the First Target (Used Inks)

(Preparation of Inks)

Preparation of Black Ink 1:

The black ink 1, in Examples of the first embodiment for accomplishing the first target, was used. The black ink 1 had a viscosity of 2.3 mPa·s at 25° C.

Preparation of Yellow Ink 1:

C.I. Direct Yellow (4 parts by weight), glycerin (7 parts by weight), polyethylene glycol 400 (4 parts by weight), 2-pyrrolidone (5 parts by weight), Acetylenol E100 (ethylene oxide addition product of acetylene glycol, manufactured by Kawaken Fine Chemical Co.) (1 part by weight) and water (79 parts by weight) were mixed and agitated for 1 hour. The mixture was then filtered under a pressure with a filter FR20 (manufactured by Fuji Photo Film Co.) to obtain a yellow ink 1, which had a viscosity of 2.0 mPa·s at 25° C.

(Ink Jet Recording Apparatus)

Figure 42:
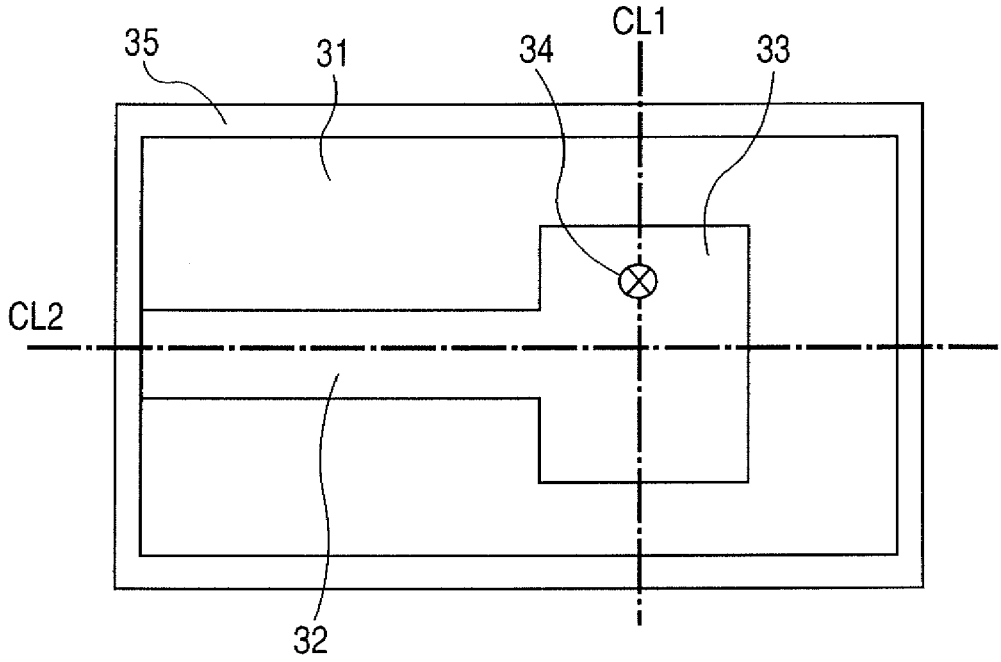
FIG. 42 is a plan view showing an example of a waste ink absorbent member embodying the present invention.

An ink jet recording apparatus PIXUS550i (trade name, manufactured by Canon Inc.) was modified so as to accommodate a rectangular waste ink tank as shown in FIG. 42, also by providing tubes for introducing the waste liquids into the waste ink absorbent member respectively at a black ink side and a color ink side, in such a manner that the positions of the waste liquid introducing parts were arbitrarily adjustable.

An evaluation was executed by loading the main body of the printer with the black ink only.

The waste ink absorbent member employed was a fibrous member formed by pulp, having shapes shown in following examples and comparative examples.

(Viscosity of Mixed Ink)

The black ink 1 and the yellow ink 1 were mixed with a 1:1 ratio and agitated sufficient. The mixed liquid showed a viscosity at 25° C. of 3.0 mPa·s, indicating that the mixing of two inks shows a viscosity increase.

Example 3

A waste ink absorbent member 31 having a hole portion 33 and a slit 32, as shown in FIG. 42, was accommodated in a lower case 35 of the ink jet recording apparatus. The waste ink absorbent member 31 had a thickness of 8 mm. A waste liquid introducing part 34 was positioned on a center line CL1 of the hole portion 33, but displaced from a center line CL2 of the slit 32. A printing operation was executed with the black ink 1, and a resulting waste liquid was dropped from the waste liquid introducing part 34.

After a recovery operation, the internal surface of the hole portion 33 of the waste ink absorbent member 31 was observed. It was found that a part of the waste ink was in contact with the waste ink absorbent member 31.

Example 4

Figure 43:
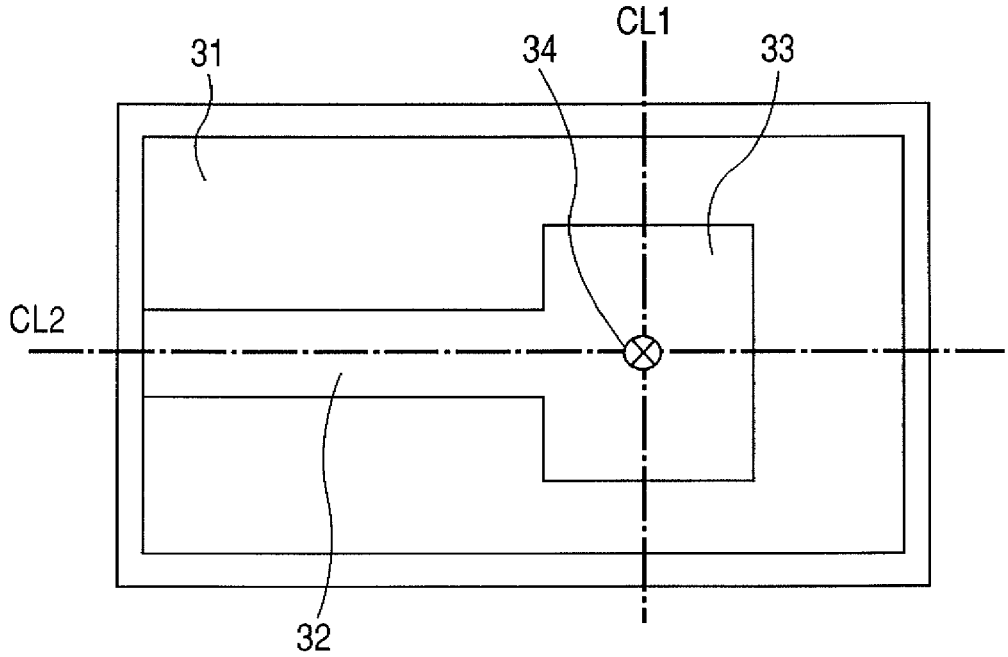
FIG. 43 is a plan view showing another example of the waste ink absorbent member embodying the present invention.

A waste ink absorbent member of a structure shown in FIG. 43 was employed. It was different, from that of Example 3, in the position of the waste liquid introducing part 34, which, in this example, was positioned at a crossing point of the center line CL1 of the hole portion 33 and the center line CL2 of the slit 32. A printing operation was executed with the black ink 1, and a resulting waste liquid was dropped from the waste liquid introducing part 34.

After a recovery operation, the internal surface of the hole portion 33 of the waste ink absorbent member 31 was observed. It was found that a part of the waste ink was in contact with the waste ink absorbent member 31.

Example 5

A waste ink absorbent member of a structure shown in FIG. 20 was employed. The waste ink absorbent member 31 had a thickness of 14 mm in a total of two layers. A printing operation was executed with the black ink 1, and a resulting waste liquid was dropped from the waste liquid introducing part 34.

After a recovery operation, the internal surface of the hole portion 33 of the waste ink absorbent member 31 was observed. It was found that a part of the waste ink was in contact with the waste ink absorbent member 31.

Comparative Example 3

Figure 44:
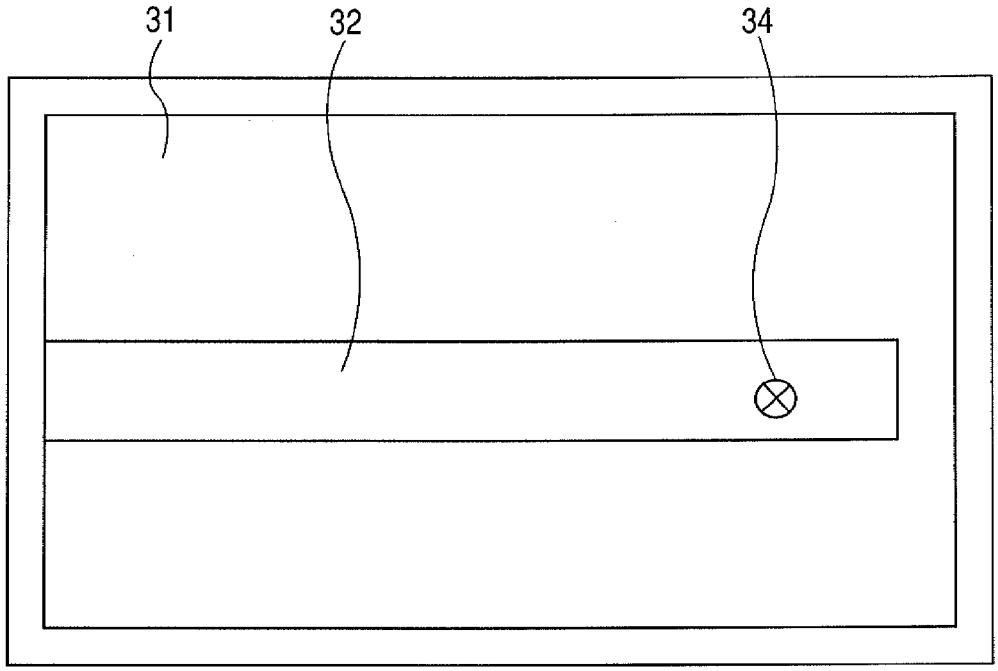
FIG. 44 is a plan view showing an example of a waste ink absorbent member constituting a comparative example to the present invention.

A waste ink absorbent member of a structure shown in FIG. 44 was employed. The waste ink absorbent member 31 had a slit 32 only, in which the waste liquid introducing part 32 was positioned. The waste ink absorbent member 31 had a thickness of 8 mm. A printing operation was executed with the black ink 1, and a resulting waste liquid was dropped from the waste liquid introducing part 34.

After a recovery operation, the internal surface of the slit 32 of the waste ink absorbent member 31 was observed. It was found that a part of the waste ink was in contact with the waste ink absorbent member 31.

Comparative Example 4

Figure 45:
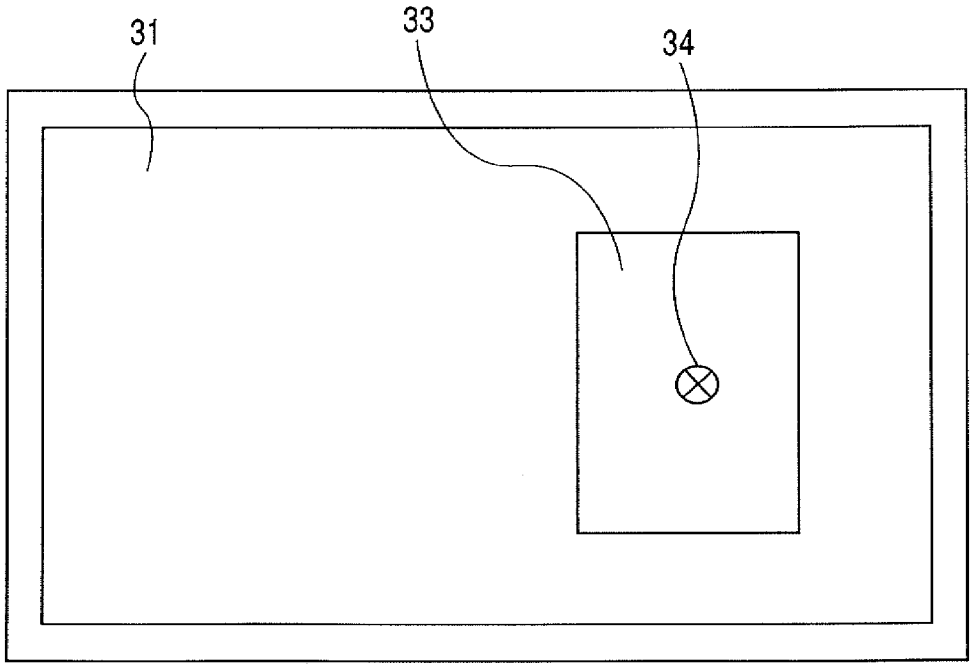
FIG. 45 is a plan view showing another example of the waste ink absorbent member constituting a comparative example to the present invention.

A waste ink absorbent member of a structure shown in FIG. 45 was employed. The waste ink absorbent member 31 had a hole portion 33 only, without an open part. The waste ink absorbent member 31 had a thickness of 8 mm. A printing operation was executed with the black ink 1, and a resulting waste liquid was dropped from the waste liquid introducing part 34.

After a recovery operation, the internal surface of the hole portion 33 of the waste ink absorbent member 31 was observed. It was found that the waste liquid was uniformly in contact, over the entire periphery thereof, with the waste ink absorbent member 31.

Comparative Example 5

A waste ink absorbent member of a structure shown in FIG. 15 was employed. The waste ink absorbent member 31 had a thickness of 8 mm. A printing operation was executed with the black ink 1, and a resulting waste liquid was dropped from the waste liquid introducing part 34.

After a recovery operation, the internal surface of the hole portion 33 of the waste ink absorbent member 31 was observed. It was found that a part of the waste ink was in contact with the waste ink absorbent member 31.

Comparative Example 6

A waste ink absorbent member of a structure shown in FIG. 16 was employed. The waste ink absorbent member 31 had a thickness of 8 mm. A printing operation was executed with the black ink 1, and a resulting waste liquid was dropped from the waste liquid introducing part 34.

After a recovery operation, the internal surface of the hole portion 33 of the waste ink absorbent member 31 was observed. It was found that a part of the waste ink was in contact with the waste ink absorbent member 31.

Comparative Example 7

Figure 46:
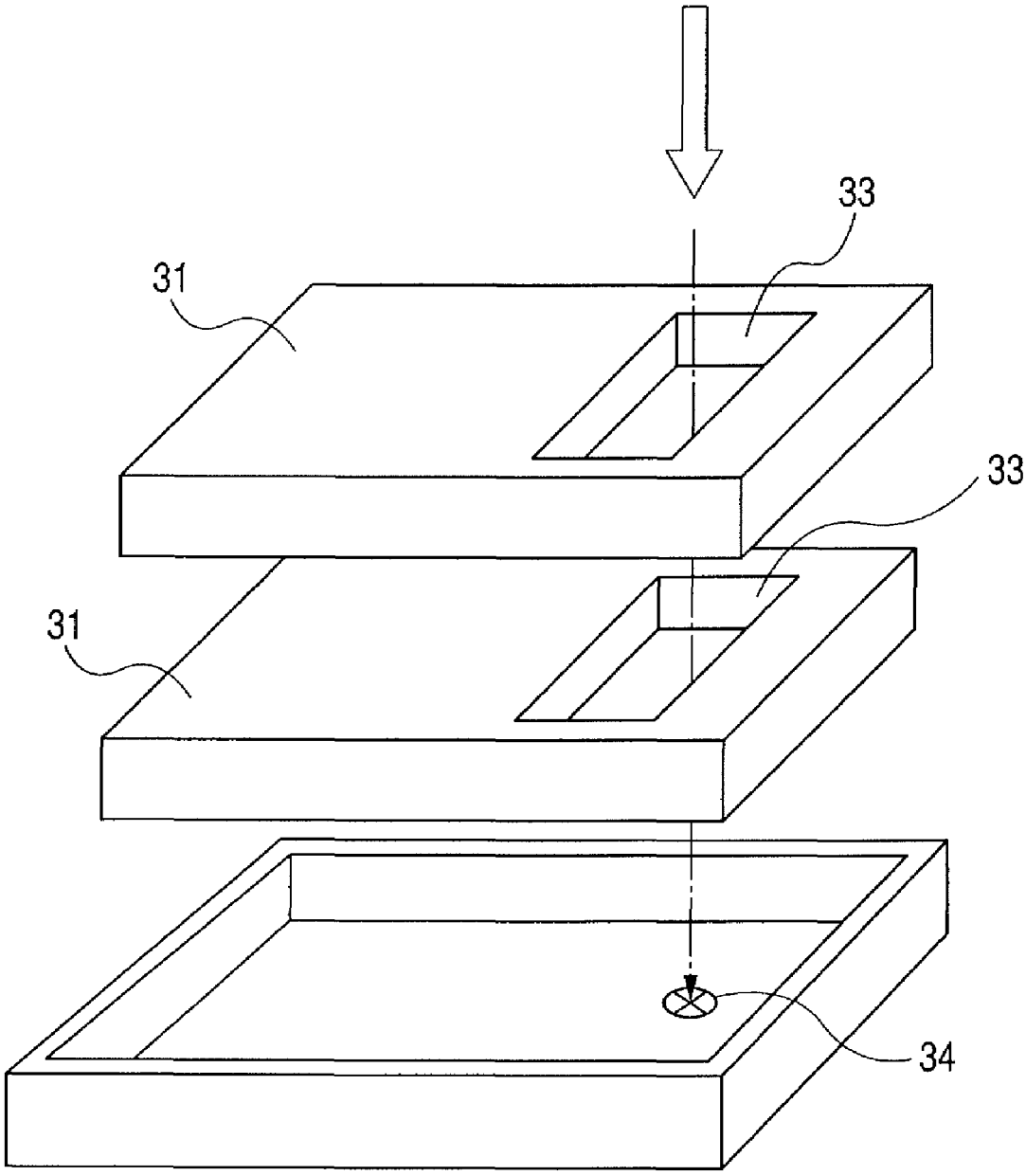
FIG. 46 is a plan view showing still another example of the waste ink absorbent member constituting a comparative example to the present invention.

A waste ink absorbent member of a structure, including waste ink absorbent members 31 stacked in two layers, as shown in FIG. 46 was employed. Each waste ink absorbent member 31 had a hole portion 33 only, without an open part. The waste ink absorbent members 31 had a thickness of 14 mm in a total of two layers. A printing operation was executed with the black ink 1, and a resulting waste liquid was dropped from the waste liquid introducing part 34.

After a recovery operation, the internal surface of the hole portion 33 of the waste ink absorbent member 31 was observed. It was found that the waste liquid was uniformly in contact, over the entire periphery.

Comparative Example 8

A waste ink absorbent member of a structure shown in FIG. 4 was employed. The waste ink absorbent member 2 had a thickness of 8 mm. A printing operation was executed with the black ink 1, and a waste liquid 4 was dropped so as to be in contact with the entire surface of the hole portion 2*a*, as shown in FIGS. 4 and 5A.

After a recovery operation, the internal surface of the hole portion 2*a* of the waste ink absorbent member 2 was observed. It was found that the waste ink was uniformly in contact, over the entire periphery. Also, as the waste liquid 4 was absorbed into the waste ink absorbent member 2, the waste liquid 4 was left in the vicinity of the center of the hole portion 2*a*, as shown in FIG. 5B.

(Evaluation 1 of Waste Liquid Absorbing Property)

With an ink jet recording apparatus equipped with each of the waste ink absorbent members shown in Examples 3-5 and Comparative Examples 3-8, a print pattern of alphabetic characters from A to Z over several lines, was printed with the black ink on five Canon PPC sheets, and then a suction operation was conducted to introduce the black ink a predetermined amount into the waste ink absorbent member. The apparatus was let to stand in an environment of a temperature of 30° C. and a humidity of 10%, after printing of every 100 sheets. Eventually, 4,000 sheets were printed intermittently with replacement of the ink tank from time to time, and a state of the waste ink absorbent member was evaluated according to following criteria:

(Criteria of Evaluation)

++: The waste liquid was spread over the entire waste liquid. A coagulated substance was not at all or scarcely observable in the hole portion and the slit;

+: The waste liquid was spread over the entire waste liquid. A coagulated substance was slightly observable in the hole portion or the slit, but no ink overflow at all;

±: The absorbing property was satisfactory in the printing up to about 3,000 sheets, but an ink overflow appeared eventually. Much coated substance was observable in the hole portion or the slit;

−: The absorbing property was lowered in the printing already at about 500 sheets, and an ink overflow appeared eventually. Much coated substance was observable in the hole portion or the slit.

Results of evaluation are shown in Table 2.

TABLE 2

| | Example 3 | Example 4 | Comp. Ex. 3 | Comp. Ex. 4 | Comp. Ex. 5 | Comp. Ex. 6 | Comp. Ex. 8 |
|---|---|---|---|---|---|---|---|
| Evaluation of waste ink absorbing property | + | ++ | ± | ± | ± | ± | − |

(Evaluation 2 of Waste Liquid Absorbing Property)

With an ink jet recording apparatus equipped with each of the waste ink absorbent members of Example 5 and Comparative Example 7, a print pattern of alphabetic characters from A to Z over several lines, was printed with the black ink on five Canon PPC sheets, and then a suction operation was conducted to introduce the black ink a predetermined amount into the waste ink absorbent member. The apparatus was let to stand in an environment of a temperature of 30° C. and a humidity of 10%, after printing of every 100 sheets. Eventually, 5,000 sheets were printed intermittently with replacement of the ink tank from time to time, and a state of the waste ink absorbent member was evaluated according to following criteria:

(Criteria of Evaluation)

++: The waste liquid was spread over the entire waste liquid. A coagulated substance was not at all or scarcely observable in the hole portion and the slit;

+: The waste liquid was spread over the entire waste liquid. A coagulated substance was slightly observable in the hole portion or the slit, but no ink overflow at all;

±: The absorbing property was satisfactory in the printing up to about 3,000 sheets, but an ink overflow appeared eventually. Much coated substance was observable in the hole portion or the slit;

−: The absorbing property was lowered in the printing already at about 500 sheets, and an ink overflow appeared eventually. Much coated substance was observable in the hole portion or the slit.

Results of evaluation are shown in Table 3.

TABLE 3

| | Example 5 | Comp. Ex. 7 |
|---|---|---|
| Evaluation of waste ink absorbing property | ++ | ± |

(Evaluation of Bleeding Resistance)

A bleeding suppressing property was found to be extremely satisfactory, in an evaluation of utilizing the black ink 1 and the yellow ink 1 and printing a black line on a yellow solid print.

Examples of the First Embodiment of the Invention for Accomplishing the Second Target (Used Inks)

(Preparation of Pigment Dispersion for Black Ink)

A pigment dispersion for the black ink, in the examples of the first embodiment of the invention for accomplishing the first target, was used.

(Preparation of Dyes for Color Inks)

(Cyan Dye)

C.I. Direct Blue 199 was used as the cyan dye.

(Magenta Dye 1)

A following compound α, sodium carbonate and ethyl benzoylacetate were reacted in xylene, and a reaction product was collected by filtration and washed. Then, it was reacted, in N,N-dimethylformamide, by successively charging meta-aminoacetanilide, copper acetate and sodium carbonate, and the reaction product was collected by filtration and washed. It was then sulfonated with fuming sulfuric acid, then collected by filtration, washed, and subjected to a condensation reaction with cyanuric chloride in the presence of sodium hydroxide.

Anthranilic acid was added to the reaction liquid, and a condensation reaction was conducted in the presence of sodium hydroxide. The reaction product was collected by filtration and washed to obtain a magenta dye 1 represented by a following structural formula (6):

structural formula (6)

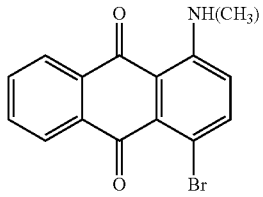

(Magenta Dye 2)

A magenta dye 2 was prepared by following steps (A) to (C):

(A) A monoazo compound was prepared from 2-aminobenzoic acid (anthranilic acid) and 1-amino-8-hydroxy-3, 6-naphthalenedisulfonic acid (H-acid) through a diazotization and a coupling;

(B) The obtained monoazo compound was added to a suspension of cyanulic chloride under a pH of 4-6 and a temperature of 0-5° C. and reacted for several hours. Then an aqueous solution of 2-aminobenzoic acid (anthranylic acid) was added at the room temperature in such a manner that the mixture does not become alkaline, and a condensation reaction was conducted for several hours. Then a 25% aqueous solution of sodium hydroxide was added at 50-60° C. to execute a hydrolysis in a strongly alkaline condition, thereby completing the reaction;

(C) After cooling, the product was salted out with sodium chloride.

In this manner, a magenta dye 2 represented by a following structural formula (7) was obtained:

structural formula (7)

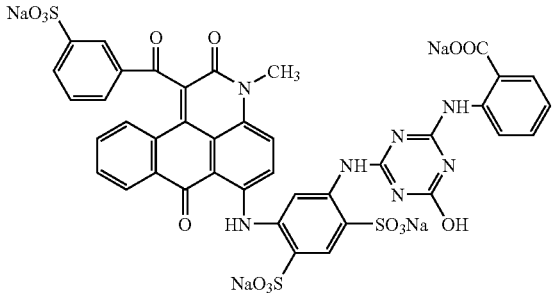

(Yellow Dye)

C.I. Direct Yellow 132 was used as the yellow dye.

(Ink Composition)

Black ink and color inks were prepared with formulations shown in Table 4.

TABLE 4

| | | color ink 1 | | | color ink 2 | | |
|---|---|---|---|---|---|---|---|
| | black ink | cyan ink | magenta ink | yellow ink | cyan ink | magenta ink | yellow ink |
| pigment dispersion | 35.0 | — | — | — | — | — | — |
| cyan dye | — | 5.0 | — | — | 5.0 | — | — |
| magenta dye 1 | — | — | 5.0 | — | — | — | — |
| magenta dye 2 | — | — | — | — | — | 5.0 | — |
| yellow dye | — | — | — | 3.0 | — | — | 3.0 |
| glycerin | 7.0 | 10.0 | 10.0 | 10.0 | 10.0 | 10.0 | 10.0 |
| diethylene glycol | 6.0 | 10.0 | — | 10.0 | 10.0 | 10.0 | 10.0 |
| urea | — | 10.0 | 10.0 | 10.0 | 10.0 | 10.0 | 10.0 |
| diammonium phthalate | 0.5 | — | — | — | — | — | — |
| 2-pyrrodiline | 6.0 | — | 5.0 | — | — | — | — |
| Acetylenol E100* | 0.2 | 1.0 | 1.0 | 1.0 | 1.0 | 1.0 | 1.0 |
| water | 45.3 | 64.0 | 69.0 | 66.0 | 64.0 | 64.0 | 66.0 |
| coagulate formation | — | no | yes | no | no | no | no |
| poor solvent | — | none | present | none | none | none | none |
| reversibility | — | — | reversible | — | — | — | — |

*1) ethylene oxide addition product of acetylene glycol (manufactured by Kawaken Fine Chemical Co.)

In the table, the coagulate formation indicates that, when the black ink and the color ink were mixed with a 1:1 ratio in a glass bottle and the glass bottle was inverted after a standing for 1 hour, coagulated particles are attached to the glass bottle wall. Such coagulated substance is an obstacle in the present invention.

Also the reversibility is defined as follows. The coagulated substance described above is taken out together with the mixed inks and added to the black ink of 10 times in weight, contained in a glass bottle. A reversibility is identified in the case that the coagulated substance does not stick to the glass bottle wall and is no longer observable when the glass bottle is inverted after a standing for 1 hour.

(Judging Method for Good Solvent and Poor Solvent Among Used Water-Soluble Organic Solvents)

A following experiment was conducted for selecting a poor solvent for the pigment dispersion. An aqueous solution of pigment dispersion, with a pigment concentration of 10%, was prepared and used for preparing a poor solvent-judging dispersion, with a following formulation:

(Formulation of Poor Solvent-Judging Dispersion)

aqueous solution of pigment dispersion, with a pigment concentration of 10%:50 parts each water-soluble organic solvent: 50 parts Then 10 g of the poor solvent-judging dispersion were placed in a transparent stoppered glass sample bottle, then sufficiently agitated in a stoppered state, and let to stand in an oven of 60° C. for 48 hours. Thereafter, the dispersion taken out from the oven was used as a measuring sample and subjected to a measurement of the particle size of the pigment dispersion contained in the sample, with a concentrated system particle size analyzer FPAR-1000 (trade name; manufactured by Otsuka Denshi Co.), to obtain an original particle size (particle size measured without dilution) of the poor solvent-judging dispersion after storage at 60° C. for 48 hours. On the other hand, as a reference, there was prepared an aqueous pigment dispersion of a pigment concentration same as that of the poor solvent-judging dispersion, namely a comparative aqueous pigment dispersion containing water, instead of the water-soluble organic solvent, in a same amount. This aqueous dispersion was subjected, without standing under a heated condition, to a measurement of a particle size of the water-insoluble colorant contained therein, in the same manner as above, by the concentrated system particle size analyzer. Then the obtained original particle size of the judging dispersion was compared with the particle size of the reference aqueous dispersion, and a poor solvent was identified in the case where the original particle size of the dispersion after storage at 60° C. for 48 hours showed an increase from the original particle size of the reference aqueous dispersion. Also a good solvent was identified in the case where the original particle size of the dispersion after storage at 60° C. for 48 hours was equal to or smaller than the original particle size of the reference aqueous dispersion.

Among the pigment dispersions above, 2-pyrrolidone alone was identified as a poor solvent.

(Ink Jet Recording Apparatus)

An ink jet recording apparatus PIXUS550i (trade name, manufactured by Canon Inc.) was modified so as to accommodate a rectangular waste ink absorbent member as shown in FIG. 27. Also tubes for introducing the waste liquids into the waste ink absorbent member were provided respectively at a black ink side and a color ink side, in such a manner that the positions of the waste liquid introducing parts (A and B in FIG. 27) were arbitrarily adjustable.

The waste ink absorbent member was formed by a fibrous member constituted of pulp.

Example 6

The black ink 1 and the color inks 1 were used, and a distance between an introducing position for a waste liquid derived from the black ink and an introducing position for a waste liquid derived from the color inks was selected as 5 cm.

Example 7

The black ink 1 and the color inks 1 were used, and a distance between an introducing position for a waste liquid derived from the black ink and an introducing position for a waste liquid derived from the color inks was selected as 10 cm.

Example 8

The black ink 1 and the color inks 1 were used, and a distance between an introducing position for a waste liquid derived from the black ink and an introducing position for a waste liquid derived from the color inks was selected as 20 cm.

Comparative Example 9

The black ink 1 and the color inks 1 were used, and an introducing position for a waste liquid derived from the black ink and an introducing position for a waste liquid derived from the color inks were made mutually adjacent.

Comparative Example 10

The black ink 1 and the color inks 1 were used, and a distance between an introducing position for a waste liquid derived from the black ink and an introducing position for a waste liquid derived from the color inks was selected as 4 cm.

Comparative Example 11

The black ink 1 and the color inks 1 were used, and a distance between an introducing position for a waste liquid derived from the black ink and an introducing position for a waste liquid derived from the color inks was selected as 21 cm.

Reference Example 1

The black ink 1 and the color inks 2 were used, and an introducing position for a waste liquid derived from the black ink and an introducing position for a waste liquid derived from the color inks were made mutually adjacent (The black ink 1 and the color inks 2 do not form a barrier when mutually contacted on the surface of the waste ink absorbent member).

(Result of Evaluation)

(Evaluation of Waste Ink Absorbing Property)

A print pattern of alphabetic characters from A to Z over several lines with the black ink on a 100% duty solid magenta area, was printed on five Canon PPC sheets, and then a suction operation was conducted to introduce the black ink and the color ink into the waste ink absorbent member. This operation was repeated continuously, under replacement of the ink tank from time to time, until 1,000 sheets were printed. The result was evaluated by following criteria:

+: The waste ink absorbent member sufficiently absorbed the waste ink, without an overflow.

−: The waste ink absorbent member could not completely absorb the waste ink, and caused an overflow.

Results of evaluation are shown in Table 5.

TABLE 5

| | Example 6 | Example 7 | Example 8 | Comp. Ex. 9 | Comp. Ex. 10 | Comp. Ex. 11 | Ref. Ex. 1 |
|---|---|---|---|---|---|---|---|
| Evaluation of waste ink | + | + | + | − | − | − | + |

TABLE 5-continued

| | Example 6 | Example 7 | Example 8 | Comp. Ex. 9 | Comp. Ex. 10 | Comp. Ex. 11 | Ref. Ex. 1 |
|---|---|---|---|---|---|---|---|
| absorbing property | | | | | | | |

Results in Table 5 indicate that, in a combination of the black ink 1 and the color inks 1, the waste ink absorbent member can fully exhibit the absorbing ability thereof, when the distance between the introducing positions for the inks to the waste ink absorbent member is within a range of from 5 to 20 cm. Also the ink combination used in Reference Example 1 provided, in the evaluation of the waste ink absorbing ability, a print pattern with an inferior print quality and a noticeable bleeding, in comparison with the print pattern in the ink combination used in Examples 6-8 and Comparative Examples 9-11.

Examples of the Second Embodiment of the Invention for Accomplishing the Second Target (Used Inks)

(Preparation of Pigment Dispersion for Black Ink)

A pigment dispersion for the black ink, in the examples of the first embodiment of the invention for accomplishing the first target, was used.

(Preparation of Dyes for Color Inks)

(Cyan Dye)

C.I. Direct Blue 199 was used as the cyan dye.

(Magenta Dye)

The magenta dye 1, in the examples of the first embodiment of the invention for accomplishing the second target, was used.

(Yellow Dye)

C.I. Direct Yellow 132 was used as the yellow dye.

(Ink Composition)

Black ink and color inks were prepared with formulations shown in Table 6.

TABLE 6

| | | color ink | | |
|---|---|---|---|---|
| | black ink | cyan ink | magenta ink | yellow ink |
| pigment dispersion | 35.0 | — | — | — |
| cyan dye | — | 5.0 | — | — |
| magenta dye | — | — | 5.0 | — |
| yellow dye | — | — | — | 3.0 |
| glycerin | 7.0 | 10.0 | 10.0 | 10.0 |
| diethylene glycol | 6.0 | 10.0 | — | 10.0 |
| urea | — | 10.0 | 10.0 | 10.0 |
| diammonium phthalate | 0.5 | — | — | — |
| 2-pyrrodiline | 6.0 | — | 5.0 | — |
| Acetylenol E100* | 0.2 | 1.0 | 1.0 | 1.0 |
| water | 45.3 | 64.0 | 69.0 | 66.0 |

*1) ethylene oxide addition product of acetylene glycol (manufactured by Kawaken Fine Chemical Co.) (Judging method for relative diffusion velocity in waste ink absorbent member)

A material, same as that used for the waste ink absorbent member of the ink jet recording apparatus, is prepared in a size of a width of 5 mm, a length of 150 mm and a thickness of 5 mm. 10 ml of a liquid to be measured is placed in a 50 cc beaker, and the waste ink absorbent member of the above-mentioned size is immersed therein. The waste ink absorbent member is taken out from the beaker after 5 minutes, and a diffusion velocity is calculated by measuring a displaced distance of each liquid. This method allows to easily judge the relative diffusion velocity into the waste ink absorbent member. When the ink causes a solid-liquid separation, the velocity is judged by a displaced distance including a colorant such as a pigment. Also in the case of utilizing plural inks, they may show stepwise difference in the diffusion velocity in the waste ink absorbent member. In such case, an ink showing a smallest diffusion velocity in the waste ink absorbent member is taken as the first waste liquid, and other inks are taken as the second waste liquid of a relatively larger diffusion velocity.

(Ink Jet Recording Apparatus)

An ink jet recording apparatus PIXUS550i (trade name, manufactured by Canon Inc.) was modified so as to accommodate a rectangular waste ink absorbent member as shown in FIGS. 31A-31C and 33A-33C. Also tubes for introducing the waste liquids into the waste ink absorbent member were provided respectively at a first waste liquid side and a second waste liquid side, in such a manner that the introducing positions for the waste liquids derived from the first and second liquids were arbitrarily adjustable.

The waste ink absorbent member was formed by a fibrous member constituted of pulp.

As regards the distance between the introducing positions, into the waste ink absorbent member, of the waste liquids derived from the first and second liquids, the waste liquids could be absorbed in the entire absorbent member by selecting the shortest distance of such positions within a range of from 5 to 20 cm. Following Examples and Comparative Examples show the results of evaluation when the shortest distance above was selected as 5, 10 and 20 cm.

Example 9

The black ink and the color inks were subjected to measurements of a diffusion velocity into the waste ink absorbent member, by the aforementioned method. 10 ml of each ink was placed in a beaker, in which a waste ink absorbent member was immersed and then taken out after 5 minutes, and a displaced distance of the ink on the waste ink absorbent member was measured. The displaced distance was 1.0 cm/min for the black ink, and 1.5 cm/min for the color ink. Based on these results, the waste liquid derived from the black ink was taken as the first waste liquid, and the waste liquid derived from the color ink was taken as the second waste liquid.

The waste liquids were absorbed in the waste ink absorbent member by selecting an introducing position for the first waste liquid in an upper position of the absorbent member, as indicated by 25 in FIG. 31A, and an introducing position for the second waste liquid in a lower position of the absorbent member, as indicated by 3 in FIG. 31A.

Example 10

The waste liquids were absorbed in the waste ink absorbent member by selecting an introducing position for the first waste liquid, derived from the black ink used in Example 9, in an upper position of the absorbent member, as indicated by 25 in FIG. 32A, and an introducing position for the second waste liquid, derived from the color ink used in Example 9, in a lower position of the absorbent member, as indicated by 3 in FIG. 32A.

Example 11

The waste liquids were absorbed in the waste ink absorbent member by selecting an introducing position for the first waste liquid, derived from the black ink used in Example 9, in an upper position of the absorbent member, as indicated by 25 in FIG. 32A, and an introducing position for the second waste liquid, derived from the color ink used in Example 9, in a lower position of the absorbent member, as indicated by 3 in FIG. 32A.

Comparative Example 12

The waste liquids were absorbed in the waste ink absorbent member by selecting an introducing position for the second waste liquid, derived from the color ink used in Example 9, in an upper position of the absorbent member as indicated by 25 in FIG. 32A, and an introducing position for the first waste liquid, derived from the black ink used in Example 9, in a lower position of the absorbent member as indicated by 3 in FIG. 32A.

Example 13

The first waste liquid, derived from the black ink used in Example 9, and the second waste liquid, derived from the color ink used in Example 9, were both absorbed from an upper part of the waste ink absorbent member, as indicated by the waste liquid introducing parts 25, 3 shown in FIG. 34.

(Result of Evaluation)

(Evaluation of Waste Ink Absorbing Property)

A print pattern of alphabetic characters from A to Z over several lines on a 100% duty solid magenta area, was printed with the black ink on five Canon PPC sheets, and then a suction operation was conducted to introduce the black ink and the color ink into the waste ink absorbent member. This operation was repeated continuously, under replacement of the ink tank from time to time, until 2,000 sheets were printed. The result was evaluated by following criteria, and is shown in Table 7:

+: The waste ink absorbent member sufficiently absorbed the waste inks, without an overflow.

±: The waste ink absorbent member was slow in absorbing the waste inks, almost causing an overflow.

−: The waste ink absorbent member could not completely absorb the waste ink, and caused an overflow.

TABLE 7

| | Example 9 | Example 10 | Example 11 | Comp. Ex. 12 | Comp. Ex. 13 |
|---|---|---|---|---|---|
| Evaluation of waste ink absorbing property | + | + | + | − | ± |

Among the evaluation of the absorbing property of the waste ink absorbent member, Example 11 showed a largest diffusion in the waste ink absorbent member.

This application claims priorities from Japanese Patent Applications No. 2005-192086 filed Jun. 30, 2005, No. 2005-192608 filed Jun. 30, 2005, No. 2005-192609 filed Jun. 30, 2005 and No. 2005-200533 filed Jul. 8, 2005, which are hereby incorporated by reference herein.

The invention claimed is:

1. A plurality of waste ink absorbent members, each of the waste ink absorbent members adapted for use in an ink jet recording apparatus for forming an image with an ink, and adapted for absorbing and holding a waste liquid which does not contribute to the image formation, each of the waste ink absorbent members comprising:

a hole portion for opening an introducing position where the waste liquid is introduced; and a slit extending from the hole portion, wherein a connecting part between the hole portion and the slit has a width smaller than a shortest dimension of the hole portion, passing through a center of the introducing position of the waste liquid, and wherein the hole portions of each of the waste ink absorbent members have the same size and the slits of each of the waste ink absorbent members have the same size, and the plurality of waste ink absorbent members are stacked so that the hole portions are mutually superposed and the slits are mutually superposed.

2. A plurality of waste ink absorbent members according to claim 1, wherein the slit is formed in a perpendicular direction to the hole portion, and a connecting part between the hole portion and the slit has a width smaller than the widths of the hole portion respectively in a direction parallel and a direction perpendicular to a longitudinal direction of the slit.

3. A plurality of waste ink absorbent members according to claim 1, wherein the waste liquid is introduced from above a crossing point between a center line of a width direction of the slit and a center line of the hole portion in a direction perpendicular to the width direction of the slit.

4. A plurality of waste ink absorbent members according to claim 1, wherein the hole portion has such a size that the introduced waste liquid contacts at least a part of each of the waste ink absorbent members.

5. A plurality of waste ink absorbent members according to claim 4, wherein the hole portion is formed corresponding to the introducing position of waste liquid and an area contacted by the waste liquid on an internal surface of the hole portion does not cause an equilibrated state in a surface energy of the waste liquid.

6. A plurality of waste ink absorbent members according to claim 5, wherein the hole portion has an aperture part open on a lateral face of each of the waste ink absorbent members.

7. A plurality of waste ink absorbent members according to claim 5, wherein the internal surface of the hole portion is treated so that the waste liquid has at least two different surface energies.

8. A plurality of waste ink absorbent members according to claim 7, wherein a part of the internal surface of the hole portion is subjected to a hydrophilizing treatment or a water-repellent treatment.

9. A plurality of waste ink absorbent members according to claim 7, wherein a part of the internal surface of the hole portion is formed by a separate member providing the waste liquid with a surface energy different from that provided by each of the waste ink absorbent members.

10. A plurality of waste ink absorbent members according to claim 1, wherein the waste liquid is derived from the ink, wherein the ink is a liquid containing a solvent and a colorant, in which the solvent includes a poor solvent for the colorant, and wherein at least a part of the waste liquid is in contact with each of the waste ink absorbent members and an absorbing ability of each of the waste ink absorbent members for the waste liquid is variable depending on a contact area between the waste liquid and each of the waste ink absorbent members.

11. A waste ink receiving tank adapted for use in an ink jet recording apparatus executing an image formation with an ink and adapted for receiving a waste ink not contributing to the image formation, comprising a plurality of waste ink absorbent members for absorbing and holding the waste liquid, and a tank member accommodating the plurality of waste ink absorbent members, wherein each of the waste ink absorbent members is provided with a hole portion including an introducing position where the waste liquid is introduced, and a slit extending from the hole portion, and a connecting part between the hole portion and the slit has a width smaller than a shortest dimension in the hole portion, passing through a center of the introducing position of the waste liquid, and wherein the hole portions of each of the waste ink absorbent members have the same size and the slits of each of the waste ink absorbent members have the same size, and the plurality of waste ink absorbent members are stacked so that the hole portions are mutually superposed and the slits are mutually superposed.

* * * * *